US009151527B2

(12) United States Patent
Boarman et al.

(10) Patent No.: US 9,151,527 B2
(45) Date of Patent: Oct. 6, 2015

(54) MOLDED CLEAR ICE SPHERES

(71) Applicant: Whirlpool Corporation, Benton Harbor, MI (US)

(72) Inventors: Patrick J. Boarman, Evansville, IN (US); Brian K. Culley, Evansville, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 234 days.

(21) Appl. No.: 13/713,140

(22) Filed: Dec. 13, 2012

(65) Prior Publication Data

US 2014/0165598 A1 Jun. 19, 2014

(51) Int. Cl.
*F25C 1/18* (2006.01)
*F25C 1/22* (2006.01)

(52) U.S. Cl.
CPC .... *F25C 1/18* (2013.01); *F25C 1/22* (2013.01)

(58) Field of Classification Search
CPC ..... F25C 1/18; F25C 5/14; F25C 1/22; F25C 1/00; F25C 3/00; F25C 5/00; F25C 2300/00; F25C 2301/00; F25C 2303/00; F25C 2303/001
USPC ..... 62/71, 344, 347, 74, 75, 3.3, 3.63
See application file for complete search history.

(56) References Cited

U.S. PATENT DOCUMENTS 3,908,395 A 9/1975 Hobbs
4,288,497 A 9/1981 Tanaka et al.
4,487,024 A 12/1984 Fletcher
4,550,575 A 11/1985 DeGaynor
4,910,974 A 3/1990 Hara
5,884,487 A * 3/1999 Davis et al. ..... 62/3.64
6,289,683 B1 9/2001 Daukas
6,857,277 B2 2/2005 Somura
6,951,113 B1 10/2005 Adamski
7,131,280 B2 11/2006 Voglewede
7,448,863 B2 * 11/2008 Yang ..... 425/298
7,669,435 B2 3/2010 Joshi
8,037,697 B2 * 10/2011 LeClear et al. ..... 62/72
8,677,774 B2 * 3/2014 Yamaguchi et al. ..... 62/340

(Continued)

FOREIGN PATENT DOCUMENTS

AU 2006201786 11/2007
CN 1989379 6/2007
FR 2771159 5/1999

(Continued)

*Primary Examiner* — Mohammad M Ali

(57) ABSTRACT

An ice maker adapted to make clear ice spheres includes a mold apparatus having a first mold portion and a second mold portion. The first and second mold portions further include mold cavity segments which define mold cavities when the mold apparatus is assembled in an ice forming position. A cooling source is in thermal communication with the first mold portion of the mold apparatus, such that water injected into the mold cavities is solidified in a directional manner from the first mold portion to the second mold portion to create a clear ice structure. Water is circulated, typically continuously, within the mold cavities to ensure clear ice is formed by injecting and simultaneously ejecting water from the mold cavities during ice formation.

18 Claims, 52 Drawing Sheets

(56) References Cited

U.S. PATENT DOCUMENTS

| | | | | |
|---|---|---|---|---|
| 2004/0099004 | A1* | 5/2004 | Somura | 62/347 |
| 2004/0206250 | A1* | 10/2004 | Kondou et al. | 99/426 |
| 2005/0160741 | A1* | 7/2005 | Park | 62/1 |
| 2006/0288726 | A1* | 12/2006 | Mori et al. | 62/351 |
| 2007/0107447 | A1 | 5/2007 | Langlotz | |
| 2007/0119202 | A1* | 5/2007 | Kadowaki et al. | 62/340 |
| 2009/0173089 | A1* | 7/2009 | LeClear et al. | 62/136 |
| 2010/0055223 | A1* | 3/2010 | Kondou et al. | 425/234 |
| 2010/0218518 | A1 | 9/2010 | Ducharme | |
| 2010/0218540 | A1 | 9/2010 | McCollough | |
| 2010/0218542 | A1 | 9/2010 | McCollough | |
| 2011/0005263 | A1* | 1/2011 | Yamaguchi et al. | 62/347 |
| 2012/0007264 | A1* | 1/2012 | Kondou et al. | 264/28 |
| 2012/0023996 | A1 | 2/2012 | Herrera | |
| 2012/0047918 | A1 | 3/2012 | Herrera | |

FOREIGN PATENT DOCUMENTS

| | | | |
|---|---|---|---|
| GB | 2139337 | | 11/1984 |
| JP | 60141239 | | 7/1985 |
| JP | 1310277 | | 12/1989 |
| JP | 2031649 | | 2/1990 |
| JP | 4015069 | | 1/1992 |
| JP | 10253212 | A | 9/1998 |
| JP | 10253212 | A | 9/1998 |
| JP | 2001221545 | | 8/2001 |
| KR | 2001109256 | | 12/2001 |
| KR | 2006126156 | | 12/2006 |
| KR | 2011037609 | | 4/2011 |
| TW | 424878 | | 3/2001 |
| TW | 484878 | | 3/2001 |

* cited by examiner

MOLDED CLEAR ICE SPHERES

CROSS-REFERENCE TO RELATED APPLICATIONS

The present application is related to, and hereby incorporates by reference, the entire disclosures of the following applications for United States Patents: U.S. patent application Ser. No. 13/713,126 entitled "CLEAR ICE SPHERES," filed on Dec. 13, 2012; U.S. patent application Ser. No. 13/713,131 entitled "MOLDED CLEAR ICE SPHERES," filed on Dec. 13, 2012; and U.S. patent application Ser. No. 13/713,119 entitled "CLEAR ICE HYBRID MOLD," filed on Dec. 13, 2012.

FIELD OF THE INVENTION

The present invention generally relates to an ice maker, and more specifically, to a counter top ice structure producing apparatus adapted to produce clear ice spheres.

SUMMARY OF THE PRESENT INVENTION

One aspect of the present invention includes an ice structure producing apparatus which comprises a first mold portion having an outer surface area that is in thermal communication with a cooling source. The first mold portion further includes at least one mold cavity segment disposed on the outer surface thereof. A second mold portion includes an outer surface area having at least one liquid inlet configured to permit liquid ingress into a mold cavity disposed therein. The second mold portion also includes at least one liquid outlet configured to permit liquid egress from the mold cavity. The second mold portion further includes at least one mold cavity segment disposed on the outer surface thereof. At least one liquid delivery conduit is fluidly connected to the at least one liquid inlet and a liquid source. A liquid departure conduit is fluidly connected to the liquid outlet disposed on the second mold portion. The first mold portion and the second mold portion are configured to engage with one another to form at least one mold cavity which is defined by the mold cavity segments of the first and second mold portions. The cooling source is configured to provide sufficient cooling to produce an ice structure within the mold cavity when liquid capable of freezing solid is injected into the mold cavity through the liquid inlet. The first mold portion is configured to be cooled by the cooling source to a first temperature wherein the first temperature is below a second temperature of the second mold portion during the forming of an ice structure.

Another aspect of the present invention includes an ice mold comprising a substantially metallic first mold portion having an outer surface that is in thermal communication with a cooling source. The first mold portion further includes at least one mold cavity segment disposed on the outer surface. A substantially polymeric second mold portion includes an outer surface having a water inlet and a water outlet disposed thereon. The second mold portion further includes at least one mold cavity segment disposed on the outer surface. The first mold portion and second mold portion are configured to engage one another to form at least one mold cavity which is defined by the mold cavity segments of the first and second mold portions. A drive mechanism is configured to drive the first mold portion and the second mold portion between an ice structure forming position or closed position and an ice harvesting position or open position. An ejector apparatus is coupled to either of the first mold portion or the second mold portion for use in ejecting an ice structure formed in the mold cavity. It is noted that the first mold portion is cooled to a first temperature that is below the temperature of the second mold portion during the forming of an ice structure.

Yet another aspect of the present invention includes an apparatus for making clear ice structures having a first mold portion that is comprised of a metal material. The first mold portion includes an outer surface that is in thermal communication with at least one thermoelectric cooling source that is adapted to cool the first mold portion to a temperature below freezing. The first mold portion further includes at least one mold cavity segment disposed on the outer surface area thereof. A second mold portion comprising a polymeric material includes an outer surface and at least one inlet and at least one outlet disposed thereon. The second mold portion further includes at least one mold cavity segment disposed on the outer surface. The mold cavity segments of the first and second mold portions are adapted to engage with one another to form at least one spherical mold cavity having a diameter in a range from about 20 mm to 80 mm. A motorized drive mechanism is configured to move the first mold portion and the second mold portion between an ice forming position or closed position and a harvesting position or open position. A heat source is engaged with the second mold portion and is configured to emit heat which facilitates a directional freezing of water that is injected into the mold cavity. An ejector pin is coupled to either the first mold portion or the second mold portion, wherein the ejector pin is configured to extend and retract. In the extended position, the ejector pin is disposed partially within the spherical mold cavity and in the retracted position, the ejector pin is disposed substantially within a body portion of either the first mold portion or the second mold portion. The first mold portion of the apparatus has a higher thermal conductivity as compared to the second mold portion.

These and other aspects, objects, and features of the present invention will be understood and appreciated by those skilled in the art upon studying the following specification, claims, and appended drawings.

DETAILED DESCRIPTION OF THE PREFERRED EMBODIMENTS

Figure 1:
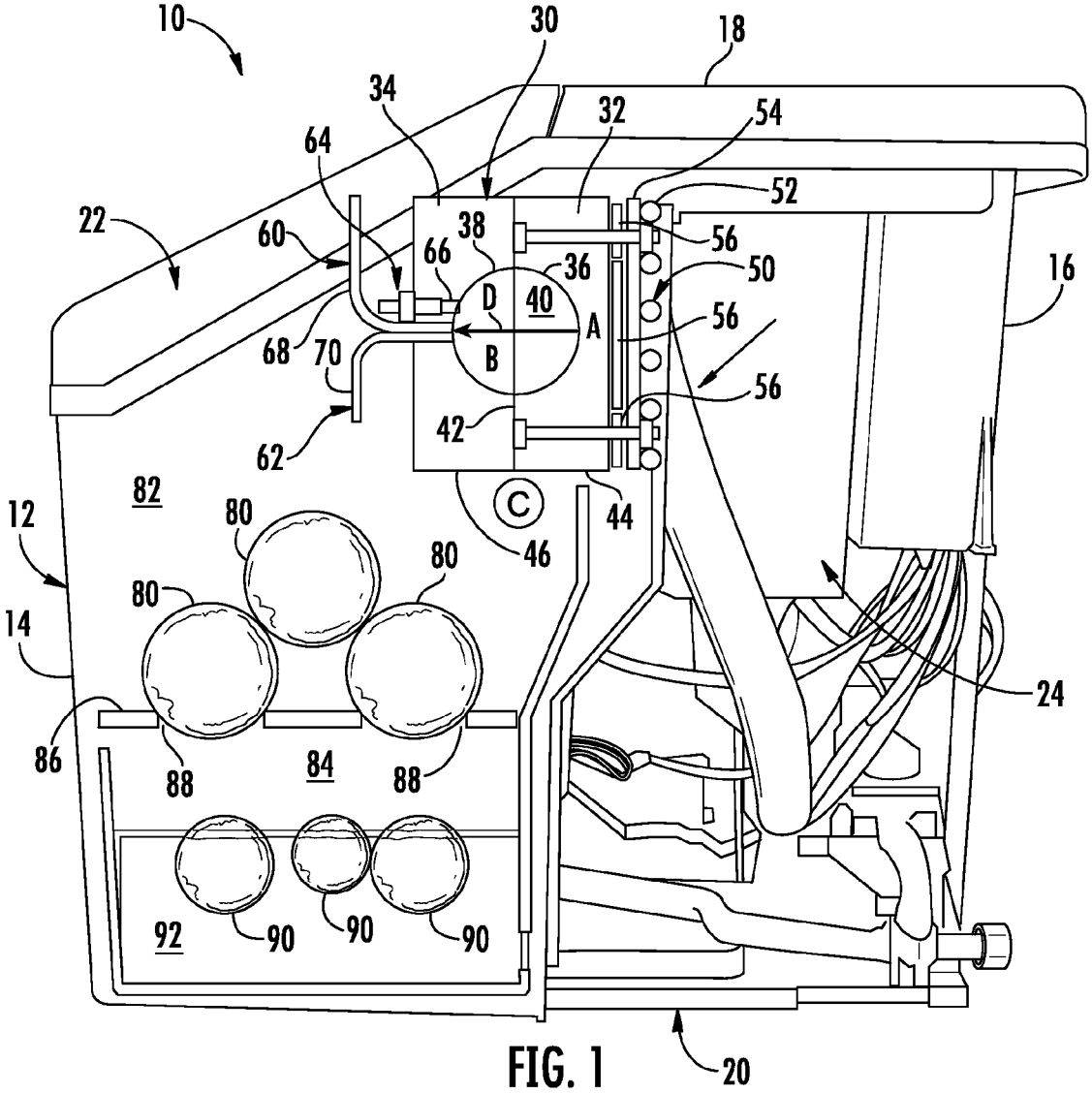
FIG. 1 is a side elevational view of an ice maker according to one embodiment of the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The invention disclosed herein relates to various ice making machines and methods of making ice structures. Generally, the ice making apparatuses of the present disclosure are configured to make clear ice structures, and more specifically, clear ice spheres. The apparatuses generally include a mold comprised of two mold halves described herein as mold portions or mold assemblies. The mold portions generally include mold cavity segments designed to cooperate to form an ice forming mold cavity when the mold portions are assembled. The dimensions and parameters of the mold cavity generally define the shape of the resulting ice structure formed therein and multiple mold cavities may be defined by the assembled mold apparatus such as found in a standard cope and drag mold assembly.

Referring now to FIG. 1, the reference numeral 10 generally designates an ice maker according to one embodiment of the present invention. As shown in FIG. 1, the ice maker 10 includes a housing 12, wherein the housing further includes a front side 14, a rear side 16, a top side 18, a bottom side 20 and an access door 22, which is operable between an open position and a closed position. The ice maker 10 further includes a reserve water reservoir 24 adapted to store water and provide water as needed to form ice structures as further described below. In the embodiment shown in FIG. 1, the water reservoir 24 is configured to feed water into a mold apparatus 30. As shown in FIG. 1, the mold apparatus 30 includes a first mold portion 32 and a second mold portion 34 which are moveably associated with one another, such that the mold apparatus 30 is operable between an open position and a closed position. As shown in FIG. 1, the mold apparatus 30 is in a closed position "C."

The mold apparatus 30 operates to form ice structures, and specifically, to form ice spheres as indicated by reference number 80 in the embodiment of FIG. 1. The first mold portion 32 comprises a mold cavity segment 36. The second mold portion 34 similarly comprises a mold cavity segment 38, such that, as shown in FIG. 1, when the first mold portion 32 and the second mold portion 34 are in the closed position "C," or ice structure forming position, the first mold portion 32 and the second mold portion 34 are configured to engage or abut one another to form at least one mold cavity 40 defined by the mold cavity segments 36, 38 of the first and second mold portions 32, 34. In the closed position "C," the first and second mold portions 32, 34 meet or abut one another at a parting line 42. The first and second mold portions 32, 34 further include outer surfaces 44, 46, respectively, wherein a portion of the outer surface 44 of the first mold portion 32 is in thermal communication with a cooling source 50. As shown in FIG. 1, the cooling source 50 is in the form of an evaporator having evaporator tubes 52 disposed adjacent to an evaporator plate 54. In the embodiment shown in FIG. 1, insulating members 56 are shown disposed between the outer surface 44 of the first mold portion 32 and the evaporator plate 54. The cooling source 50 is thermally engaged with at least the first mold portion 32, and the cooling source 50 is configured to provide sufficient cooling to freeze water injected into the mold cavity 40 as further described below.

Figure 4A:
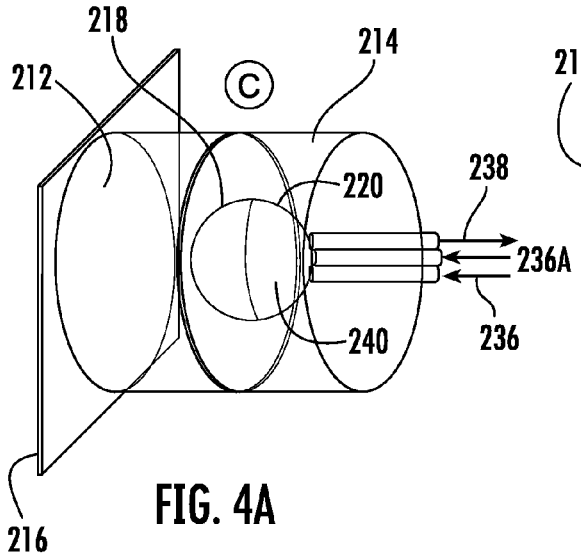
FIG. 4A is a perspective view of a mold apparatus for making ice structures in a closed position.

The second mold portion 34 includes a liquid inlet 60 and a liquid outlet 62, wherein the liquid inlet 60 is configured to permit liquid ingress into the mold cavity 40 and the liquid outlet 62 is adapted to permit liquid egress from the mold cavity 40. As shown in FIG. 1, the liquid inlet and liquid outlet 60, 62 are disposed on a backside of the outer surface 46 of the second mold portion 34. In this way, the inlet 60 and outlet 62 are disposed on an opposite side of the mold apparatus 30 relative to the cooling source 50. As further shown in FIG. 1, the second mold portion 34 includes an ejector apparatus 64 disposed on the backside of the outer surface 46, wherein the ejector apparatus 64 includes an ejector pin 66, which is operable between an extended position and a retracted position. The ejector pin 66 is substantially disposed within a body portion of the second mold portion 34 in the retracted position, as shown in FIG. 1, and extends into the mold cavity segment 38 of the second mold portion 34 in the extended position. In this way, the ejector apparatus 64 is adapted to facilitate the ejection of an ice structure as formed within the mold cavity 40, when the mold apparatus is in an open position "O" or an ice harvesting position as shown in FIG. 4.

As shown in FIG. 1, a fluid or liquid conduit 68 operably couples the water reservoir 24 and the liquid inlet 60, such that the fluid conduit 68 is fluidly connected with the water reservoir 24. The liquid outlet 62 further comprises a liquid departure conduit 70, which is adapted to take water that is not frozen in the mold cavity 40 during the formation of an ice structure, and return this unfrozen water to the water reservoir 24. It is contemplated that the water reservoir 24 is a removable reservoir such that it can be easily cleaned and re-filled by the consumer.

As noted above, the liquid inlet 60 is adapted to supply water from the water reservoir 24 through the liquid delivery conduit 68 into the mold cavity 40. Water entering the mold cavity 40 will generally be injected into the mold cavity 40 and deposited substantially at a position A identified on a back wall of mold cavity segment 36 of the first mold portion 32. Again, it is noted that the first mold portion 32 is in thermal communication with a cooling source 50, such that water entering the mold cavity 40 will freeze within the mold cavity 40 in a direction indicated by arrow D between position A and a position B. In this way, and further described with reference to FIGS. 5-5C, the water entering the mold cavity 40 directionally solidifies layer-by-layer to gradually form a clear ice structure. The mold apparatus 30 is designed to have running water coming in and out of the mold cavity 40 through the liquid inlet 60 and liquid outlet 62 such that the water does not stand still or become stagnant during the freezing or solidification process. The running water feature of the present invention allows for the formation of clear ice structures as the layer-by-layer formation of the ice structures reduces the potential for fracturing the ice structure and the running water feature decreases, if not altogether eliminates, air and minerals that can be trapped in the ultimate ice structure formed.

As noted above, the ice maker 10 of the present invention is designed, in the embodiment shown in FIG. 1, to form clear ice structures such as the clear ice structures 80 shown in FIG. 1. The clear ice structures 80 are ejected into a storage cavity 82 after formation. The storage cavity 82 is accessible through the access door 22 of the ice maker 10. In the embodiment shown in FIG. 1, the storage area 82 is disposed adjacent and above a water circulation reservoir 84. A sizing plate 86, having sizing apertures 88, separates the storage area 82 from the circulation reservoir 84. In use, the sizing plate 86 is adapted to retain clear ice structures 80 in the storage area 82. However, as the ice structures 80 begin to melt or otherwise decrease in overall spherical volume, the ice structures 80 will pass through the apertures 88 disposed on the sizing plate 86. In this way, the sizing plate 86 helps to ensure that the ice structures 80 located in the storage area 82 are freshly formed ice structures that are substantially similar in size for the delivery of a more consistent and predictable product to the consumer. Ice structures 90 that are reduced in size will fall through the apertures 88 in the sizing plate 86 and will be deposited in the circulation reservoir 84. Theses ice structures 90 will remain in an aqueous medium 92 in the circulation reservoir 84 where they will melt and be reincorporated into the ice making process or otherwise drained from the ice maker 10.

Figure 2:
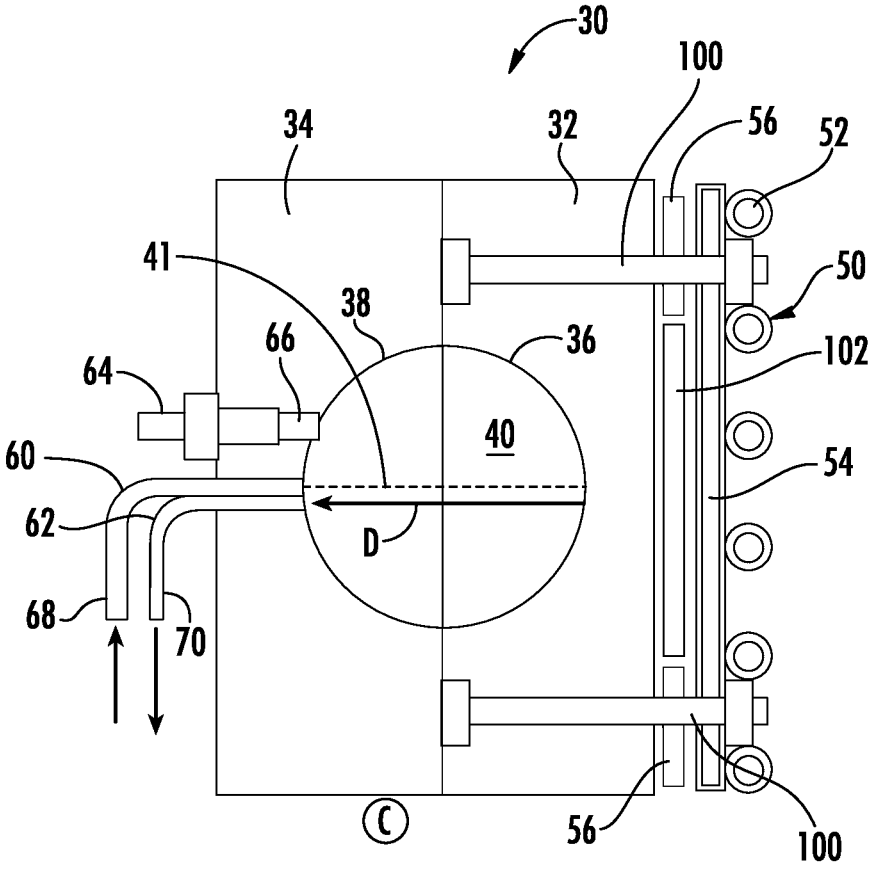
FIG. 2 is a side elevational view of a mold apparatus for making ice structures in a closed position.

Referring now to FIG. 2, the mold apparatus 30 is shown having one or more mold fasteners 100 adapted to a couple of the first mold portion 32 to the cooling source 50. In the embodiment shown in FIG. 2, a thermoelectric plate 102 is disposed between the cooling source 50 and the first mold portion 32, and is adapted to provide cooling to the first mold portion 32. In this way, during the step of freezing of a liquid capable of being frozen solid, water is injected into the mold cavity 40 and the first mold portion 32 is cooled by the cooling source 50 to a first temperature which is lower than a second temperature of the second mold portion 34. Further, it is contemplated that the first mold portion 34 can have a greater thermal conductivity as compared to a thermal conductivity of the second mold portion 34. The thermal conductivities of the first and second mold portions 32, 34 can differ based on the material make-up of the mold portions. For instance, the first mold portion 32 can be comprised of a substantially metallic material, such as an aluminum or copper material, whereas the second mold portion 34 may be comprised of a substantially polymeric material, such as a food grade plastic polymer. In this way, the first mold portion 32 would have a greater thermal conductivity as compared to the second mold portion 34. Having a greater thermal conductivity in the first mold portion 32, as compared to the second mold portion 34, creates a temperature gradient across the first mold portion 32 and the second mold portion 34. As shown in FIG. 2, the temperature gradient will generally follow a path as indicated by arrow D. The thermal gradient of the mold apparatus 30 facilitates directional solidification of ice structures as formed in the mold cavity 40. The material makeup of the mold portions 32, 34 may also vary to include both conductive materials and insulating materials as further described below. As shown in FIG. 2, the mold cavity segments 36, 38 of the first and second mold portions 32, 34 are generally dome-shaped (hemispherically-shaped) mold cavity segments which define a substantially spherically shaped mold cavity 40. With the mold cavity 40 structurally defined in this way, clear ice spheres, such as the clear ice structures 80 shown in FIG. 1, can be formed. It is noted that the mold cavity segments 36, 38 may also be configured to provide clear ice structures of a different form; however, the cavity segments 36, 38 will be depicted throughout this disclosure as dome-shaped (hemispherically-shaped) mold forms for providing clear ice spheres. Further, it is contemplated that the first and second mold portions 32, 34 may include a plurality of mold cavity segments, such that a plurality of clear ice structures can be formed simultaneously during the ice making process.

As shown in FIG. 2, the liquid inlet 60 and liquid outlet 62 are disposed proximate one another; however, it is contemplated that liquid inlet 60 and the liquid outlet 62 can also be coaxially aligned with one another. Further, it is contemplated that liquid inlet 60 and the liquid outlet 62 can share a common aperture disposed on the second mold portion 34, wherein the liquid delivery conduit 68 and the liquid departure conduit 70 would be disposed in a unitary conduit having a liquid delivery channel and a liquid departure channel.

As noted above, and shown in FIGS. 1 and 2, the cooling source 50 can be an evaporator cooling source having a series of evaporator tubes 52 which are in thermal communication with an evaporator plate 54 which may also be in thermal communication with a thermoelectric plate 102. It is further contemplated that the cooling source 50 could be a secondary cooling loop or a cool air supply where air below freezing temperature is provided about the first mold portion 32 to freeze circulating water in the mold cavity 40.

Figures 5, 5A, 5B, 5C:
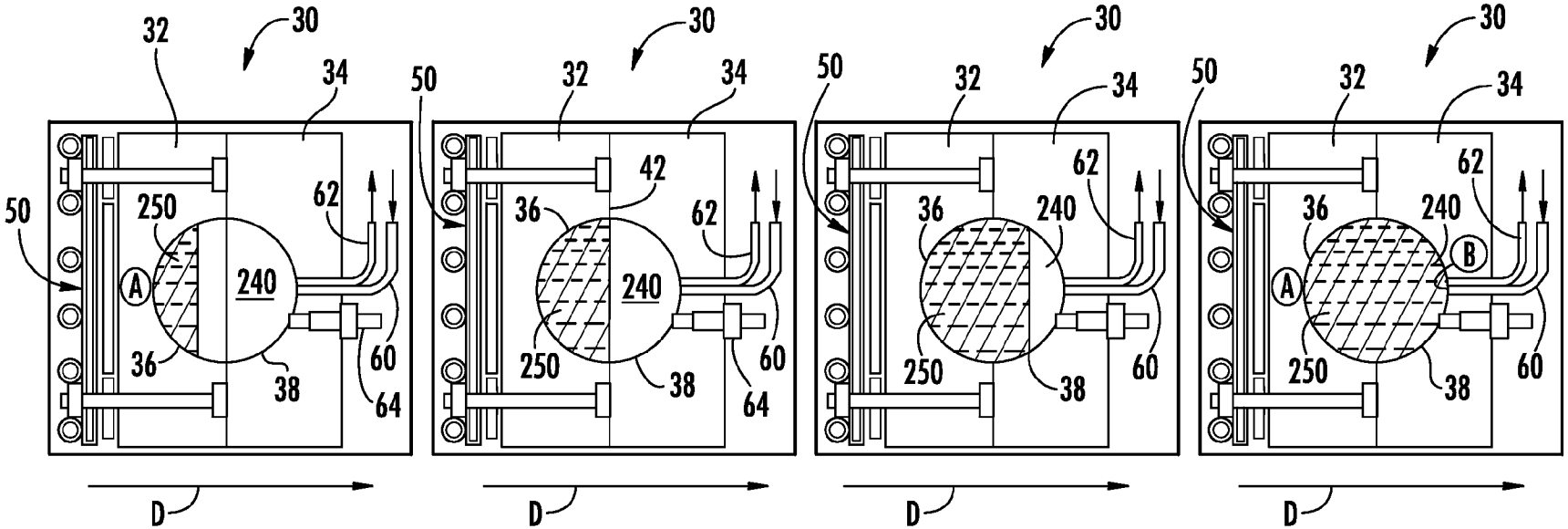
FIGS. 5-5C are side elevational views of a mold apparatus depicting directional solidification of an ice structure within the mold apparatus.

As shown in FIGS. 1, 2 and 5, the first and second mold portions 32, 34 are substantially rectangularly prism shaped mold forms which define a substantially spherical mold cavity 40. The mold cavity 40 has an equatorial plane 41, which is a plane through the center of the spherical mold cavity 40. In FIG. 2 an equatorial plane may be aligned with the liquid inlet 60. The ejector pin 66 of the ejector apparatus 64 is generally disposed off-set from the center of an equatorial plane 41 of the mold cavity 40 aligned with the liquid inlet 60. The ejector pin 66 is configured to project into the mold cavity 40 through mold cavity segment 38 of the second mold portion 34 in order to eject a clear ice structure as formed in the mold cavity 40. In this way, the ejection pin 66 is adapted to apply a force to an ice structure, such as ice structures 80 shown in FIG. 1, as formed within the mold cavity 40 to eject the ice structures into the storage area 82.

Figure 2A:
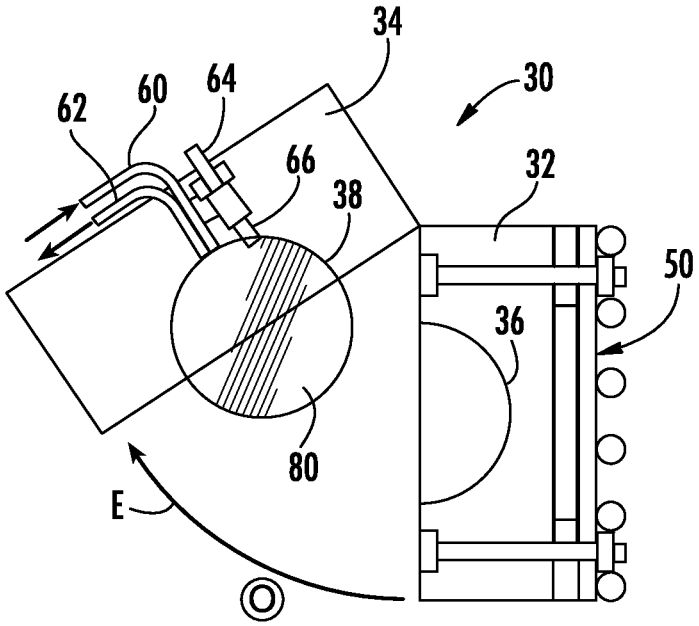
FIG. 2A is a side elevational view of the mold apparatus of FIG. 2 in an open position.

Referring now to FIG. 2A, the mold apparatus 30 is in an open position O wherein the second mold portion 34 has been pivoted along a path as indicated by arrow E to open the mold apparatus 30 such that the clear ice structure 80 can be ejected therefrom. The ejection apparatus 64 can be used to apply a force to the clear ice structure 80 by the ejection pin 66 being moved to an extended position into the mold cavity segment 38 of the second mold portion 34.

Figure 3:
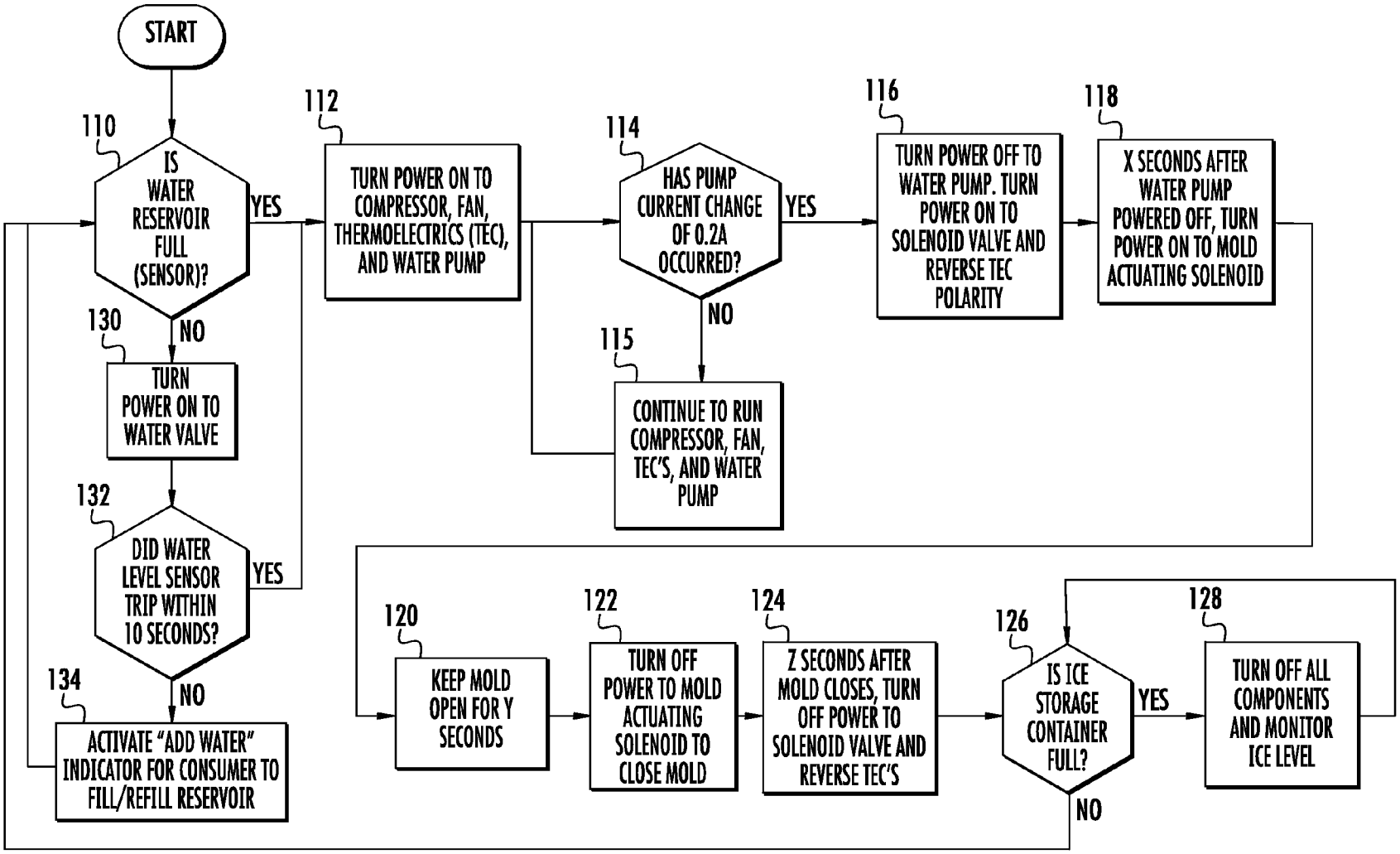
FIG. 3 is a diagrammatical flowchart depicting an ice making process.

Referring now to FIG. 3, a diagrammatical flow-chart of an ice making process is depicted which begins with a step of determining the water level of a water reservoir 110. If it is determined that the water reservoir is full, power is provided to a compressor, a fan, a thermoelectric cooling source, and a water pump 112 to begin the ice making process. Next, a determination is made as to whether a power supply to the pump has undergone a current change of approximately 0.2 amps 114 or any other like current change indicating that the ice maker water loop is near full. The pump will generally run at a current of approximately 0.8 amps depending on a predetermined flow rate. When a current change of 0.2 amps has occurred, this generally indicates that a sufficient amount of water has been supplied to the mold apparatus which then triggers the ice maker to turn off power to the water pump, as indicated in step 116 of FIG. 3, and also to supply power to a solenoid valve and reverse the polarity of the thermoelectric unit. As shown in FIG. 3, if a current change of 0.2 amps has not occurred, the ice maker will continue to run the compressor, fan, thermoelectric unit, and water pump as indicated in step 115 until the current change of 0.2 amps is detected. After 60-360 seconds of having the water pump powered off, a mold actuating solenoid is powered on 118. A mold apparatus, operable between an open position and a closed position, is held in the open position for 60-120 seconds 120. After the mold apparatus is held in the open position for 60-120 seconds, power to the mold actuating solenoid is terminated to move the mold apparatus to the closed position 122. After 30-60 seconds of the mold apparatus being in the closed position, power is terminated to the solenoid valve and the polarity of the thermoelectric unit is reversed 124. A sensor then indicates whether an ice storage container is full 126. The sensor is adapted to detect whether an ice storage container contains a certain volume of ice structures. If the ice storage container is determined to be full, then power is terminated to all components and the ice level in the ice storage container is monitored 128. If the ice storage container is determined to be empty, or not full, the ice maker begins the ice making process again at step 110 as shown in FIG. 3 of determining the water level in a water reservoir. As shown in FIG. 3, if the water reservoir is determined to be empty or not full, power is supplied to a water valve and a determination is made whether a water level sensor has been tripped within 10 seconds 132. If a water level sensor has been tripped within 10 seconds, then the ice maker moves to step 112 shown in FIG. 3 of the ice making process. If the water level sensor is not tripped within 10 seconds, as indicated in step 132 of FIG. 3, than an indicator is activated which alerts the consumer to add water to the water reservoir 134.

Figure 4B:
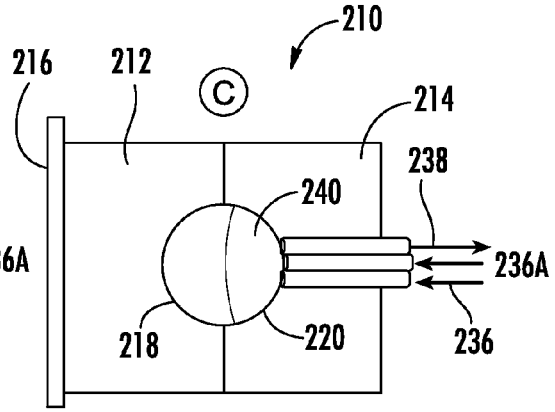
FIG. 4B is a side elevational view of the mold apparatus of FIG. 4A.
Figure 4:
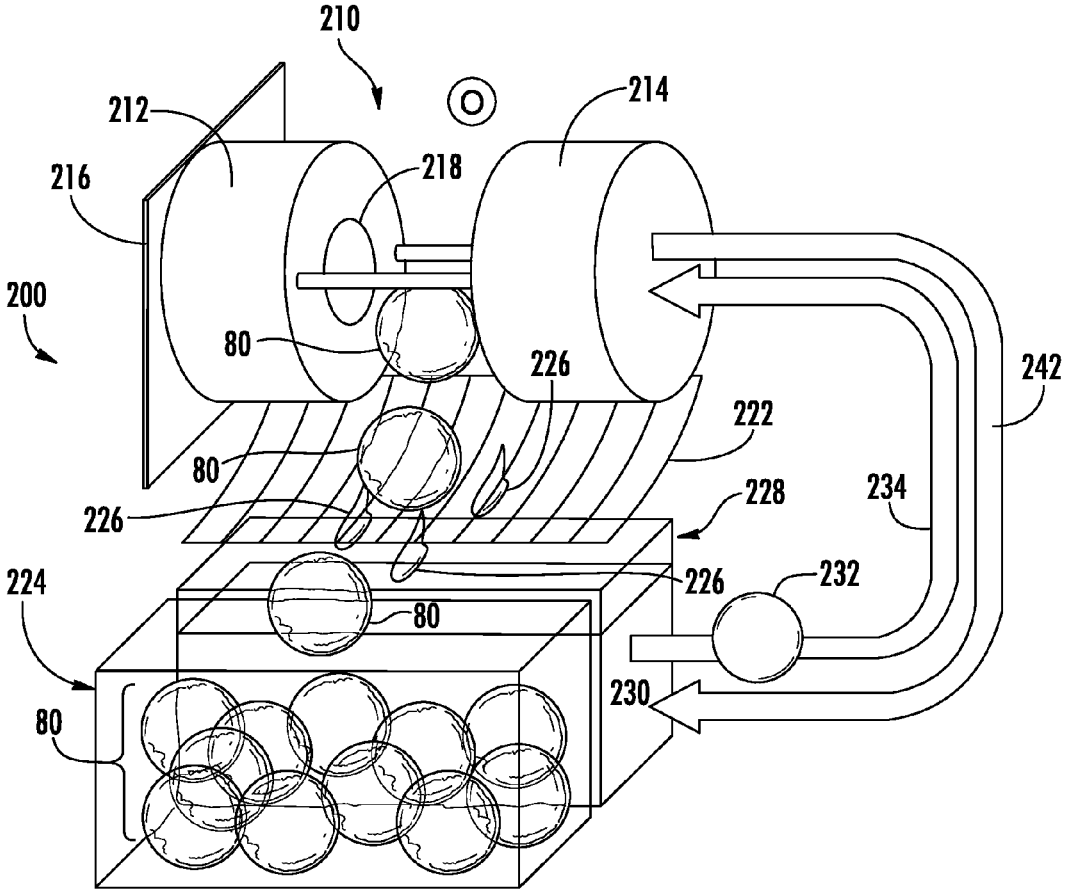
FIG. 4 is a perspective view of an ice maker according to another embodiment of the present invention.

Referring now to FIGS. 4-4B, an ice maker 200 is shown, according to another embodiment of the present invention, having an ice mold apparatus 210. The ice mold apparatus 210 is shown in FIG. 4 in an open position "O" or in ice harvesting position. As shown in FIGS. 4A and 4B, the mold apparatus 210 is shown in a closed position or an ice structure forming position "C". The ice mold apparatus 210 comprises a first mold portion 212 having an outer surface which is in thermal communication with a cooling source, which is depicted in FIGS. 4-4B as an evaporator plate 216. A second mold portion 214 is also incorporated into the ice mold apparatus 210 and is movably associated with the first mold portion 212 between the open position "O" and the closed position "C." The evaporator plate 216 provides a cooling source in thermal communication with the first mold portion 212 as the first mold portion 212 is disposed adjacent to the evaporator plate 216. In this way, the evaporator plate 216 is able to provide cooling to the mold apparatus 210 in order to freeze a liquid capable of freezing solid to form a solid ice structure form within the mold apparatus 210. As shown in FIGS. 4-4B, the first mold portion 212 includes a mold cavity segment 218, and the second mold portion 214 similarly includes a mold cavity segment 220. In the closed position "C," the mold cavity segments 218, 220 are aligned with one another as the first and second mold portions 212, 214 are engaged with one another. With the first and second mold portions 212, 214 engaged with one another in the closed position "C," a mold cavity 240 is formed therebetween as defined by the mold cavities segments 218, 220 of the first and second mold portions 212, 214.

As shown in FIG. 4, the ice mold apparatus 210 is in the ice harvesting position "O" wherein ice structures 80, formed in the ice mold cavity 240, are ejected from the ice mold apparatus 210, such that they are gravitationally fed onto an angled chute 222 that feeds the ice structures 80 into an ice storage container 224. The chute 222 is generally an angled grate structure which allows for access water 226 to pass through the chute 222 into a water reservoir 228 disposed directly below the chute 222 which stores water 230 that is supplied to the mold apparatus 210 for forming clear ice structures 80. As shown in FIG. 4 a pump apparatus 232 is disposed on a supply line 234 and adapted to supply water from the water reservoir 228 to the mold apparatus 210. The water supply line 234 is adapted to provide water to the mold apparatus 210 through a liquid inlet 236 shown in FIGS. 4A and 4B. Simultaneously, as water is being supplied to the mold cavity 240 through the water inlet 236, a water outlet 238 is adapted to allow for liquid egress from the mold cavity 240 as shown in FIGS. 4A and 4B, such that unfrozen water can return to the water reservoir 228 through a liquid departure conduit 242 shown in FIG. 4. The liquid inlet 236 and liquid outlet 238 work in concert to provide for constant movement of water within the mold cavity 240. The constant movement of running water within the mold cavity 240 helps to provide for the formation of clear ice structures in the mold cavity 240 and also ensures that minerals and other impurities get washed out of the mold cavity 240 and are not then frozen into the formed ice structures. The cycling of water into and out of the mold cavity 240 further helps prevent fracturing of the formed ice structures. If the liquid injected into the mold cavity 240 freezes too fast, thermal shock can occur and the ice structures can develop cracks. The water entering the cavity 240 is generally at a temperature from about 32.5 to about 33.5° Fahrenheit. If the water entering the mold cavity 240 is too warm, it takes too long for the water to freeze. If the temperature of water entering the mold cavity 240 is vastly different from the temperature of the ice already formed therein, fractures can develop. With the water flowing constantly, the rate of ice formation is reduced and air is kept out of the formed ice structure. With the water injected into the mold cavity 240 constantly moving over a freezing surface of the mold apparatus 210, the air that is inside of the water will stay in the liquid form and will not freeze into the ice structure. If water is not flowing in the mold cavity 240 during ice formation, then the air trapped within the water could become part of the formed ice structure which results in very cloudy ice structures. The directional solidification process of the present invention is further described with reference to FIGS. 5-5C.

As shown in FIGS. 4A and 4B, a second water inlet 236A is disposed on the second mold portion 214 and is provided on an outer surface of the mold cavity 240. As shown in FIGS. 4A and 4B, the water inlet and water outlet 236, 238 are generally disposed inside the mold cavity 240, however, water inlet 236A is provided to facilitate with the ejection of an ice structure from the mold apparatus 210 when the mold apparatus 210 is in the harvesting position or open position "O." The second water inlet 236A provides a force that is applied to a frozen ice structure to help eject the frozen ice structure from the second mold form 214.

As noted above, in order to provide clear ice structures, it is important to provide constant water flow within a mold cavity such that water freezes gradually in a layer-by-layer fashion, such that no air bubbles or impurities are trapped in the ultimate ice structure formed. Thus, a thermal gradient across the mold apparatus is desired and further described with reference to FIGS. 5-5C.

FIGS. 5-5C depict a mold apparatus 30 similar to mold apparatus 30 shown in FIG. 2. Thus, the reference numerals identifying features of the mold apparatus 30 found in FIG. 2 will be used to describe the solidification process shown in FIGS. 5-5C. As noted above, the first mold portion 32 is in thermal communication with the cooling source 50, such that the first mold portion 32 is cooled to a first temperature which is lower than the temperature of the second mold portion 34. This creates a thermal gradient from the first mold portion 32 to the second mold portion 34 in a direction as indicated by arrow D. As shown in FIG. 5, the mold apparatus 30 is in a closed position during the water solidification process, or otherwise referred to as the ice structure formation process or the freezing of running water. As noted above, water is injected into the mold cavity 240 from the water inlet 60 and ejected from the mold cavity 240 through the water outlet 62. As shown in FIG. 5, an ice structure 250 has begun to form in the at least one mold cavity segment 36 of the first mold portion 32. While the mold cavity 240 may be filled entirely with running cold water that is injected and ejected through the water inlet 60 and water outlet 62, the formation of the ice structure 250 begins in the first mold portion 32 which is in thermal communication with the cooling source 50 due to the thermal gradient of the mold apparatus 30. As shown in FIG. 5A, the ice structure 250 has further developed in a gradual layer-by-layer formation, such that the ice structure 250 is a layer-formed clear ice structure. As indicated in FIG. 5A, the ice structure 250 has generally developed to fill the mold cavity segment 36 of the first mold portion 32. Referring now to FIG. 5B, the ice structure 250 has further developed by the freezing of running water disposed in the mold cavity 240, such that the ice structure 250 now has reached a point in its formation where the ice structure 250 is partially disposed within the at least one mold cavity segment 38 of the second mold portion 34. As shown in FIG. 5C, the clear ice structure 250 has now completely formed within the mold apparatus 30 such that the clear ice structure 250 substantially fills the mold cavity segments 36, 38 of the first and second mold portions 32, 34. Thus, as shown in FIG. 5C, the ice structure 250 is a complete clear ice sphere as formed in the mold apparatus 30. The directional solidification of the ice structure 250 as indicated in FIGS. 5-5C is a gradual layer-by-layer ice structure formation which follows a thermal gradient path as indicated by arrow D from a position A, disposed in mold cavity segment 36 of the first mold portion 32 nearest the cooling source 50, to a position B disposed adjacent the water inlet and water outlet valves 60, 62 of the second mold portion 34. Thus, location B is the generally last place ice is formed in the ice formation process of creating the ice structure 250.

A method of using the ice structure producing apparatus 30 depicted in FIGS. 1-5C will now be described. The ice making apparatus 10, as shown in FIG. 1, is used to make clear ice structures 80 by using a method that includes the steps of providing a mold, which includes a first mold portion 32 and a second mold portion 34. The first mold portion is in thermal communication with a cooling source 50 and includes at least one mold cavity 36 disposed on an outer surface 44. A second mold portion 34 is further provided having an outer surface 46, at least one liquid inlet 60 configured to permit liquid ingress and at least one liquid outlet 62 configured to permit liquid egress. The second mold portion 34 further includes at least one mold cavity segment 38 disposed on the outer surface 46. After a mold has been provided, the first mold portion 32 and the second mold portion 34 are assembled such that the mold cavity segments 36, 38 engage with one another to form at least one mold cavity 40. The next step in the method of making clear ice structures includes cooling the first mold portion 32 to a first temperature using the cooling source 50. Liquid is then injected into the mold cavity 40 through the liquid inlet 60 to fill the mold cavity 40. During a freezing or solidification stage, a portion of the injected liquid is frozen within the mold cavity 40 to form at least one ice structure, such as the ice structures 80 shown in FIG. 1. The next step of the method of making clear ice structures includes disassembling the first mold portion 32 from the second mold portion 34 to release the at least one ice structure. It is noted that in the method of making the clear ice structures 80 shown in FIG. 1, the first temperature of the first mold portion 32 is a temperature below a second temperature of the second mold portion 34 during the freezing or solidification phase of the liquid injected into the mold cavity 40. The first temperature of the first mold portion 32 is generally maintained below a second temperature of the second mold portion 34 during the entire step of freezing the liquid within the mold cavity 40.

As noted above, a method of making clear ice structures includes solidifying a portion of the liquid injected into the mold cavity 40 by gradually freezing the liquid along the solidification path from the first mold portion 32 to the second mold portion 34. It is noted that the first mold portion 32 can be chilled before the step of injecting a liquid into the mold cavity 40. Further, it is noted that a portion of the liquid can be ejected from the mold cavity 40 during the solidification process through the liquid outlet 62, such that a portion of the liquid injected into the mold cavity 40 is simultaneously ejected to produce constant movement of the liquid in the mold cavity 40. As shown in the embodiment of FIGS. 5-5C, the liquid inlet 60 and the liquid outlet 62 are the only liquid access apertures into and out of the mold cavity 40.

In assembling and disassembling the mold apparatus 30, it is contemplated that a motorized drive mechanism may be used to drive the first mold portion 32 and the second mold portion 34 into engagement with one another, wherein the first mold portion 32 and the second mold portion 34 abut one another. Examples of mold closure mechanisms and automated drive mechanisms for the mold apparatus 30 are further described below. Also, as noted above, the first mold portion 32 and the second mold portion 34 can be comprised of different materials which help to create the thermal gradient, identified as arrow D in FIGS. 5-5C, across the mold apparatus 30. In facilitating the creation of a thermal gradient, the first mold portion 32 can be comprised substantially of a metallic material, such as a copper or an aluminum material. The second mold portion 34 can be comprised of a substantially polymeric material which has a lower thermal conductivity as compared to the first mold portion 32. As shown in FIGS. 5-5C, the method of making an ice structure may also include the use of an ejector apparatus configured to eject the clear ice structures from the mold assembly 30. As shown in FIGS. 5-5C, the ejector apparatus 64 includes an ejecting pin 66 adapted to apply a force on the ice structure formed within the mold cavity 40 to eject the ice structure.

Figure 6:
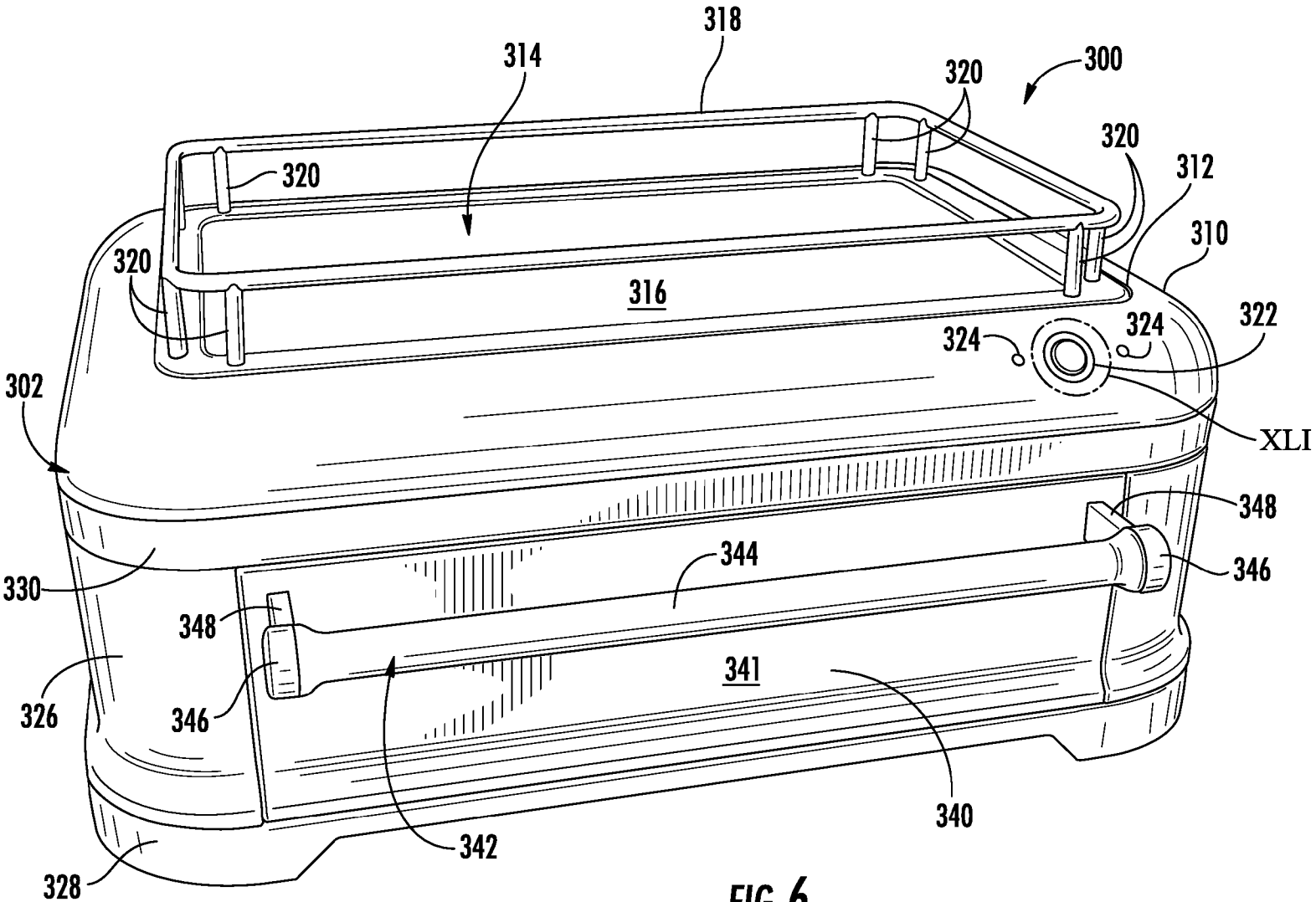
FIG. 6 is a front perspective view of an ice maker according to another embodiment of the present invention.
Figure 8:
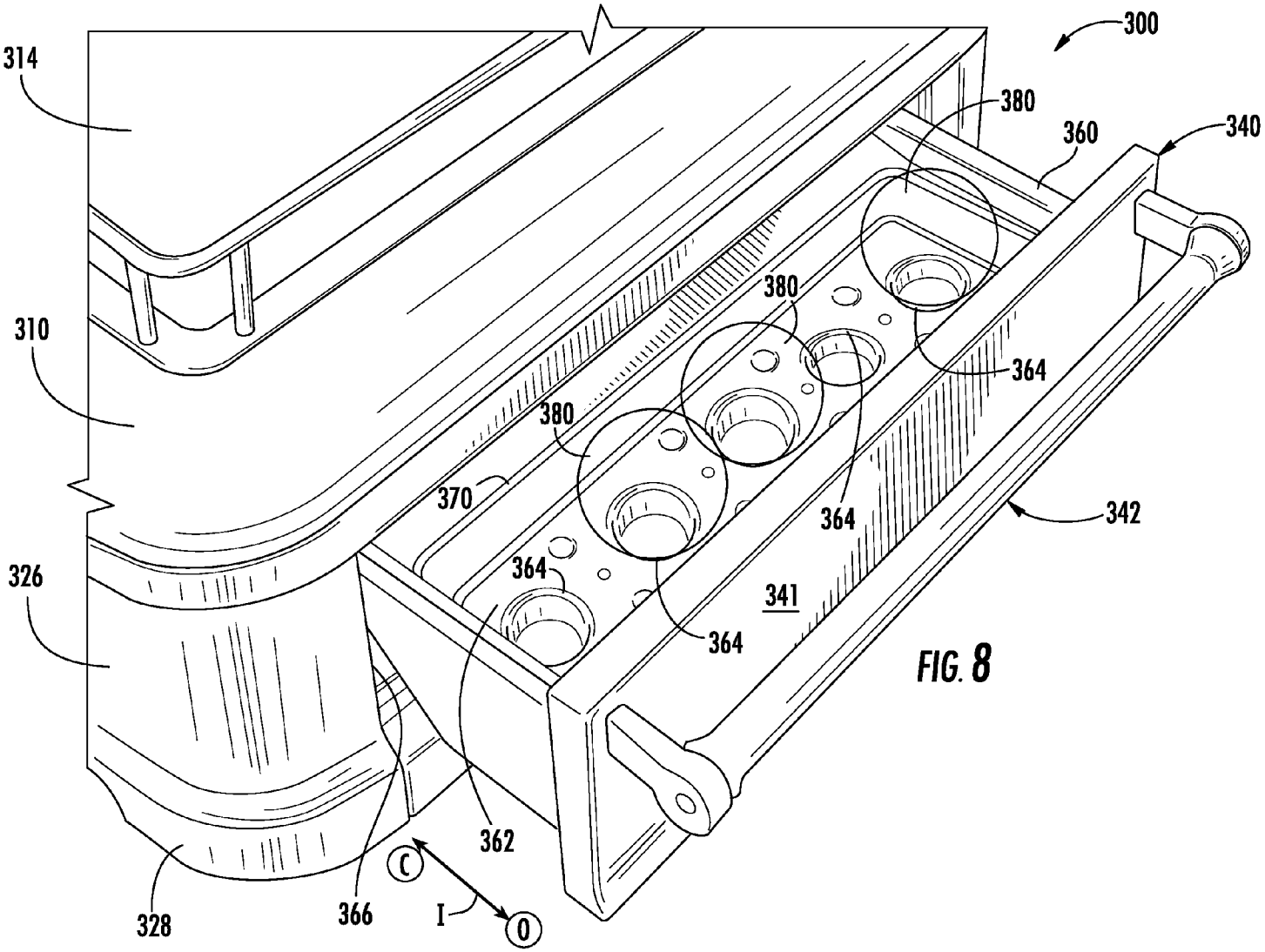
FIG. 8 is a fragmentary front perspective view of the ice maker of FIG. 6 having a ice structure delivery door in an open position.

Referring now to FIG. 6, the reference numeral 300 generally indicates an ice maker according to another embodiment of the present invention. The ice maker 300 includes an outer housing 302 which essentially comprises an upper housing portion 310 and a lower housing portion 326. The upper housing portion includes an upper tray receiving area 312 which, in FIG. 6, has a removable tray 314 disposed therein. The tray 314 includes a generally planar tray surface 316 surrounded by a rail 318, which is supported above the tray surface 316 by supports 320. The tray 314 is contemplated to be a plastic tray which may include a molded pattern disposed on the planar tray surface 316, which can be a clear soft touch surface, a matte coating surface or a leather insert fully covering the planar tray surface 316. The upper housing portion 310 further includes a function button 322 along with one or more illuminated status indicators 324, which are used in conjunction with the function button 322 to communicate ice making information to the consumer. The housing or outer casing 302 of the ice maker 300 further includes a base portion 328. As shown in FIG. 6, the lower housing 326 is separated by the upper housing 310 by a trim band 330 which may be comprised of a metallic material such as aluminum. The front portion of the ice maker 300 is shown in FIG. 6 and includes an ice structure delivery drawer 340 having a handle 342 disposed thereon. The handle includes a handle bar portion 344, end caps 346 and support members 348, which offset the handle bar portion 344 from the ice structure delivery drawer 340. The ice structure delivery drawer 340 is operable between a closed position, as shown in FIG. 6, and an open position, as shown in FIG. 8, where ice structures can be retrieved from the ice structure delivery drawer 340 in the open position. The handle bar portion 344 of the handle 342 may include a leather wrap for a more aesthetically pleasing look and the end caps 346 may further include a plated steel or chrome feature to provide a finished look for the handle 342.

Figure 7:
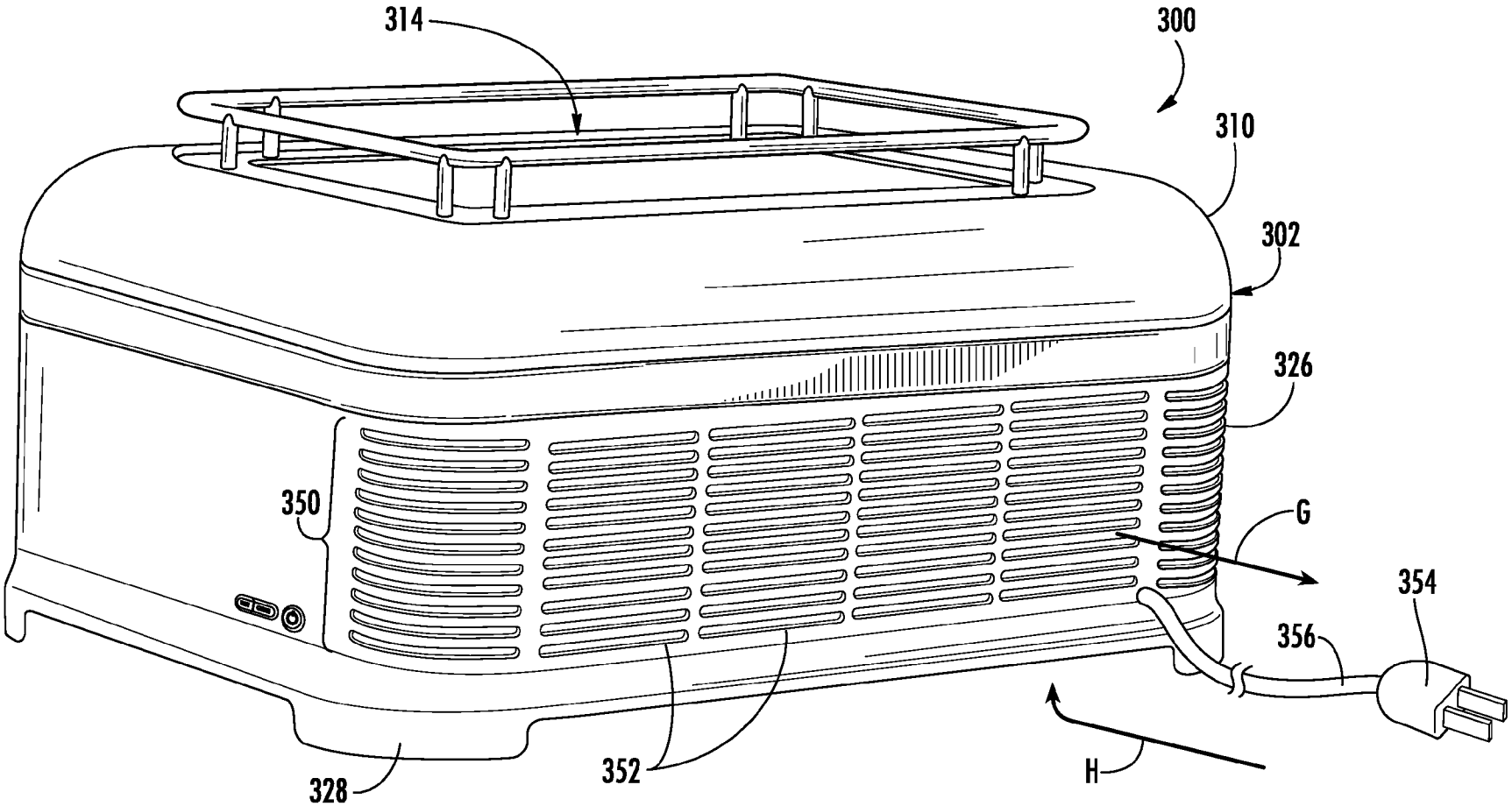
FIG. 7 is a rear perspective view of the ice maker of FIG. 6.

Referring now to FIG. 7, the ice maker 300 includes an upper casing or housing portion 310 and a lower casing or body portion 326 which form an exterior shell or outer housing 302. It is contemplated that the two-piece design of the upper casing 310 and lower casing 326 makes for a more serviceable product. The upper casing 310 and lower casing 326 can be comprised of a variety of materials including aluminum alloy, zinc or a rigidified polymeric material. The base portion 328 could be a stamped metal part or could be made from a polymeric material such as an injection molded thermoplastic material. As shown in FIG. 7, the rear portion of the lower housing 326 comprises a vent portion 350 having a plurality of vents 352 adapted to allow air out of the ice maker 300 in a direction as indicated by arrow G. In forming the ice structures, air circulation is required for cooling sources housed within the ice maker 300. It is contemplated that air can be drawn in through the bottom plate of the ice maker 300 in a direction as indicated by arrow H. The plurality of vents 352 disposed on the rear portion of the lower casing 326 are typically disposed in a generally linear spaced apart pattern; however, it is contemplated that any vent pattern or layout can be used with the ice maker 300 so long as adequate air flow is accommodated. The ice maker 300, as shown in FIG. 7, is connected to a power source by a plug 354 having an electrical cord 356 extending from the rear portion of the lower casing 326.

As shown in FIG. 8, the ice structure delivery drawer 340 is in an open position where it is shown that the handle 342 is operably coupled to a door face 341 which is further connected to a compartment or tray member 360 having a bottom wall 362 which includes apertures 364. The apertures 364 serve as placement and retaining apertures for ice structure 380 disposed within the tray 360. The ice structure delivery door 340 is again operable between an open position O and a closed position C in a direction as indicated by arrow I. In the closed position C, as shown in FIG. 6, the tray 360 is generally disposed within the housing 302. As shown in FIG. 8, in the open position O, the ice structures 380 are readily retrievable by the consumer through an aperture 366 disposed on the front wall of the lower casing 326. It is noted that the ice structures 380 are clear ice spheres produced by similar methods described above. In the embodiment shown in FIG. 8, the tray 360 includes five retaining apertures 364 for positioning and retaining formed ice structures 380; however, it is contemplated that the ice maker 300 of the present invention can include any number of ice positioning structures, limited only to the size of the ice maker 300 and the corresponding ice delivery tray 360. As further shown in the embodiment of FIG. 8, the ice delivery tray 360 may include an illumination source 370 which, in this embodiment, is shown as a channel disposed about the perimeter of the ice delivery tray 360. The illumination source 370 is contemplated to house a plurality of LED lights that are used to illuminate the tray 360 and the ice structures 380 housed therein. The illumination source 370 may also comprise a variety of colored LED light sources to provide aesthetically pleasing atmosphere that can be altered to the consumer's preference regarding color and brightness. Light may also be delivered from a more remote light source via one or more light pipes to illuminate the ice spheres from beneath the ice spheres or otherwise illuminate the clear ice spheres.

Figure 9:
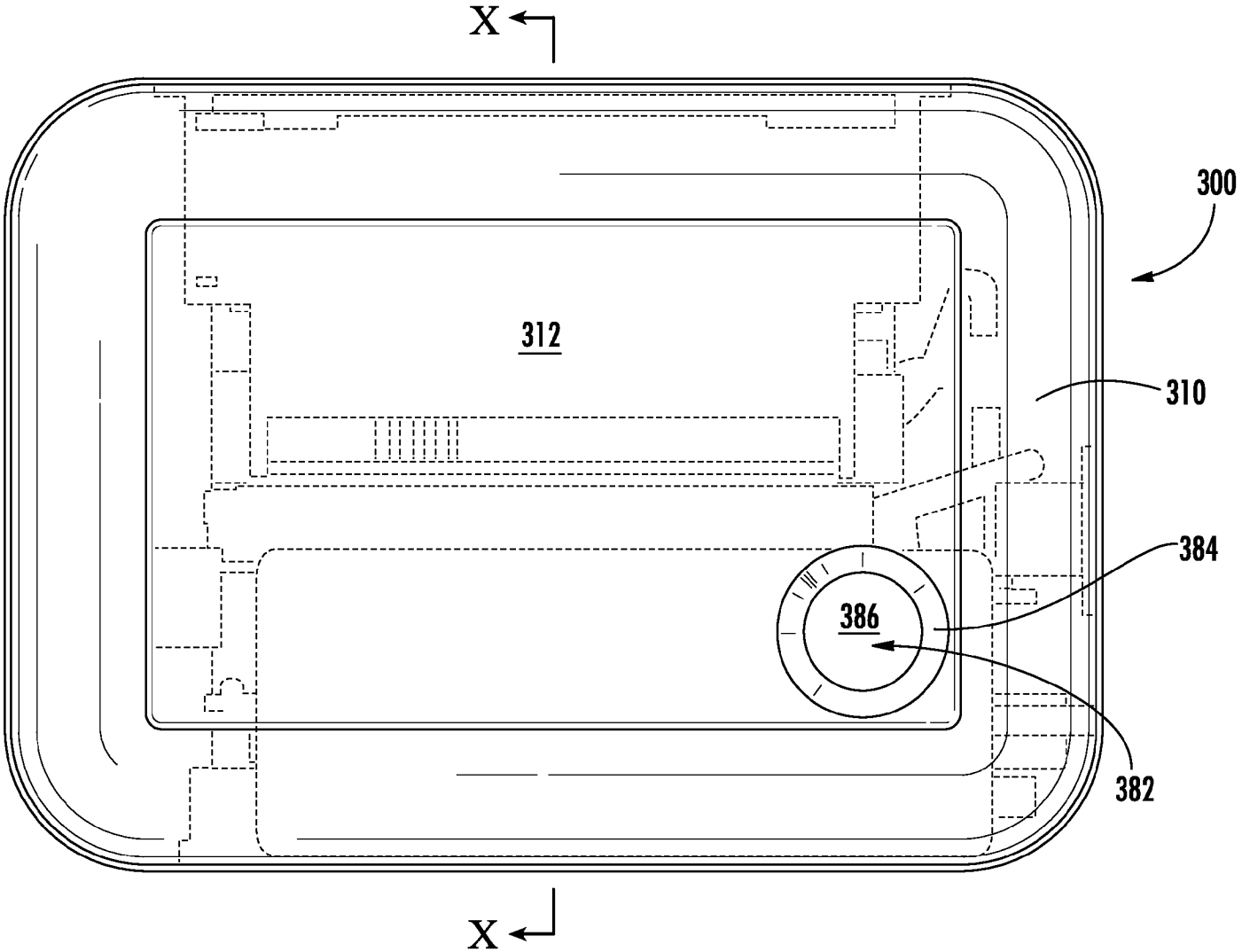
FIG. 9 is a top plan view of the ice maker shown in FIG. 6 having a fill cap disposed on an outer casing and inner components shown in phantom.

Referring now to FIG. 9, the ice maker 300 is shown from a top plan view, wherein the tray 314 has been removed such that the tray receiving area 312 is revealed. Disposed in a corner of the tray receiving area 312, a fill cap 382 is shown having a rim portion 384 and a cap portion 386. It is contemplated that the cap 386 may be threadingly engaged with the rim portion 384, or may be a push-push fill cap. When threadingly engaged, the cap portion 386 can be fully removed such that the user can supply water to the ice maker 300. When a push-push fill cap mechanism is incorporated, the user will push downwardly on the cap portion 386 such that the cap portion raises up from the rim housing 384 which then allows for the user to supply water to the ice maker 300 in the space between the upper portion of the cap 386 and the rim 384. A magnetic coupling of the rim portion 384 and cap portion 386 is further contemplated. The rim 384 may also include a downwardly angled surface to facilitate the filling of the ice maker 300 with water.

Figure 10:
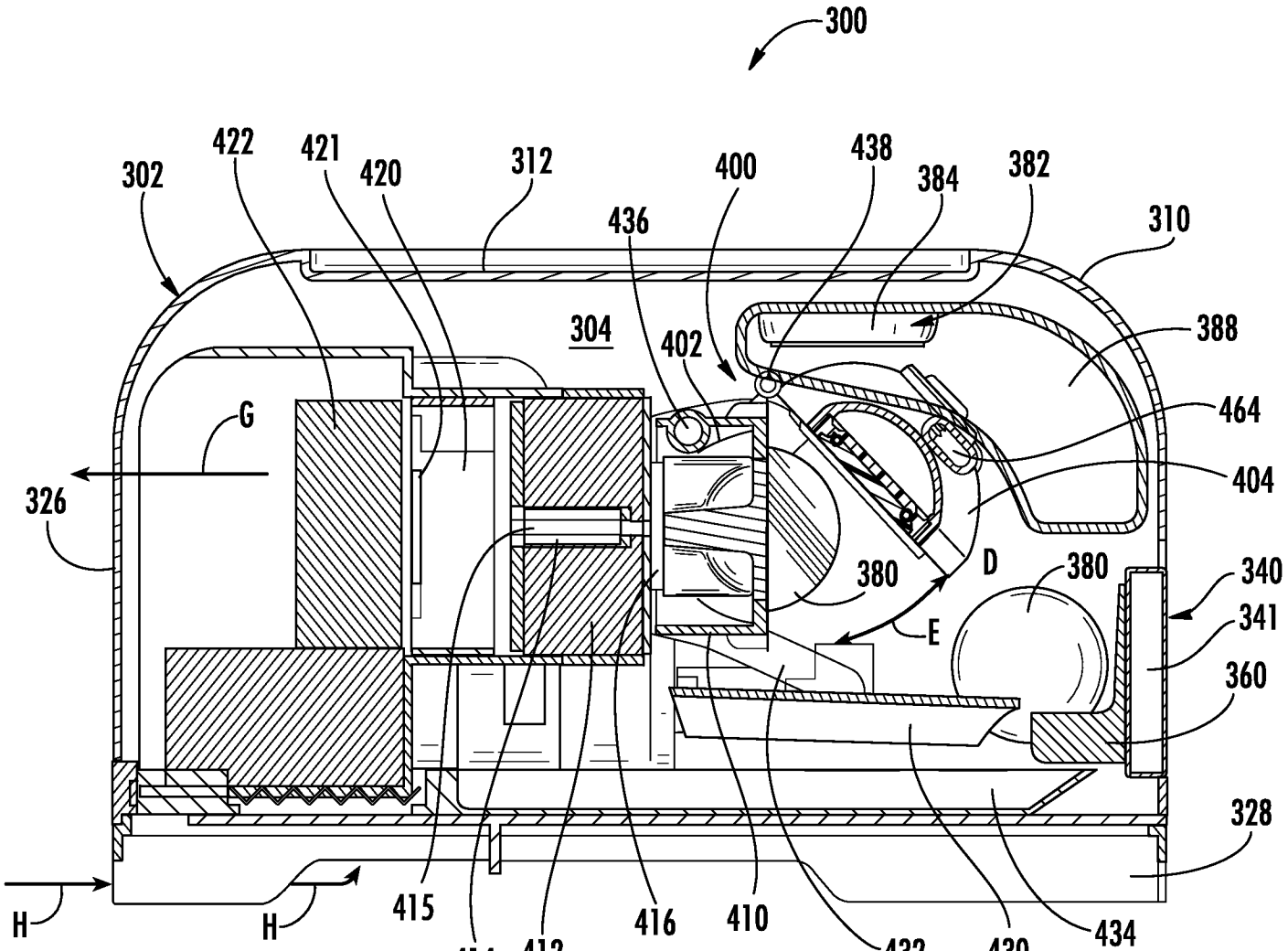
FIG. 10 is a cross-sectional side elevational view taken along line X of FIG. 9.

As shown in FIG. 10, a cross-section of the ice maker 300 is shown taken along line X of FIG. 9. In an inner cavity 304, surrounded by the outer casing 302, the inner workings of the ice maker 300 are shown. It is noted that the inner cavity 304 is surrounded by the outer casing 302. The outer casing 302 may be a two-component outer casing made up of an upper casing 310 and a lower casing 326, or the outer casing 302 can be a single unitary piece that is coupled to a base portion 328 forming an outer shell of the ice maker 300.

As shown in FIG. 10, the fill cap 382 is disposed within the inner cavity 304 and the housing portion 384 extends into a water reservoir 388. In use, the water reservoir 388 holds water necessary for making ice structures 380 within the ice maker 300. As shown in FIG. 10, the ice maker 300 includes a mold apparatus 400 having a first mold portion 402 and a second mold portion 404 for forming ice structures 380 therein. The first mold portion 402, in this embodiment, is a stationary mold portion coupled to and disposed within a base jacket 410. A heat exchanger or heat sink 412 is coupled to the base jacket 410 through a connecting channel 414 and a connecting rod 415. A thermoelectric plate 416 is coupled to the heat exchanger 412 and is generally disposed between the heat exchanger 412 and the first mold portion 402. A fan 420 is coupled to the opposite side of the heat exchanger 412 as the ice maker 300 is adapted to draw air through the base portion 328 in a direction as indicated by arrow H. The fan 420 then circulates air out of the ice maker 300 in a direction as indicated by arrow G. As further shown in FIG. 10, the ice maker 300 also includes an ice delivery platform 430 that receives ice structures 380 from the mold apparatus 400 via a track 432. Disposed below the ice delivery platform 430, a waste water reservoir 434 collects waste water created during the formation of the ice structures 380. The waste water reservoir 434 can be in the form of a drawer. The drawer is accessible via a side wall of the outer casing 302 of the ice maker 300. As shown in FIG. 10, the second mold portion 404 includes a water intake manifold 464 for supplying water to a mold cavity 440 of the mold apparatus 400. The base jacket 410 includes a water outlet 436 for removing unfrozen water from the mold apparatus 400 as further described below. As shown in FIG. 10, the first mold portion 402 and second mold portion 404 are hingedly coupled via one or more hinges 438 such that the second mold portion 404 is moveable between an open position and a closed position along a path indicated by arrow E. As shown in FIG. 10, the mold apparatus 400 is in an open position O. A Wi-Fi board 422 may be disposed adjacent to the fan apparatus 420 and is typically adapted to be cooled by the fan apparatus 420 in use.

Figure 11:
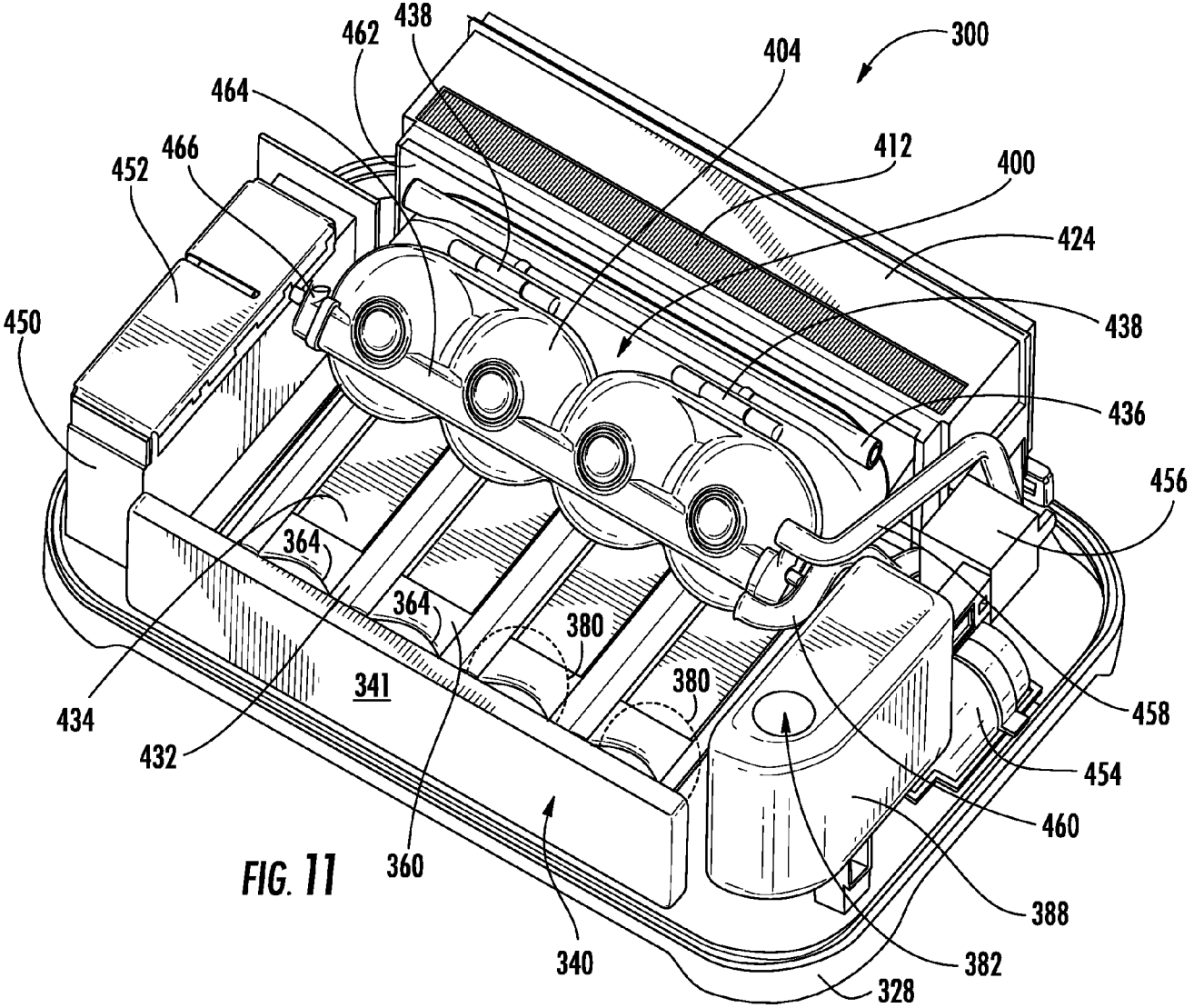
FIG. 11 is a top perspective view of the ice maker shown in FIG. 6 having an outer casing removed.
Figure 12:
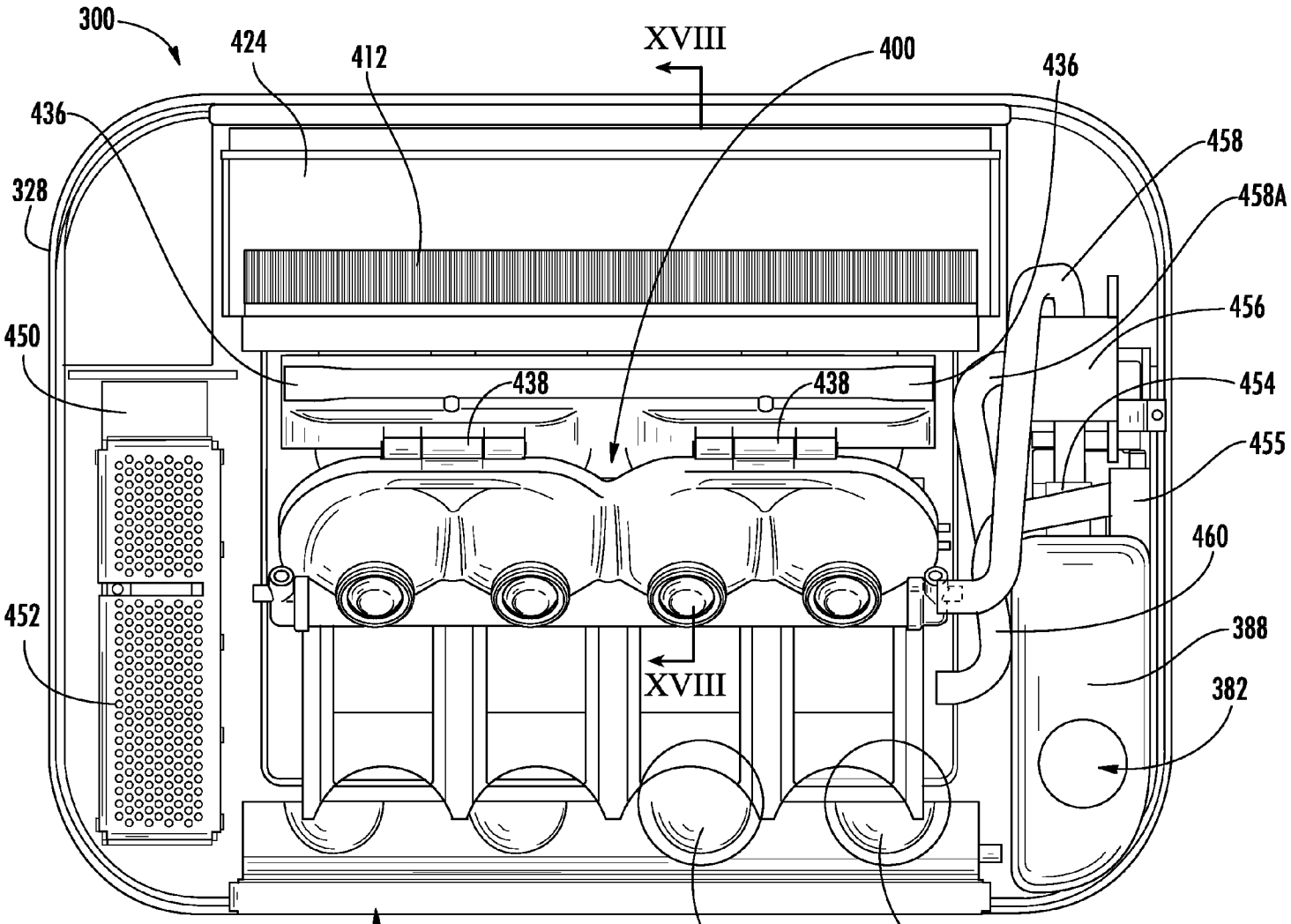
FIG. 12 is a top plan view of the ice maker shown in FIG. 11.

Referring now to FIG. 11, the ice maker 300 is shown with the outer casing 302 removed. With the outer casing 302 removed, a fan housing 424 is revealed which houses one or more fans 420 shown in FIG. 10. The housing 424 also generally encapsulates the heat exchanger 412 in assembly. A power supply 450 is disposed on an opposite side of the ice maker 300 relative to the water reservoir 388. The power supply 450 is coupled to a control board 452, which is adapted to control the operational systems of the ice maker 300 as further described below. A pump 454 is disposed in fluid communication with the water reservoir 388 and is adapted to supply water through a valve 456 to a liquid conduit 458 to the mold apparatus 400. Water is taken from the mold apparatus 400 through a liquid conduit 460 which is also coupled to an outlet pump (not shown) disposed near the water inlet pump 454. As shown in FIG. 11 in phantom, ice structures 380 have been deposited on the ice delivery tray 360 and are held in place by retaining apertures 364. The ice structures 380 have been transferred to the ice delivery tray 360 via tracks 432 disposed over the waste water reservoir 434. Disposed between the mold apparatus 400 and the fan housing 424, an insulating member 462 is positioned therebetween to insulate thermoelectric plates disposed therein. FIG. 12 depicts a top plan view of the ice maker 300 shown in FIG. 11, where pump 455 is shown coupled to the water outlet conduit 460 which again is adapted to take water out of the mold apparatus 400 such that a continuous movement of water is maintained into and out of the mold apparatus 400 for making the clear ice structures 380 in a similar manner as described above with reference to FIGS. 5-5C. The mold apparatus 400 further includes an inlet manifold 464 that couples to water inlet conduit 458 on a first side via water inlet 466 and has an optional secondary water inlet 466A disposed on a second side.

Referring now to FIG. 12, the ice maker 300 is shown from a top plan view wherein a water supply line 458A is visible as connecting the water reservoir 388 to the pump 454 to feed the water inlet conduit 458.

Figure 13:
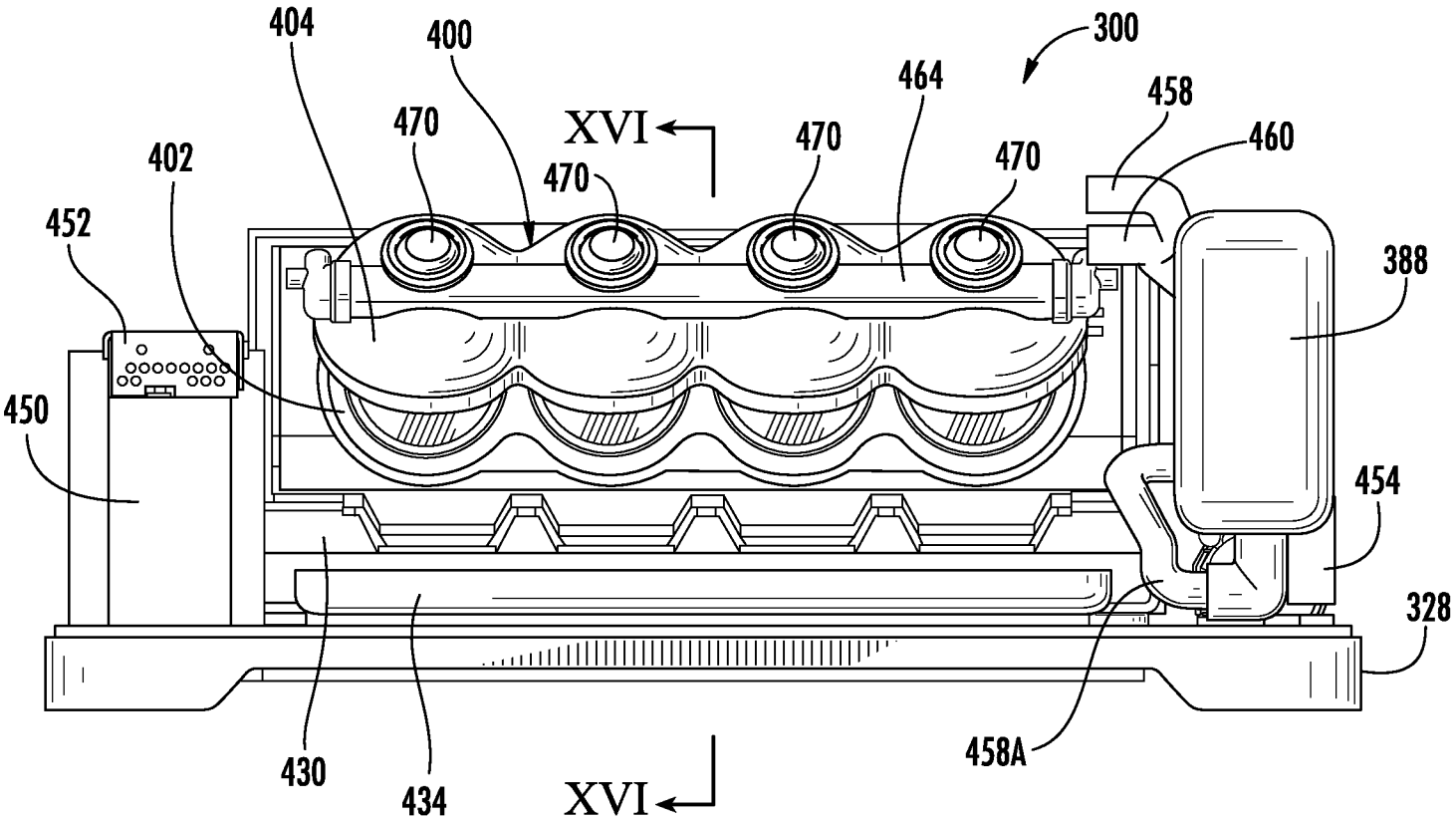
FIG. 13 is a front elevational view of the ice maker shown in FIG. 11.
Figure 14:
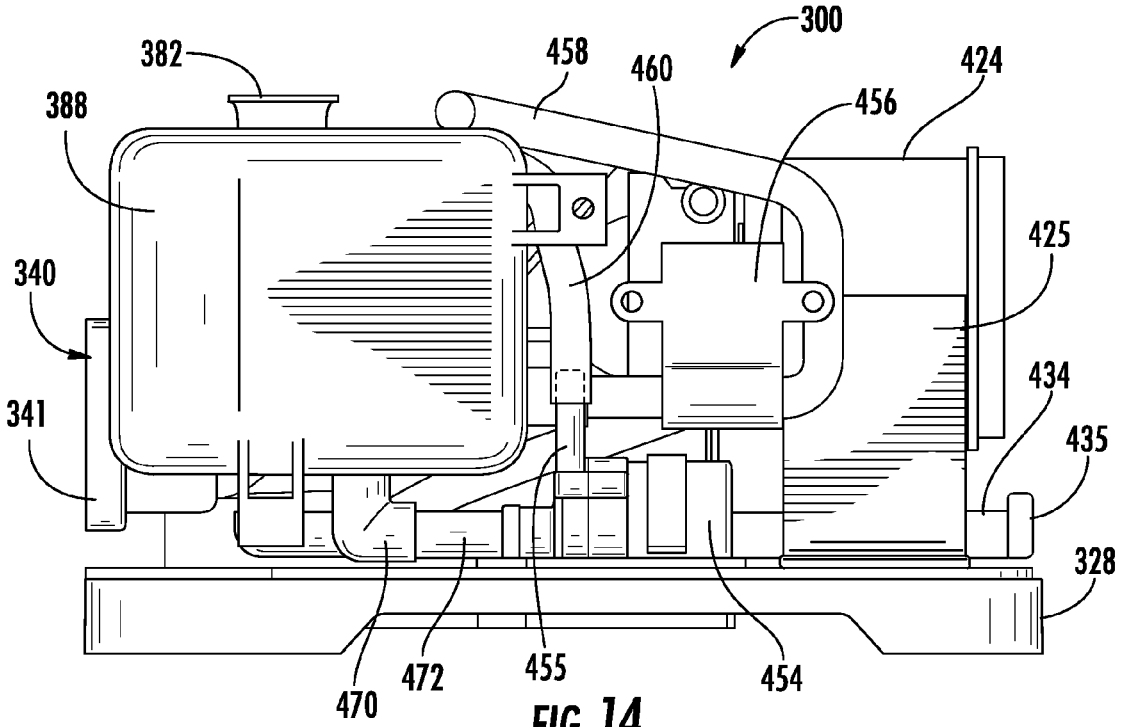
FIG. 14 is a right-side elevational view of the ice maker shown in FIG. 11.
Figure 15:
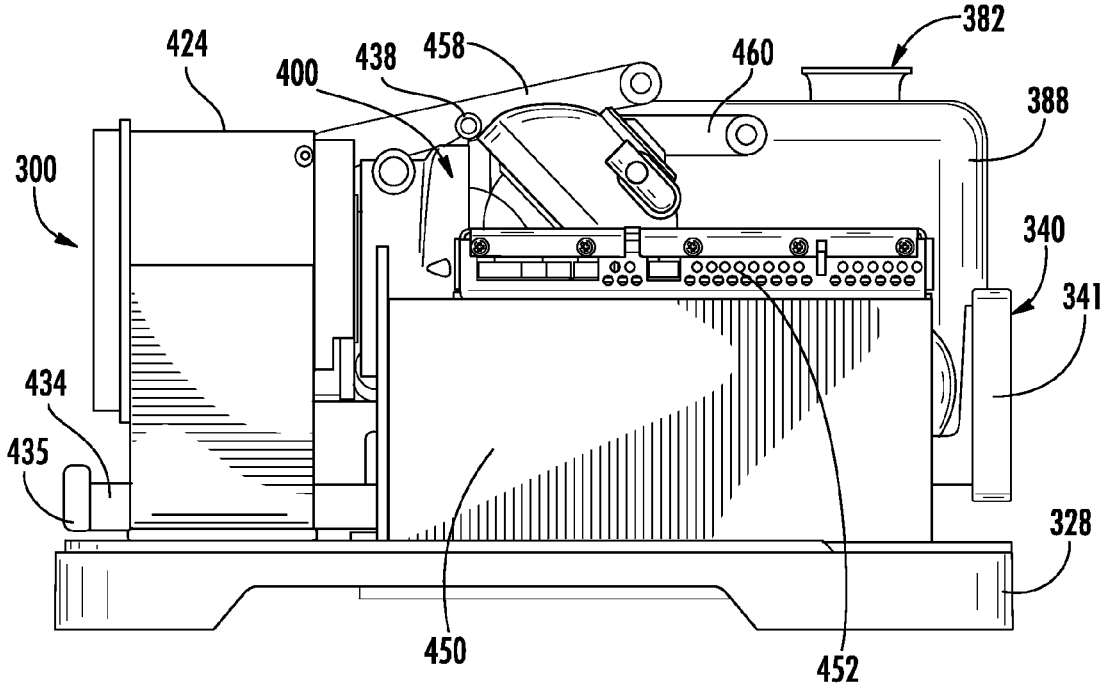
FIG. 15 is a left-side elevational view of the ice maker shown in FIG. 11.

Referring now to FIGS. 13-15, the icemaker 300 is shown from front and side views with the outer casing 302, FIG. 6, removed. As best shown in FIGS. 14 and 15, the ice maker 300 includes a waste water reservoir 434 in the form of a tray. The tray disposed below the mold apparatus 400 on an opposite side of the ice maker 300 relative to the ice delivery drawer 340. The waste water reservoir 434 is shown in FIGS. 14 and 15 a as waste water tray which is removable from the rear side of the ice maker 300. The waste water reservoir 434 includes a tray handle 435 that is adapted to be engaged by the consumer for pulling the tray 434 from the ice maker 300 to discard the waste water. In this way, the ice maker 300 does not recycle melt water, such that the clear ice structures produced by the ice maker 300 are made of clean water supplied by the consumer to the water reservoir 388. As shown in FIG. 14, a feed bracket 470 is disposed on a lower end of the water reservoir 388 and couples to an intermediary fluid conduit 472 for connecting the water reservoir 388 to the pump 454. As shown in FIG. 14, a support bracket 425 is coupled to the housing 424 to hold the housing 424 is place on the base portion 328 of the ice maker 300.

Figure 16:
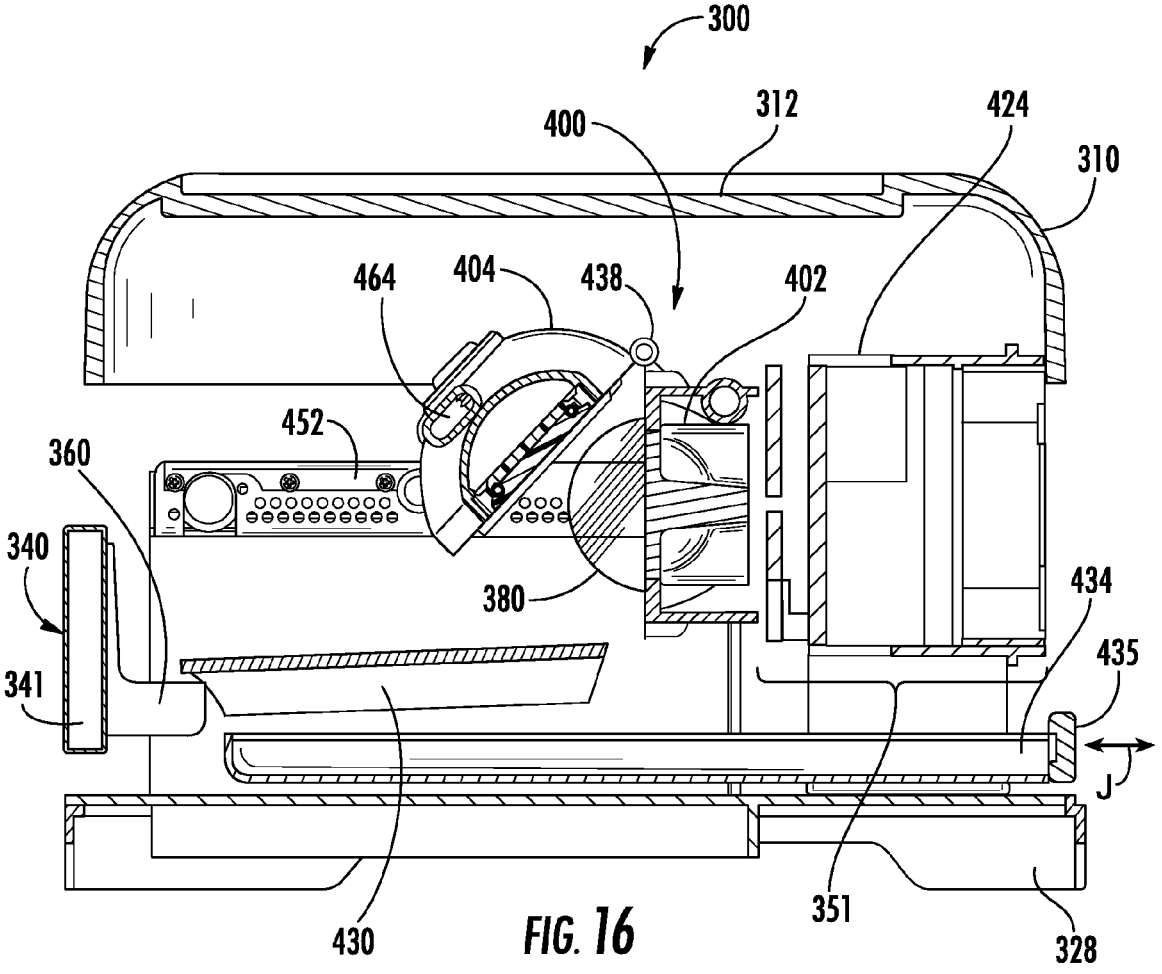
FIG. 16 is a cross-sectional side elevational view taken along line XVI of FIG. 13.
Figure 17:
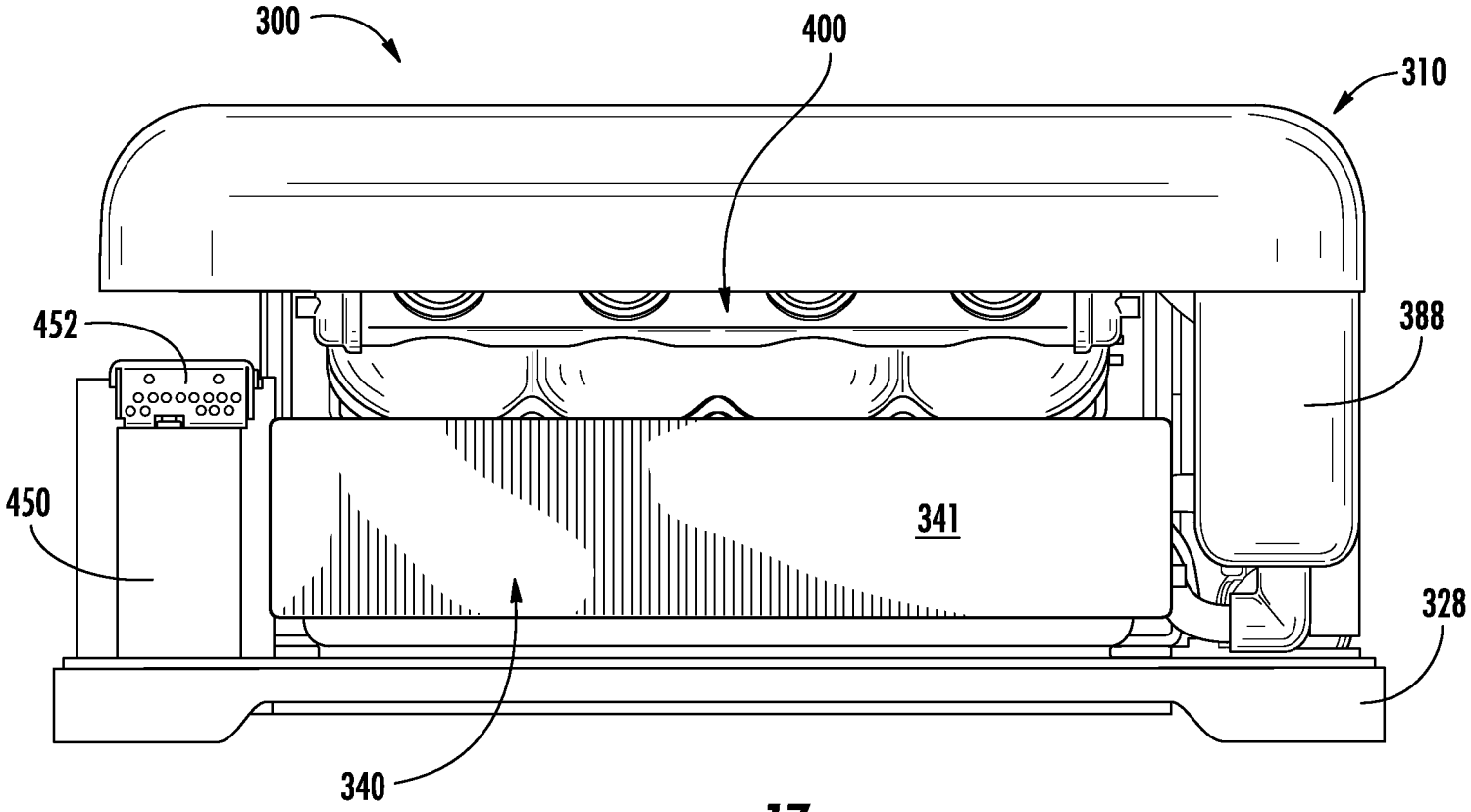
FIG. 17 is a rear elevational view of the ice maker of FIG. 11 having an upper housing member.

Referring now to FIGS. 16 and 17, the ice maker 300 is shown in a cross-sectional view where the mold apparatus 400 is in an open position O having a clear ice structure 380 formed therein. A cooling source 451 is generally disposed adjacent to the first mold form 402 and is adapted to supply cooling to the first mold form 402, thereby creating a thermal gradient from the first mold form 402 to the second mold form 404. The cooling source 451 generally includes a heat exchanger, a plurality of thermoelectric units, a plurality of fans and insulating materials disposed within the housing 424 as described above. As shown in FIG. 16, the waste water reservoir 434 is removable from the ice maker 300 in a direction as indicated by arrow J.

Figure 18:
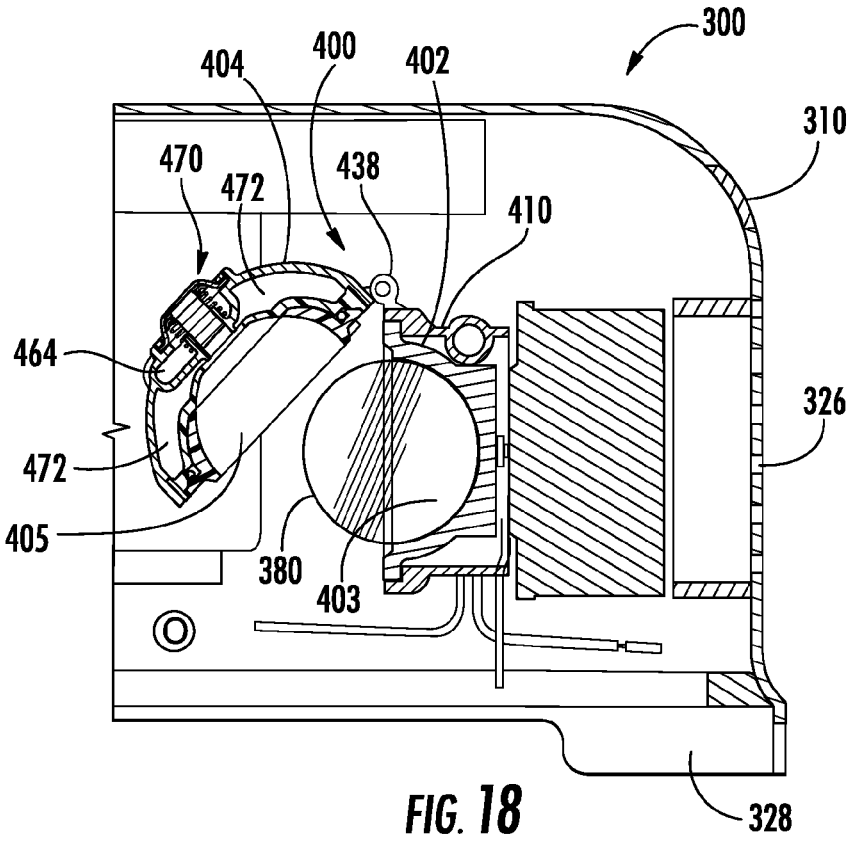
FIG. 18 is a fragmentary cross-sectional view taken along line XVIII of FIG. 12 showing a mold apparatus in an open position.
Figure 19:
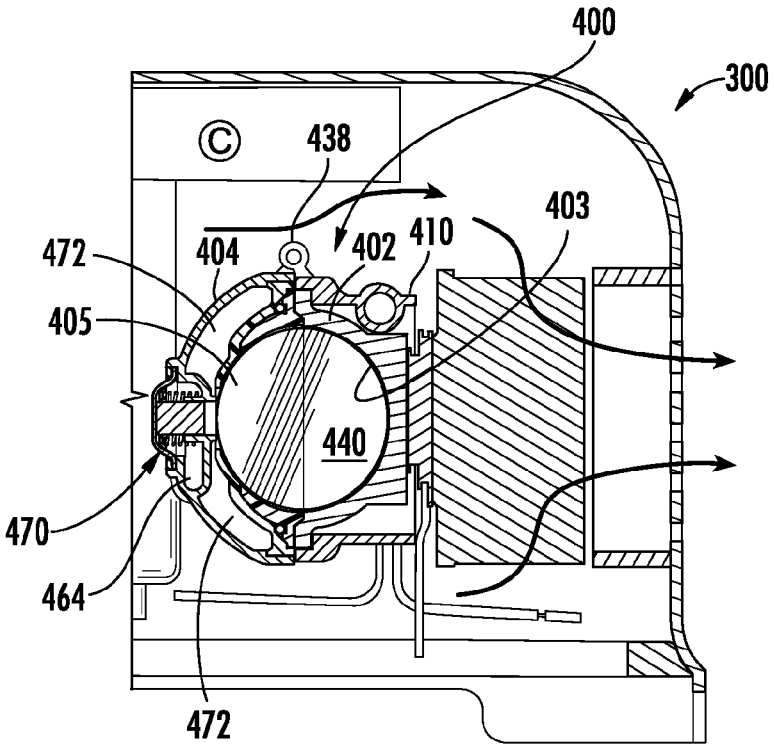
FIG. 19 is a fragmentary cross-sectional view of the ice maker of FIG. 18 showing a mold apparatus in a closed position.

Referring now to FIGS. 18 and 19, the mold apparatus 400 is shown in an open position O and a closed position C. The first mold portion 402 includes a mold cavity segment 403 while the second mold portion 404 includes a mold cavity segment 405 which, when in the closed position C, shown in FIG. 19, engage to define a mold cavity 440 for forming an ice structure therein. As shown in FIGS. 18 and 19, the second mold portion 404 further includes an ejector apparatus or mechanism 470 disposed on the water manifold 464. Referring again to FIG. 13, the mold apparatus 400 includes four separate mold forms 409, each having an ejector apparatus 470 disposed thereon. The makeup and function of the ejector apparatus is described in more detail with reference to FIGS. 31 and 32. As further shown in FIGS. 18 and 19, the second mold portion 404 includes multiple parts which are contemplated to be made up of varying material substrates as further described below. The second mold portion 404 further includes a water jacketing system 472 adapted to circulate water as water enters and exits the mold cavity 440 during ice structure formation. The water jacketing system 472 is further described with reference to FIGS. 33 and 34.

Figure 20:
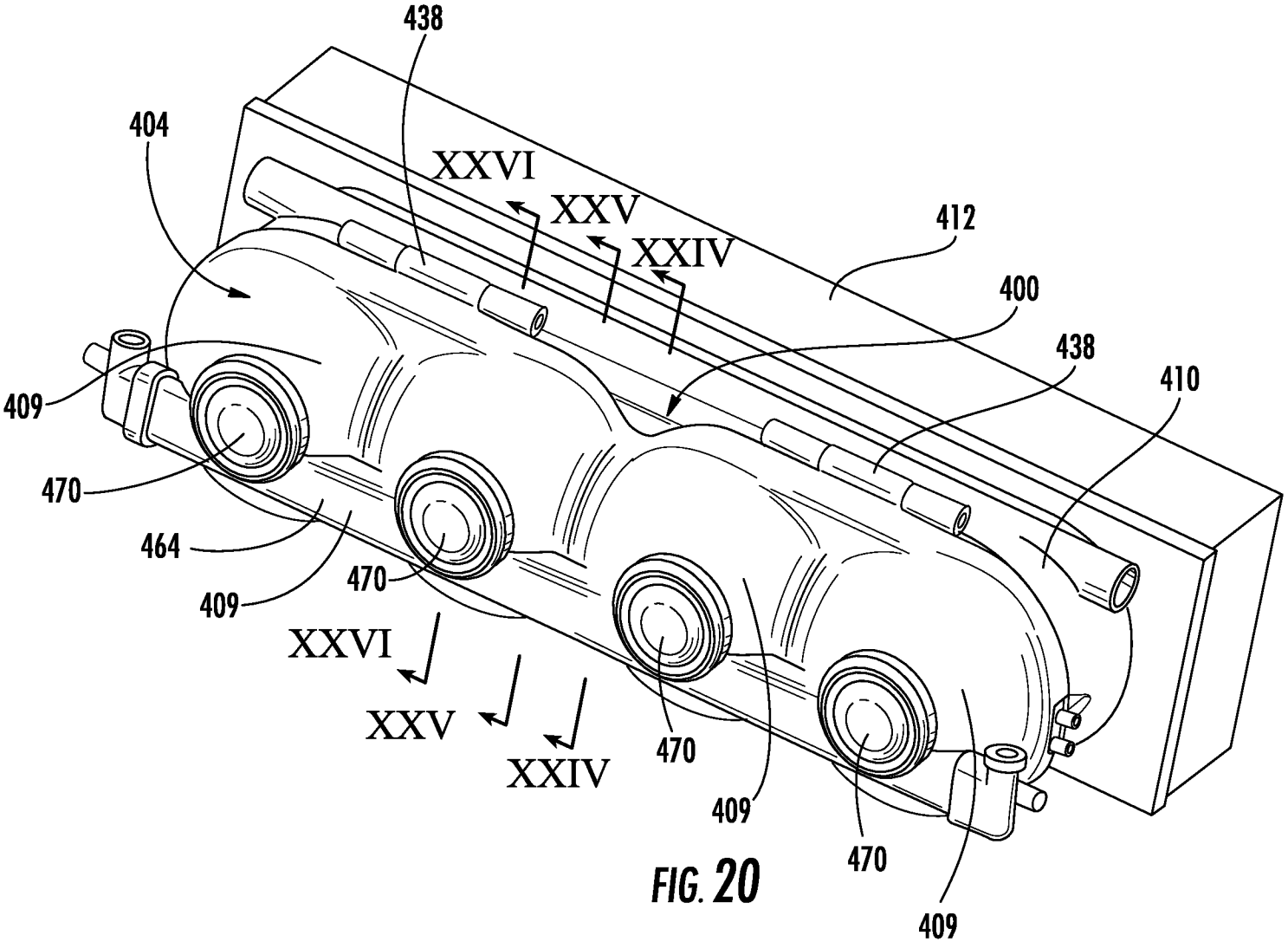
FIG. 20 is a front perspective view of a mold apparatus.

Referring now to FIG. 20, a mold apparatus 400 is shown as coupled to a heat exchanger 412. The first mold portion 402 is generally disposed within a base jacket 410 as best shown in the cross-sectional views of the mold apparatus 400 in FIGS. 21-26. The second mold portion 404 is coupled to the base jacket 410 by hinges 438 and the second mold portion 404 generally includes four individual mold forms 409 for making four ice structures therein simultaneously.

Figure 21:
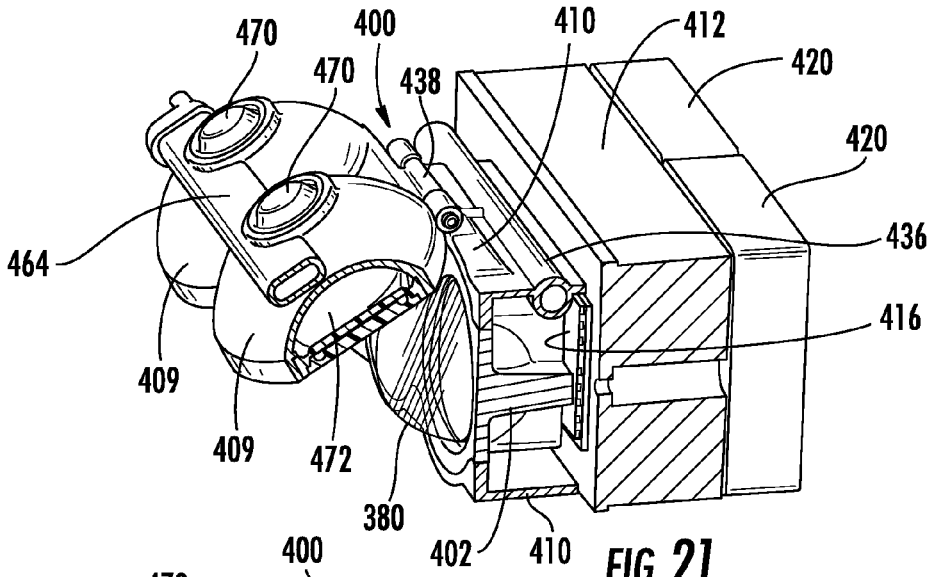
FIGS. 21-23 are cross-sectional side perspective views of the mold apparatus shown in FIG. 20 taken along lines XXIV, XXV, XXVI of FIG. 20, wherein the mold apparatus is in an open position.
Figure 22:
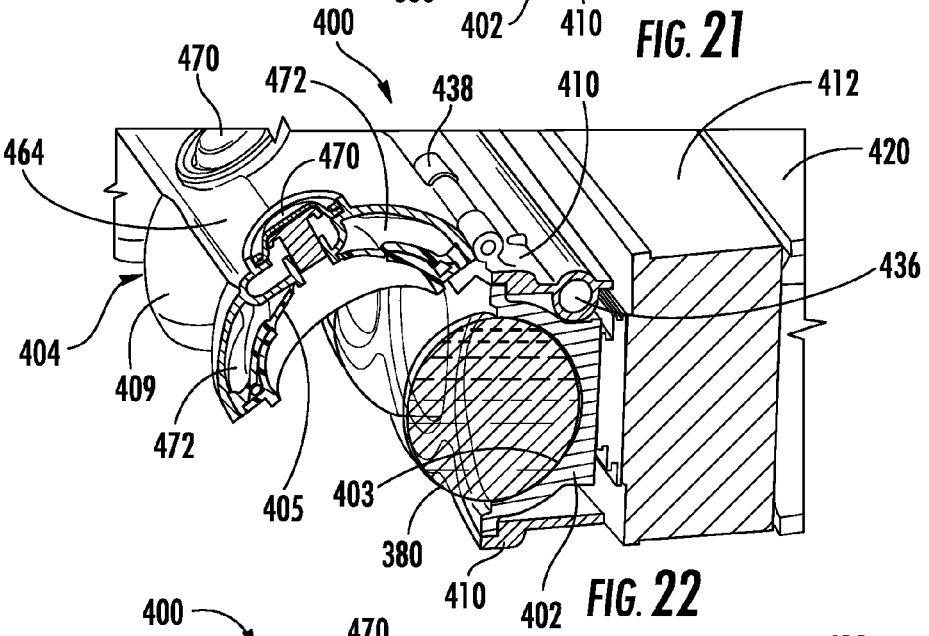
Figure 23:
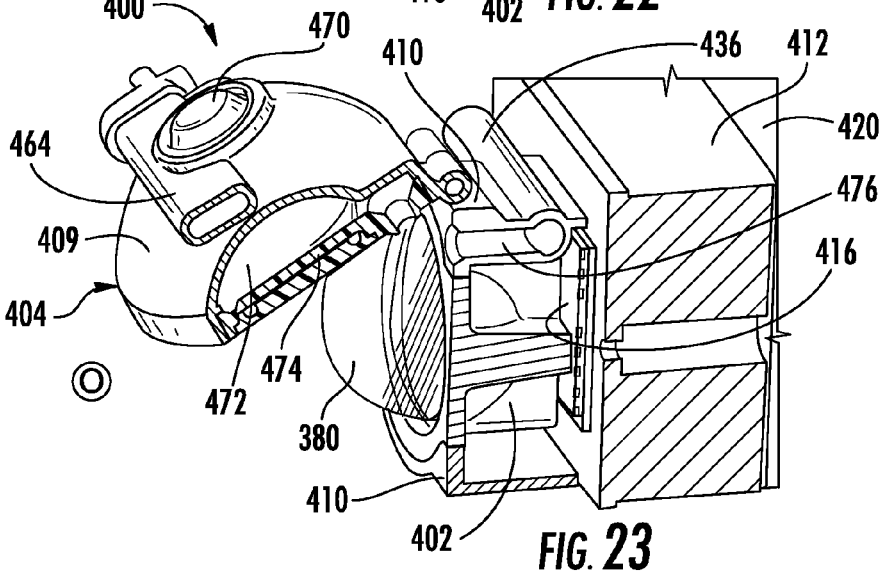
Figure 25:
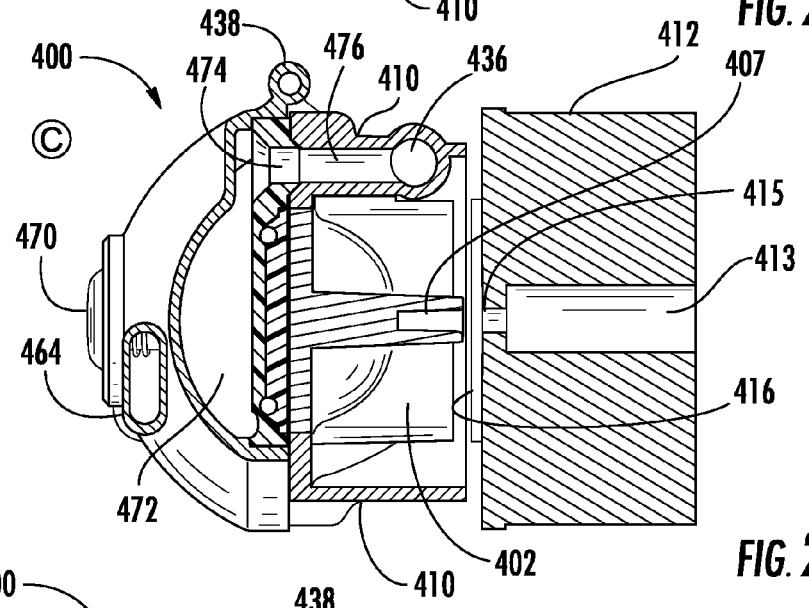

Referring now to FIGS. 21-23, the mold apparatus 400 is shown coupled to a heat exchanger 412 having one or more fans 420 disposed adjacent thereto. On the opposite side of the heat exchanger 412 relative to the fans 420, thermoelectric plates 416 are disposed directly adjacent to the first mold portion 402 such that the first mold portion 402 is in thermal communication with the thermoelectric plate 416. In the embodiment shown in FIGS. 21-23, each mold form 409 has a thermoelectric plate 416 disposed adjacent thereto. As shown in FIGS. 21-23 water cavity portions 472 are shown and are adapted to store and circulate water in a water jacketing system as further described below with reference to FIGS. 27-32. A water return aperture 474 is shown disposed on the second mold portion 404 which opens into a water return channel 476. The water return channel 476 feeds into the water outlet 436 disposed on the base housing 410 as shown in FIG. 25. As shown in FIGS. 21-23, the first mold portion 402 is substantially housed within the base jacket 410, which is hingedly coupled to the second mold portion 404.

Figure 24:
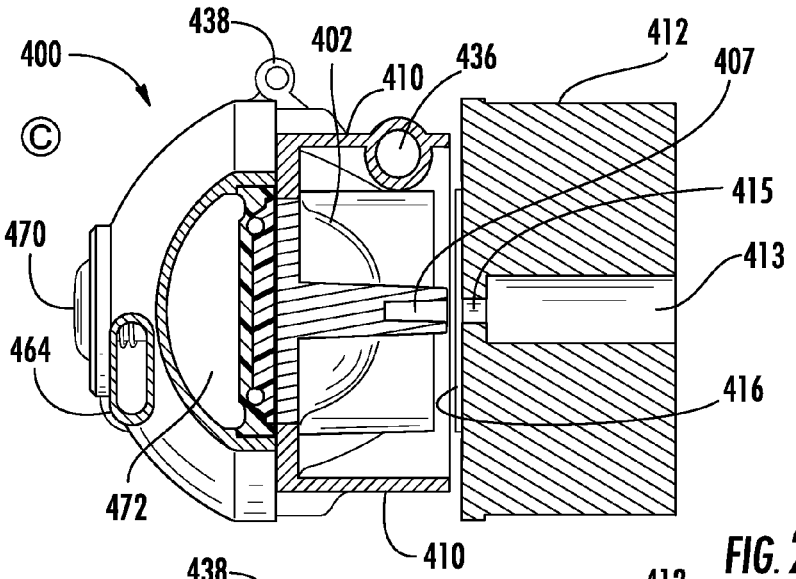
FIGS. 24-26 are cross-sectional side elevational views of the mold apparatus of FIG. 22 taken along lines XXIV, XXV, XXVI of FIG. 20.
Figure 26:
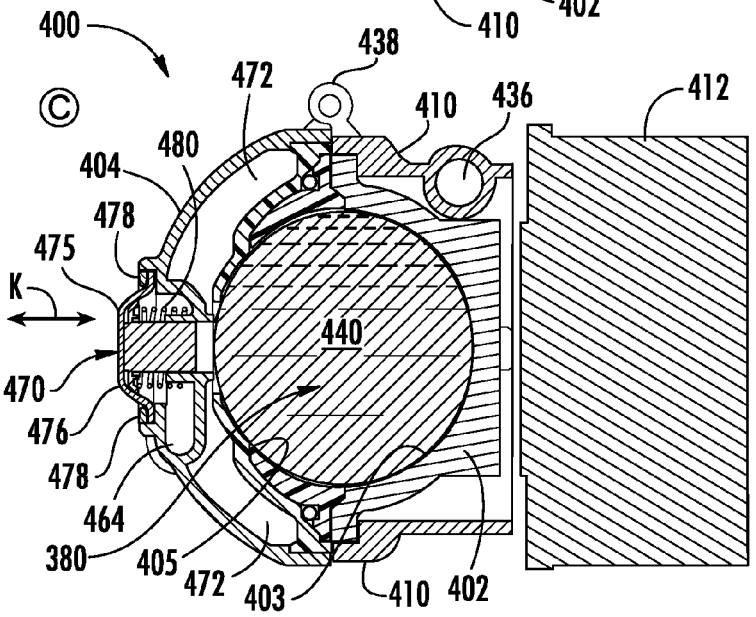

Referring now to FIGS. 24-26, the mold apparatus 400 is shown in the closed position C. The mold apparatus 400 is coupled to a heat exchanger 412 by fasteners that are generally disposed within a fastener channel 413 which further opens into a fastener aperture 415 that is aligned with a fastener retaining element 407 disposed on the first mold portion 402. In this way, the mold assembly 400 is rigidly retained against the heat exchanger 412 and the thermoelectric plates 416 disposed therebetween. In the closed form, as shown in FIG. 24, the water return aperture 474 is aligned with the water return channel 476 which is in fluid communication with the water outlet 436 disposed on the base housing 410. Thus, water circulating within the water jacket system 472, as supplied by the water intake manifold 464, can exit out of the mold apparatus 400 through the water outlet 436. As shown in FIG. 26, a solid ice structure 380 has been formed within the mold cavity 440. The mold cavity 440 is defined by the engagement of the first and second mold cavity segments 403, 405 of the first and second mold portions 402, 404. As best shown in FIG. 26, the ejector apparatus 470 includes an ejector pin 475, which is adapted to move between a retracted position and an extended position in a direction that is indicated by arrow K. The ejector apparatus 470 includes an elastomeric diaphragm 476, which is retained on the outer casing of the second mold portion 404 by a retaining ring 478. A biasing mechanism 480 is shown coupled to the second mold portion 404 and the ejector pin 475 such that the ejector pin 475 is biased towards the retracted position shown in FIG. 26. The biasing mechanism 480 is shown in FIG. 26 as a biasing spring. The function of the ejector apparatus 470 is further described below with reference to FIGS. 29 and 30.

Figure 27:
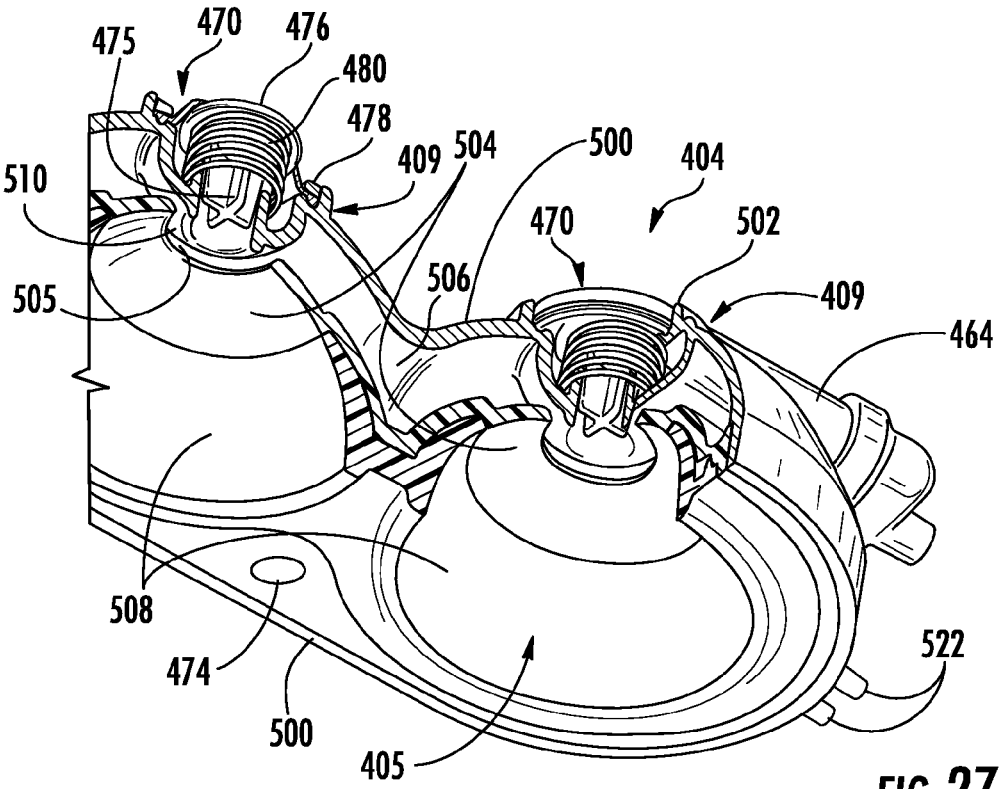
FIG. 27 is a fragmentary partially cross-sectional bottom perspective view of a front mold halve having an ejector apparatus.
Figure 28:
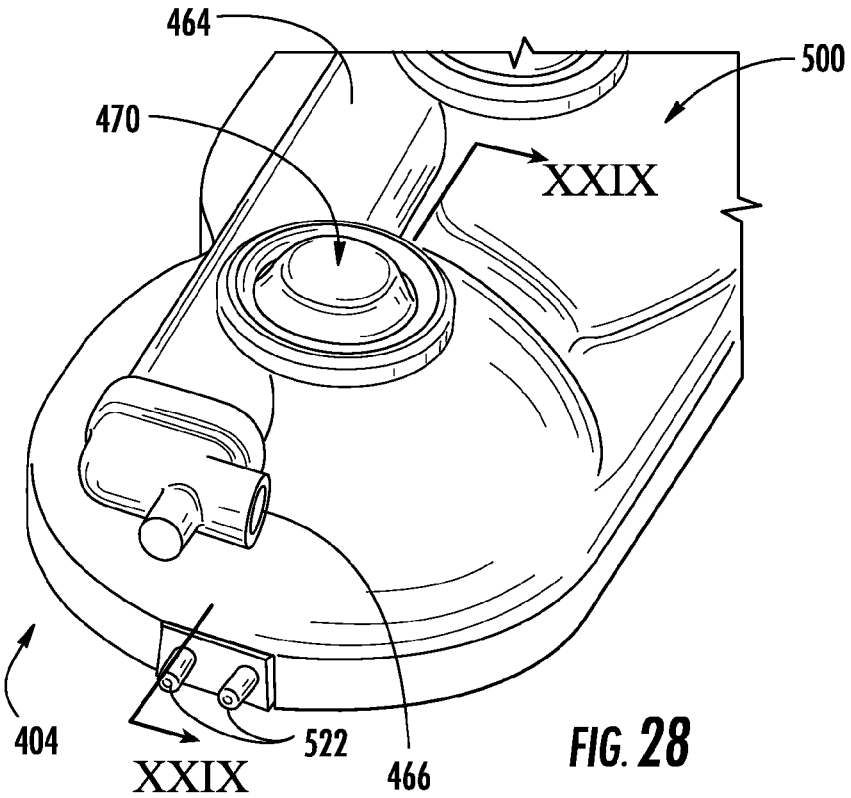
FIG. 28 is a fragmentary top perspective view of the mold halve of FIG. 27.

Referring now to FIG. 27, the second mold portion 404 includes a water jacketing system to allow for circulation of water during the filling of the mold cavity 440. The second mold portion 404 generally includes an outer shell 500. The outer shell 500 includes the water intake manifold 464 for supplying water to the mold cavity. The outer shell 500 further includes housing apertures 502 which, in the embodiment shown in FIG. 27, house the ejector mechanisms 470. Inwardly disposed and spaced apart from the outer jacket 500 is a chill ring cover 504. The chill ring cover 504 is configured in a generally spaced apart relationship relative to the outer cover 500 to create a water circulating cavity 506 disposed therebetween. A chill ring 508 is disposed under the chill ring cover 504 and is generally comprised of a metallic material, such as zinc or aluminum, such that the chill ring 508 will have a higher thermal conductivity as compared to the chill ring cover 504 which is generally contemplated to be comprised of a polymeric or thermoplastic material. As shown in FIG. 27, the contours of the chill ring 508 and the chill ring cover 504 cooperate to define the mold cavity segments 405 of each mold forms 409 of the second mold portion 404. The chill ring cover 504 further includes a water inlet aperture 505 that is in communication with the water circulating cavity 506. Specifically, the water inlet aperture 505 is disposed generally adjacent to the housing apertures 502 of the upper mold cover 500. The water inlet aperture 505 and the housing aperture 502 are configured to allow for a spacing 510 therebetween to allow for water circulating in the water circulating cavity 506 to enter the mold cavity segment 405. As shown in the embodiment of FIG. 27, the ejector pin 475 is configured with a generally cross-shaped cross-section such that the ejector pin 475 is adapted to allow for water movement through the spacing 510 into the mold cavity segment 405. The water return aperture 474 is shown disposed on the chill ring cover 504, which as noted above, is adapted to communicate with the base housing 410 of the first mold portion 402 for allowing circulating water out of the water circulating cavity 506 into the water return outlet 436 as shown in FIG. 25. As shown in FIGS. 27 and 28, the second mold portion 404 further includes leads 522, which are used to power a heating coil 520 as further shown and described with reference to FIG. 35.

Figure 29:
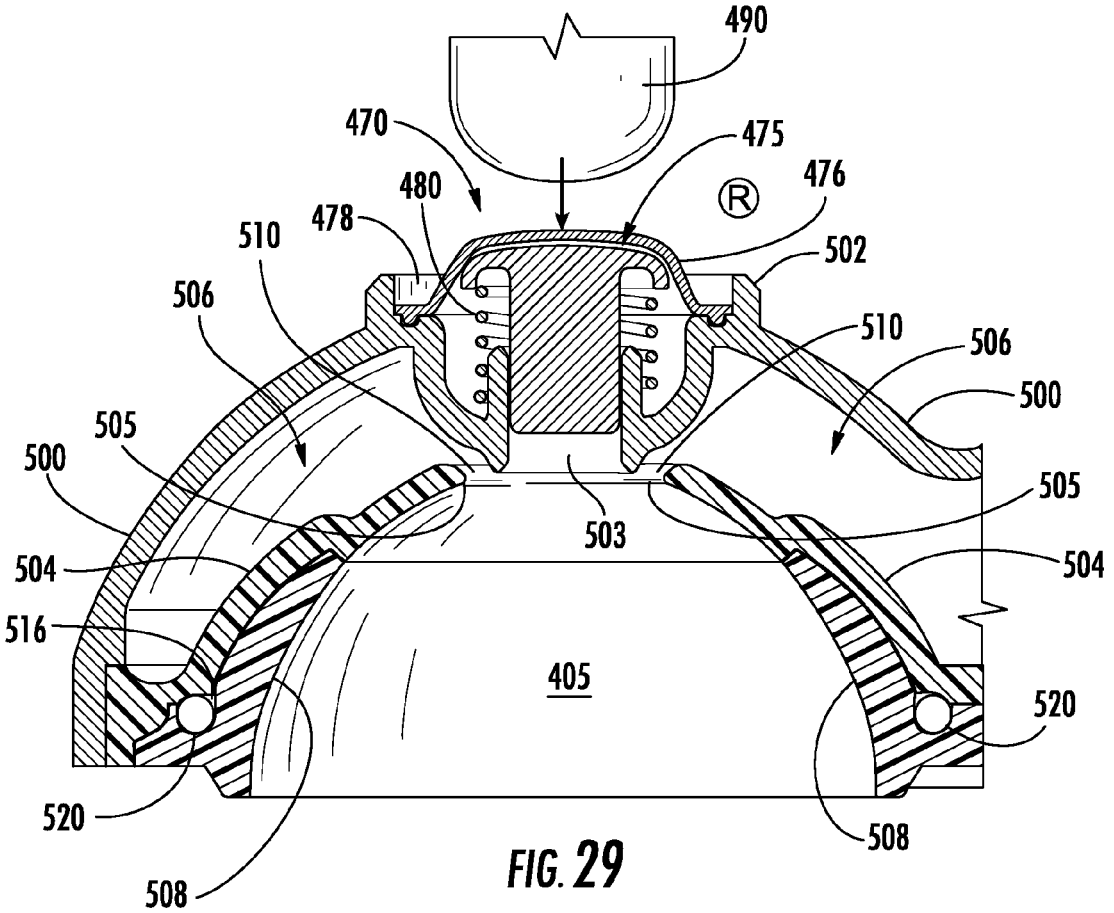
FIG. 29 is a fragmentary cross-sectional side elevational view of the mold halve of FIG. 28 with the ejector apparatus in a retracted position taken along line XXIX.
Figure 30:
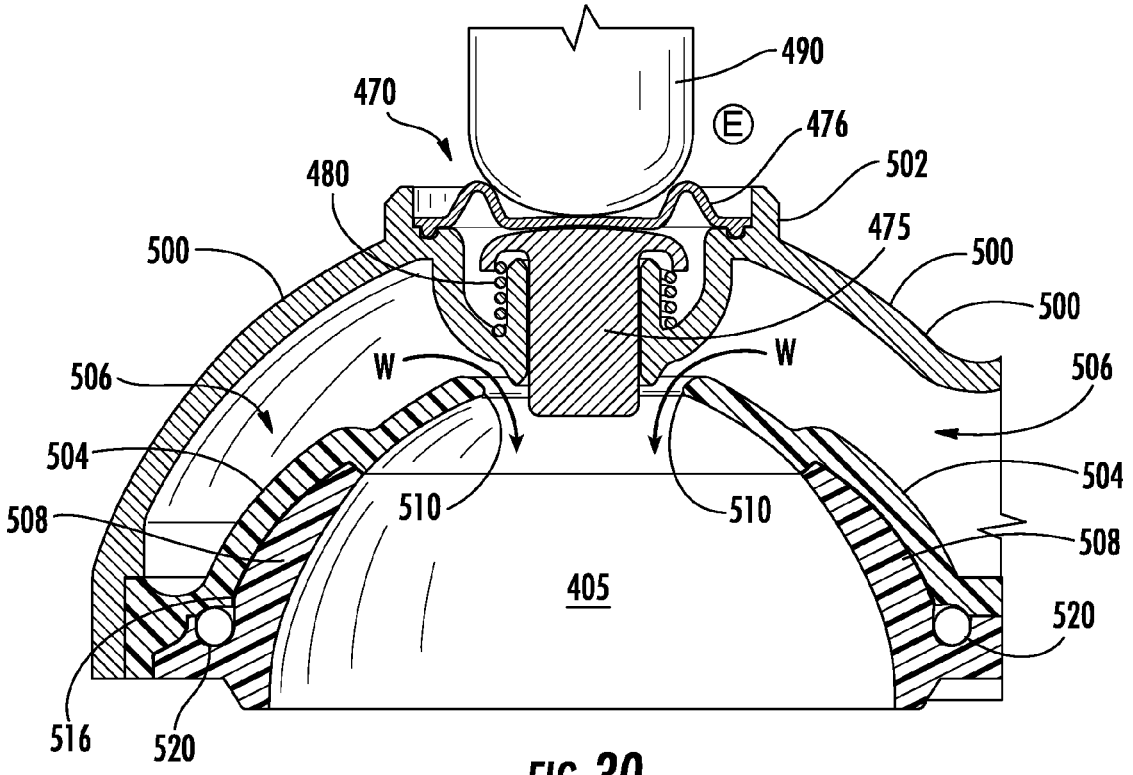
FIG. 30 is a fragmentary cross-sectional side elevational view of the mold halve of FIG. 29 showing the ejector apparatus in an extended position.

Referring now to FIGS. 29 and 30, the ejector apparatus 470 is shown with the ejector pin 475 in a retracted position R, FIG. 29, as well as in an extended position E, FIG. 30. When in the retracted position R, the elastomeric diaphragm 476 is extended outwardly from the housing aperture 502 of the outer cover 500 of the second mold portion 404. The elastomeric diaphragm 476 is outwardly extended due to the biasing mechanism 480 biasing the ejector pin 475 to the retracted position R thereby resulting in an overall bulbous protrusion of the elastomeric diaphragm 476. The housing aperture 502 further includes an ejection pin aperture 503 which allows the ejector pin 475 to extend inwardly into the mold cavity segment 405 as shown in FIG. 30. In this way, the ejector pin 475 can apply a pressure to an ice mold structure formed within the mold cavity segment 405. Again, it is noted that the mold apparatus of the present invention includes a unitary mold cavity 440 comprised of the mold cavity segments 403, 405 of the first and second mold portions 402, 404.

As shown in FIGS. 29 and 30, a rubber stop 490 is disposed adjacent to the ejector apparatus 470 and it is contemplated that the rubber stop 490 can be mounted to the casing 302 of the ice maker 300 in a location where the rubber stop 490 will align with the ejector apparatus 470. As noted above, multiple mold forms 409 may be disposed on the second mold portion 404, such that multiple rubber stops 490 will be incorporated into the ice maker 300 as necessary. Referring to FIG. 26, the mold apparatus 400 is shown in a closed position C while the mold 400 is shown in an open position O in FIG. 23. It is contemplated that the rubber stop 490 will be mounted to the casing 302 of the ice maker 300 in such a way that the ejector mechanism 470 comes into contact with the rubber stop 490 when the mold 400 is in the open position O as shown in FIG. 23. Referring now to FIG. 30, when the rubber stop 490 engages the ejector mechanism 470 by the opening of the mold apparatus 400, the stationary rubber stop 490 will deform the elastomeric diaphragm 476 and overcome the biasing force of the biasing mechanism 480 to move the ejector pin 475 from the retracted position R to the extended position E. In this way, the ejector pin 475 can apply a force via an abutment surface 477 disposed at the end of the ejector pin 475 on an ice structure formed within mold cavity segment 405.

Figure 35:
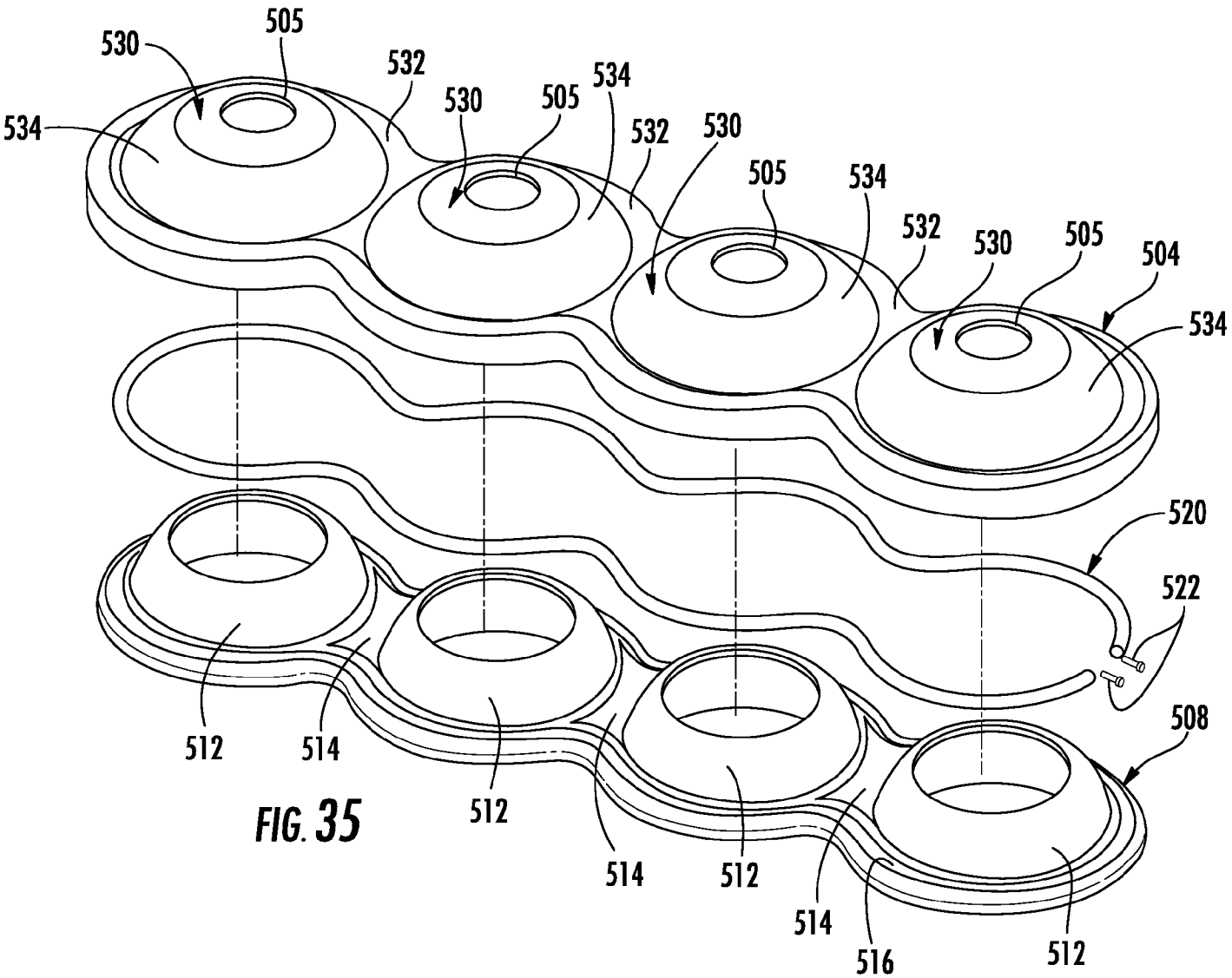
FIG. 35 is an exploded perspective view of a front mold halve having a heating element.
Figure 36:
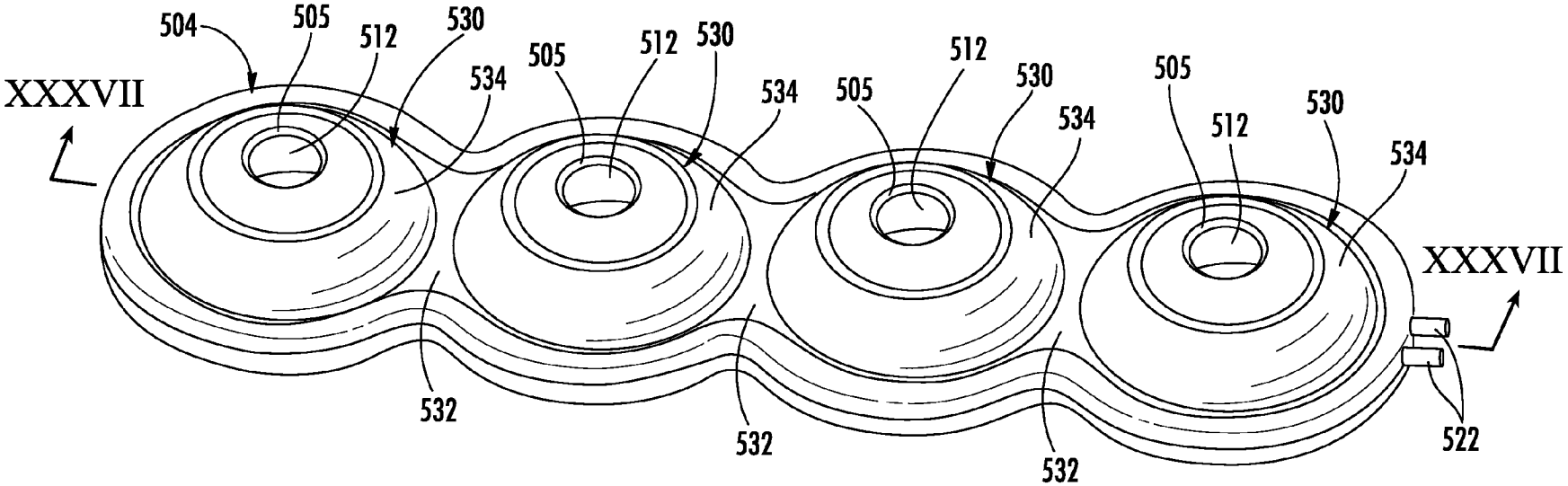
FIG. 36 is a top perspective view of the front mold halve of FIG. 35 as assembled.
Figure 37:
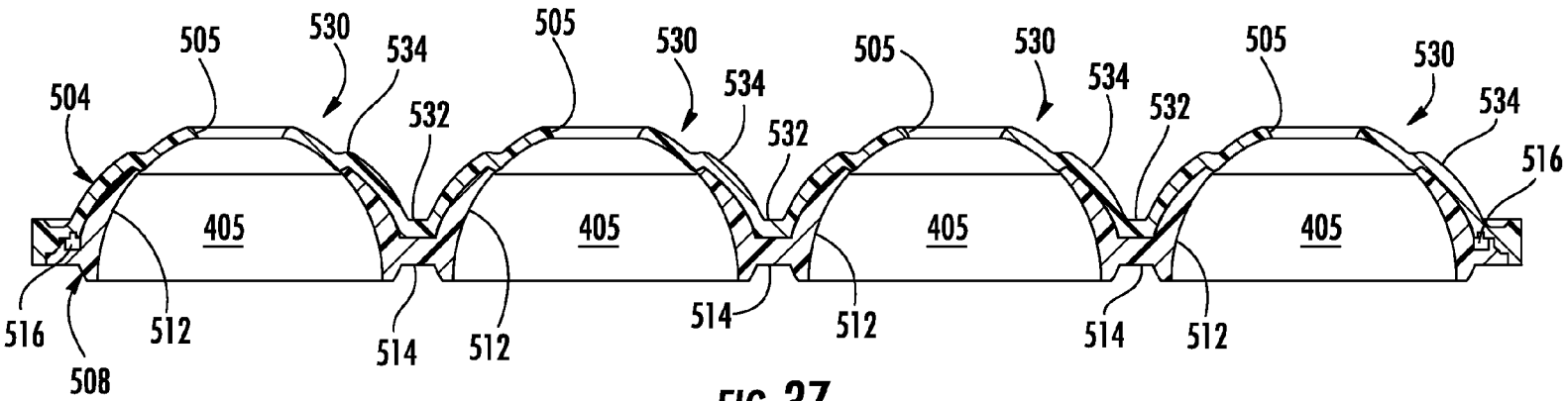
FIG. 37 is a cross-sectional side elevational view of the front mold halve of FIG. 36 taken along line XXXVII of FIG. 36.

Referring now to FIGS. 35-37, the components defining the cavity segments 405 of the second mold portion 404 are shown as configured in assembly. Specifically, with reference to FIG. 35, the chill ring 508 is shown having a plurality of dome-shaped forms 512 with web portions 514 disposed therebetween. At an outer perimeter portion of the chill ring 508, a channel 516 is disposed and is adapted to receive a heating element 520, shown in FIG. 35 as a heating coil. The heating coil 520 further includes a pair of leads 522. The leads 522 protrude outwardly from the second mold portion 404 for connection to a power supply source. As shown in FIG. 35, the chill ring cover 504 includes a plurality of reciprocal dome-shaped forms 530 having webbing portions 532 disposed therebetween. The dome-shaped forms 530 include a chill ring receiving form 534 that is adapted to align with and house the dome-shaped forms 512 of the chill ring 508. Water inlet apertures 505 are disposed on an upper portion of the dome-shaped forms 530 of the chill ring cover 504 that are adapted to allow water to flow from the water circulating cavity 506, as shown in FIG. 30, into a formed mold cavity.

Referring now to FIGS. 36 and 37, the chill ring assembly is shown fully assembled with the mold cavity segments 405 defined by dome-shaped mold forms 512 of the chill ring 508 and dome-shaped mold forms 530 of the chill ring cover 504. In this way, the mold cavity segments 405 have varying substrates in their makeup wherein it is contemplated that the dome-shaped forms 512 of the chill ring 508 have a higher thermal conductivity typically being made of a metallic material as compared to the dome-shaped forms 530 of the chill ring cover typically being made of a polymeric material.

Figure 31:
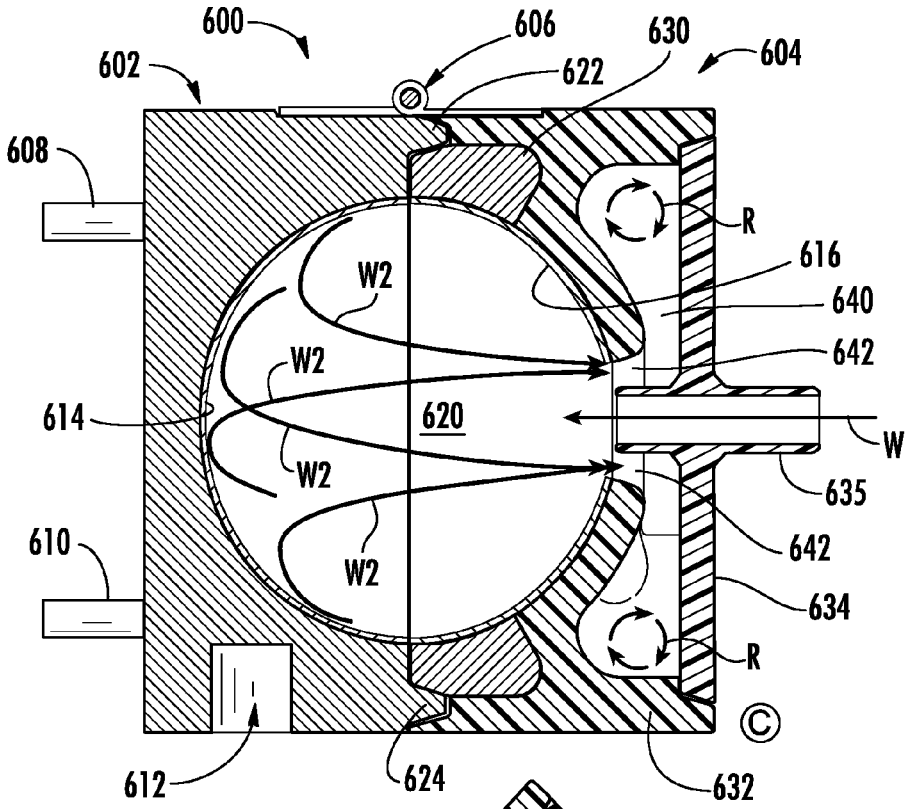
FIG. 31 is a cross-sectional side elevational view of a mold apparatus according to another embodiment of the present invention, wherein the mold apparatus is in the closed position indicating the direction of water flow into the mold apparatus.
Figure 32:
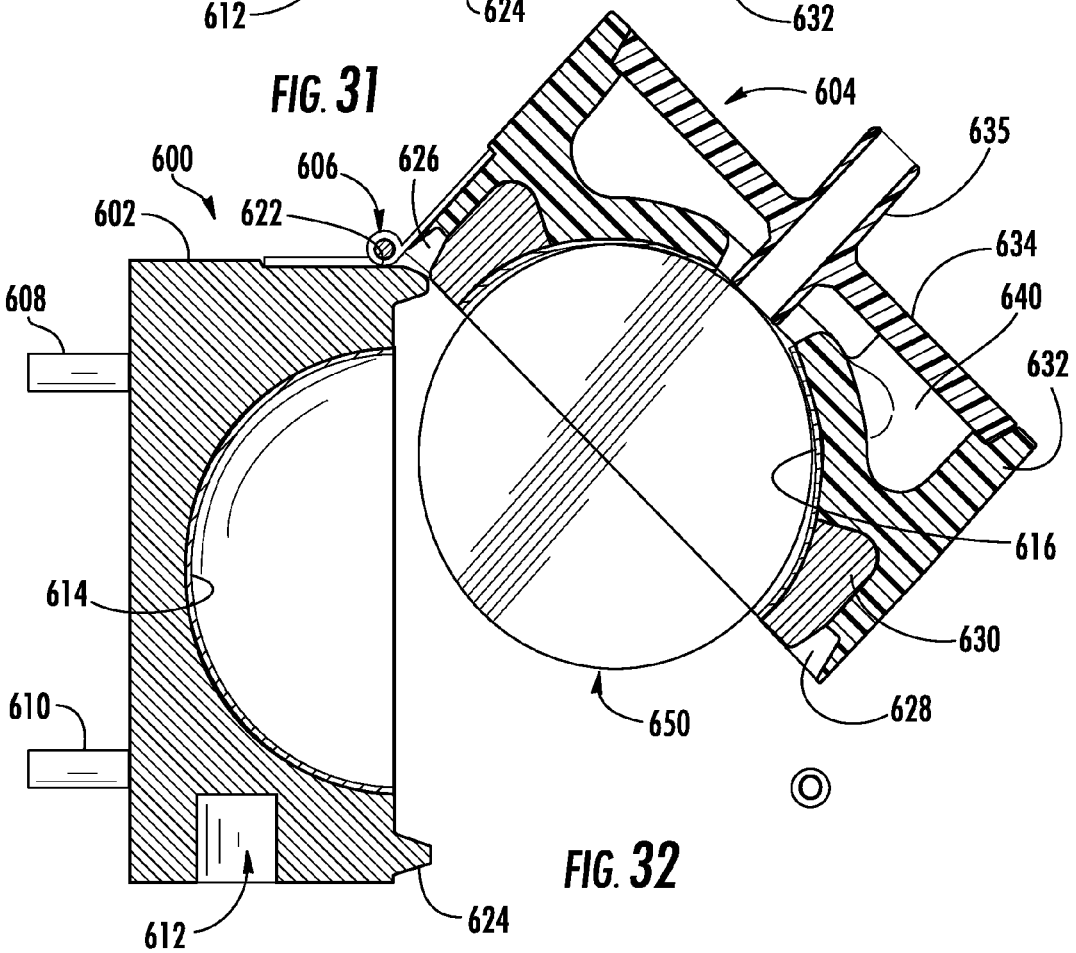
FIG. 32 is a cross-sectional side elevational view of the mold apparatus of FIG. 31 in an open position including a formed ice structure.

Referring now to FIGS. 31-32, another embodiment of a mold apparatus 600 is shown. The mold apparatus 600 includes a first mold portion 602 and a second mold portion 604 which, as shown in FIGS. 31 and 32, are typically operably coupled by a hinge member 606. In this way, the first mold portion 602 and the second mold portion 604 are operable between a closed position C, as shown in FIG. 31, and an open position O, as shown in FIG. 32. As shown in FIG. 31, the first mold portion 602 includes upper and lower mounting structures 608, 610 that are adapted to couple the first mold portion 602 to a cooling source in a similar fashion as described above with reference to the mold apparatuses 300, 400. The first mold portion 602, as shown in FIGS. 31 and 32, further includes a mounting channel 612 adapted to secure the first mold portion 602 on an ice maker. In a similar manner as described above, the first mold portion 602 includes a mold form or a mold cavity segment 614 adapted to align with a mold form or mold cavity segment 616 of the second mold portion 604. Thus, as shown in FIG. 31 in the closed position C, the first mold portion 602 and the second mold portion 604 cooperate to form a mold cavity 620, or a clear ice sphere forming volume, defined by mold cavity segments 614, 616. The first mold portion 602 further includes alignment features 622 and 624 which are adapted to be received in corresponding alignment features 626 and 628 disposed on the second mold portion 604.

As shown in FIGS. 31 and 32, and further exemplified in FIGS. 33A-33D, the mold apparatus 600 is a hybrid mold apparatus made up of multiple materials and designed to increase the ice freezing rate for forming an ice structure within the mold cavity 620. The hybrid mold design includes a substantially metallic first mold portion 602 which can be made from an aluminum, zinc or other like metallic material that has a high thermal conductivity. The second mold portion 604 includes a chill ring 630 which generally defines an inner most portion of mold cavity segment 616 of the second mold portion 604.

A chill ring cover 632 is disposed about the chill ring 630 and further defines an outer portion of the mold cavity segment 616 of the second mold portion 604. A mold cover 634 is disposed on an outer most portion of the second mold portion 604 and is operably coupled to the chill ring cover 632. The mold cover 634 and the chill ring cover 632 are configured to be spaced apart from one another such that a water circulating cavity 640 is formed therebetween. As shown in FIG. 31, the mold cover 634 includes a water inlet 635 which allows water to be injected into the mold cavity 620 when the mold apparatus 600 is in the closed position C. As shown in FIGS. 31 and 32, the water circulating cavity 640, defined between the chill ring cover 632 and the mold cover 634, is disposed both above and below the water inlet 635 of the mold cover 634. The chill ring cover 632 and the mold cover 634 are both typically comprised of a thermoplastic material or another material that has a lower thermal conductivity as compared to the first mold portion 602 and a lower thermal conductivity as compared to the chill ring 630.

As water is injected through the water inlet 635 in a direction indicated by arrow W, the water will generally be injected towards the first mold portion 602 on a forming wall of mold cavity segment 614. As water is injected in this way, the solidification or formation of an ice structure will begin as further described below with reference to FIGS. 33A-33D. While the water is being injected into the mold cavity 620, a portion of the water will circle back towards a mold cavity water outlet aperture 642 formed in the chill ring cover 632 in a direction indicated by arrow W2. In this way, unfrozen water from the mold cavity 620 is allowed to flow into the water circulating cavity 640 through the mold cavity water outlet 642 where the water can circulate within the cavity 640 as indicated generally by arrows R. The water can then flow to a water circulating cavity outlet 644, FIG. 33B, which is typically on a side portion of the second mold portion 604. The mold cavity water inlet 636 is typically coaxially positioned within the mold cavity water outlet 642 such that the mold cavity water outlet 642 is positioned around the mold cavity water inlet 635. As with other aspects of the present disclosure, the mold cavity water inlet 635 and mold cavity water outlet 642 are typically proximate and more typically coaxially positioned with one another to facilitate the formation of an ice structure without structural defects like cavities and other malformations. The configuration of the hybrid mold apparatus 600 allows for moving water near the water inlet 635. The moving water prevents ice formation near the water inlet 635, warms the second mold portion 604 slightly relative to a mold without such a water circulating cavity 640, and further assists in the ejection of a formed ice structure when an ice structure, such as ice structure 650 shown in FIG. 32, has been formed in the mold cavity 620. Thus, the hybrid mold apparatus 600 provides for a water jacketing system similar to the water jacketing system described above with reference to FIGS. 27 and 28.

Figure 33A:
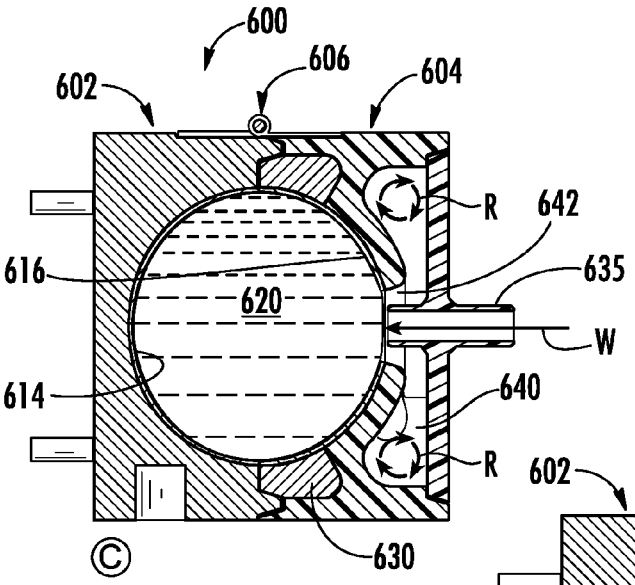
FIGS. 33A-33D are cross-sectional side elevational views of the mold apparatus shown in FIG. 31 depicting directional solidification of an ice structure.
Figure 33B:
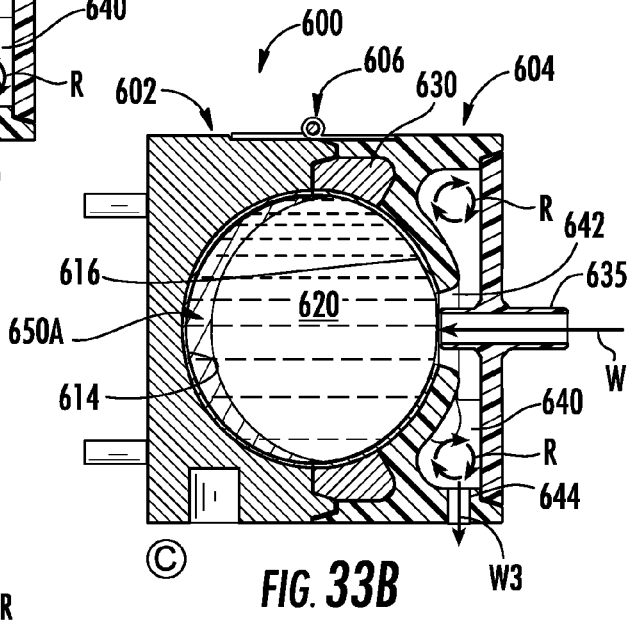
Figure 33C:
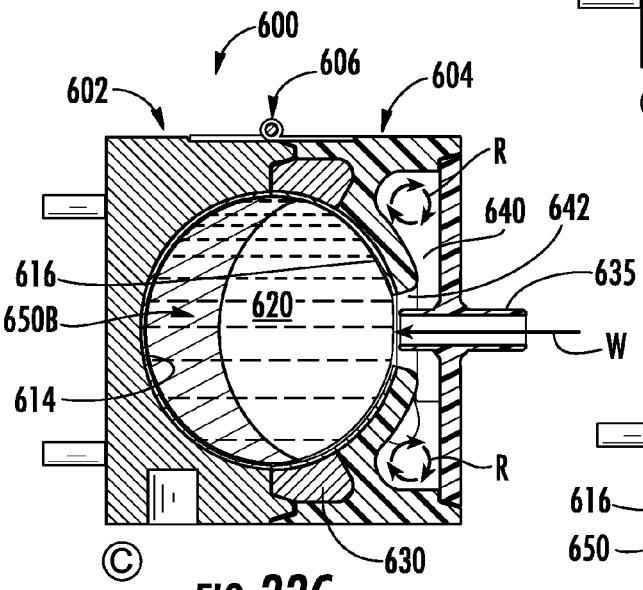
Figure 33D:
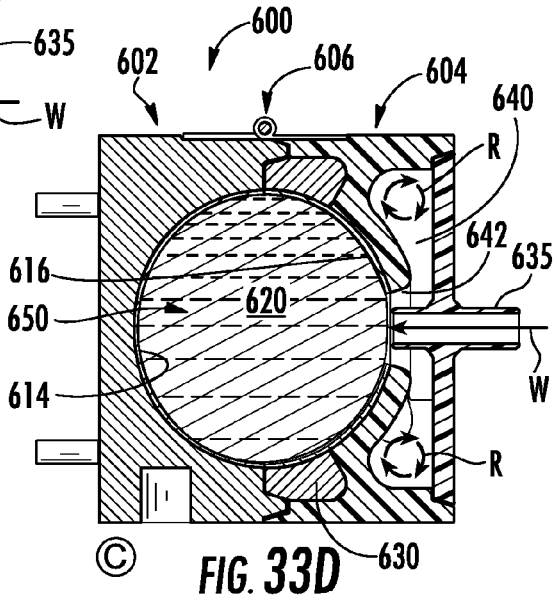

Referring now to FIGS. 33A-33D, the formation of an ice structure 650 is shown. Water enters the mold cavity 620 through the water inlet 635 in a direction as indicated by arrow W. The water will generally be injected towards the first mold portion 602 which is cooled at a cooling receiving surface by a cooling source. Unfrozen water is able to exit the mold cavity 620 through the mold cavity outlet aperture 642 and enter the water circulating cavity 640. As shown in FIG. 33B, the formation of an ice structure 650A has begun in the mold cavity segment 614 of the first mold portion 602. As shown in FIG. 33C, the ice structure 650B has further developed, but has now entered the mold cavity segment 616 of the second mold portion 604. The chill ring portion 630 of the second mold portion 604 is again a substantially metallic chill ring. The chill ring increases the freeze rate within the second mold portion 604 relative to a mold that employs two mold portions where one mold portion is metallic and the other plastic as discussed herein. Referring now to FIG. 33D, a complete ice structure 650 has been formed within the mold cavity 620 which, in this embodiment, is a clear spherical ice structure 650 formed through a directional solidification process.

Figure 34:
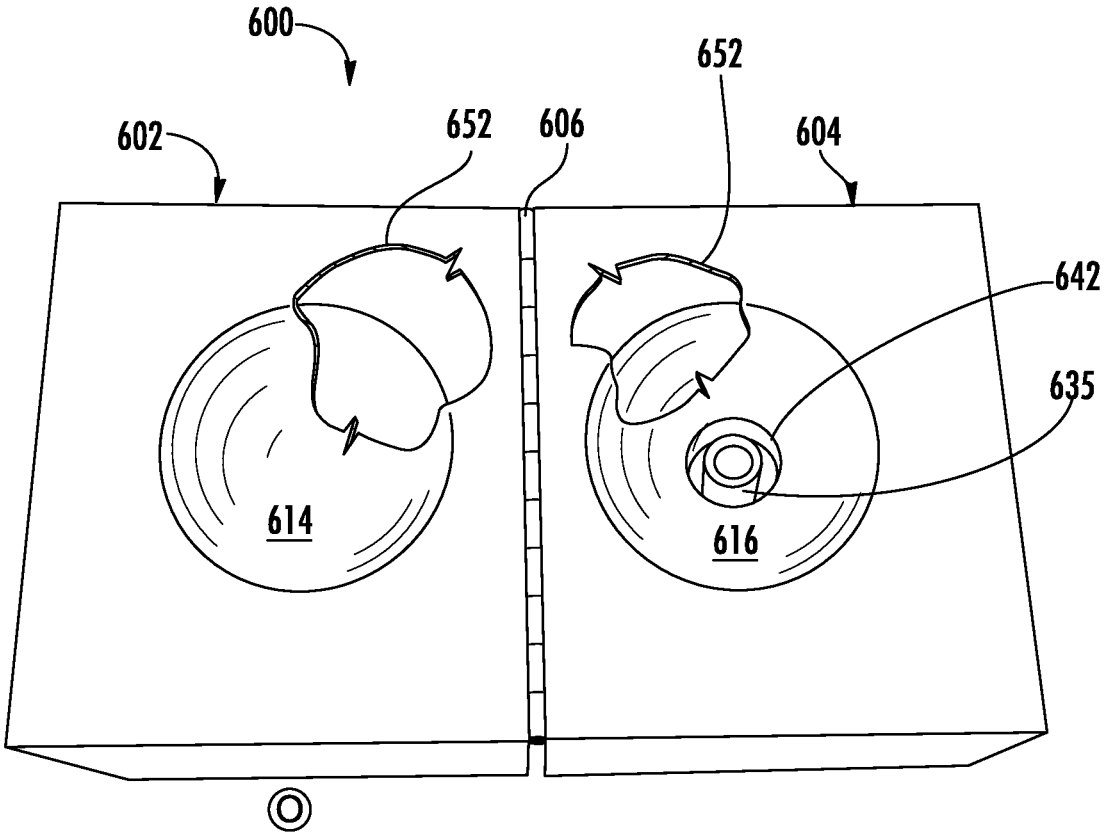
FIG. 34 is a partially fragmentary top perspective view of a mold apparatus in an open position.

Referring now to FIG. 34, the mold apparatus 600 may include an ice-phobic coating material 652 disposed about an outer surface of the first and second mold portions 602, 604. Typically the coating 652 is fully disposed within the mold cavity segments 614, 616 of the first and second mold portions 602, 604. The coating 652 helps prevent fractures during the formation of an ice structure as the coating serves to lower the freeze rate of the forming ice structure due to a low thermal conductivity of the coating 652. It is contemplated that the coating 652 can be disposed only in the mold cavity segments 614, 616 rather than fully covering the molding surface of the first mold portions 602, 604. The coating 652 may include a silicone coating, a polymeric organosilicon compound-based coating, or any other like coating that can lower the freeze rate of the forming ice structure and facilitate the release of the ice structure from the mold apparatus 600 after formation. The thermal conductivity of a 1-3 mm thick coating may range from about 0.25 W/mk, when using a polytetrafluoroethylene/silicone material, to about 0.15 W/mk, when using a silicone-based material. The mold apparatus 600 may further include a textured surface disposed in the mold cavity segments 614, 615 that helps in releasing formed ice structures from the mold apparatus 600. Such textured surfaces may include microstructured metal or plastic wherein microribs or other like microprojections are disposed on the surfaces of the mold portions 602, 604 to aid in the ice harvesting processes by decreasing the strength of bonds formed between the ice structure and the mold apparatus 600. As shown in FIG. 34, the water inlet 635 is disposed within the mold cavity water outlet aperture 642, such that the water inlet 635 and the water outlet 642 are coaxially aligned and cooperate to allow for constant movement of water within the mold cavity during ice formation. As further shown in FIG. 34, the hinge member 606 pivotally connecting the first mold portion 602 with the second mold portion 604 is in the form of a piano hinge member, which is disposed along a length of both the first and second mold portions 602, 604. While an ice-phobic coating may be employed, ice structures formed by any of the embodiments described herein do not typically utilize and are free of any (removable) insert within the first and second mold portions. Typically, the ice structures are formed within the mold cavity or cavities without any insert within the mold cavity or any other removable liner material. In an embodiment, the mold cavities and mold portions are free of such inserts and liners.

As described throughout the present disclosure, ice structures are generally formed within a mold cavity, such as mold cavity 620, shown in FIGS. 33A-33D, which depict a directional solidification process of forming an ice structure 650. It is further contemplated that an ice structure can be formed in an open mold, such as the mold apparatus 600 shown in FIG. 34. In forming an ice structure in this way, each mold portion 602, 604 would be in thermal communication with a cooling source such that a hemispherically shaped ice structure could be formed in the mold cavity segments 614, 616. Upon the formation of the hemispherical ice structures, the mold apparatus 600 would then release the ice structures, which could be fused together to form a unitary ice structure sphere, such as the ice structure spheres 650 shown in FIG. 33D. In this way, the spherical ice structures can be formed in a more efficient manner as ice formation occurs more rapidly with the water-to-ice interface being disposed closer to the cooling source. Therefore, it takes less time to form two hemispherically shaped ice structures which can be fused than it would take to form an ice structure by the methods depicted in FIGS. 33A-33D. The hemispherically shaped ice structures could be disposed in a tray or mold apparatus that vibrates, rotates or otherwise moves water within mold forms to produce clear ice structures. The fusion of the hemispherically shaped ice structures produced in this way results in a clear spherical ice structure.

Figure 38:
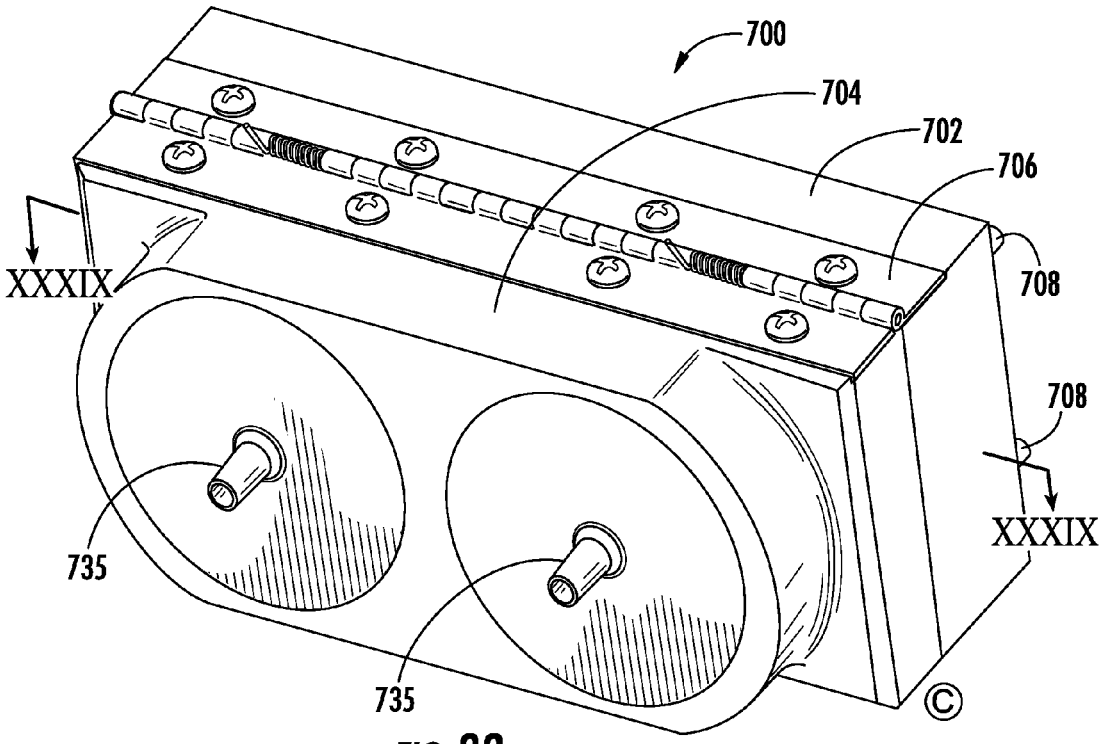
FIG. 38 is a top perspective view of a mold apparatus according to another embodiment.
Figure 39:
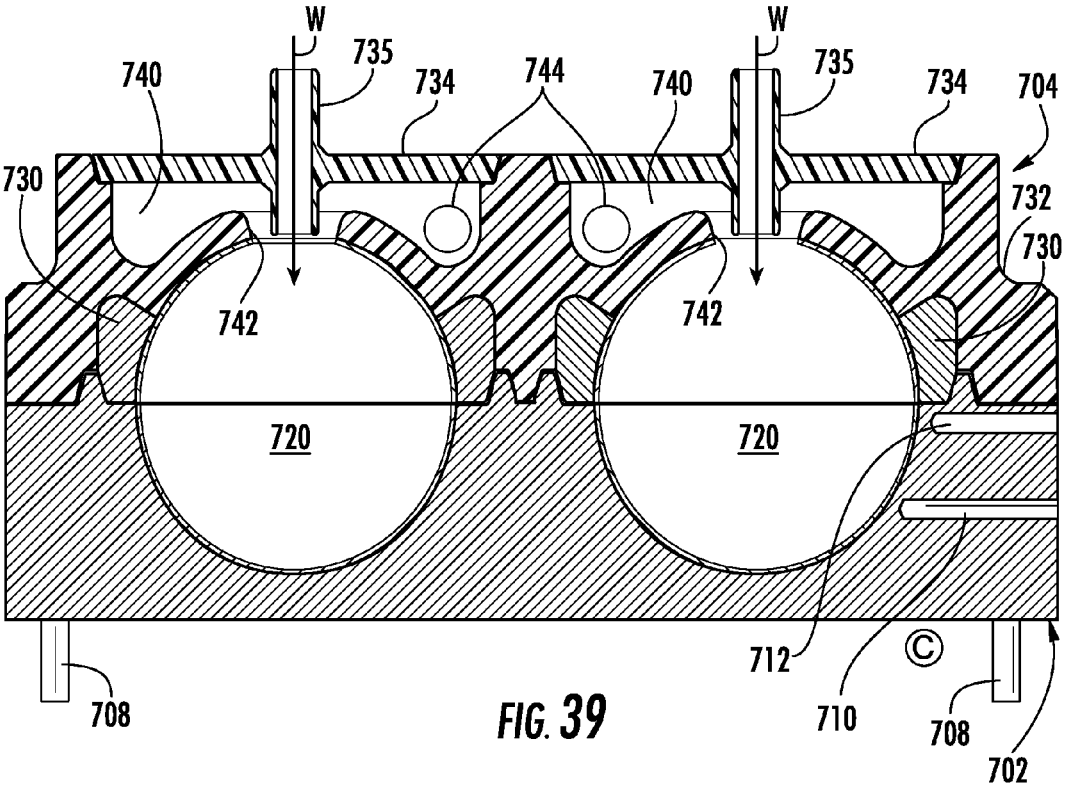
FIG. 39 is a cross-sectional side elevational view of the mold apparatus of FIG. 38 taken along line XXXIX.
Figure 40:
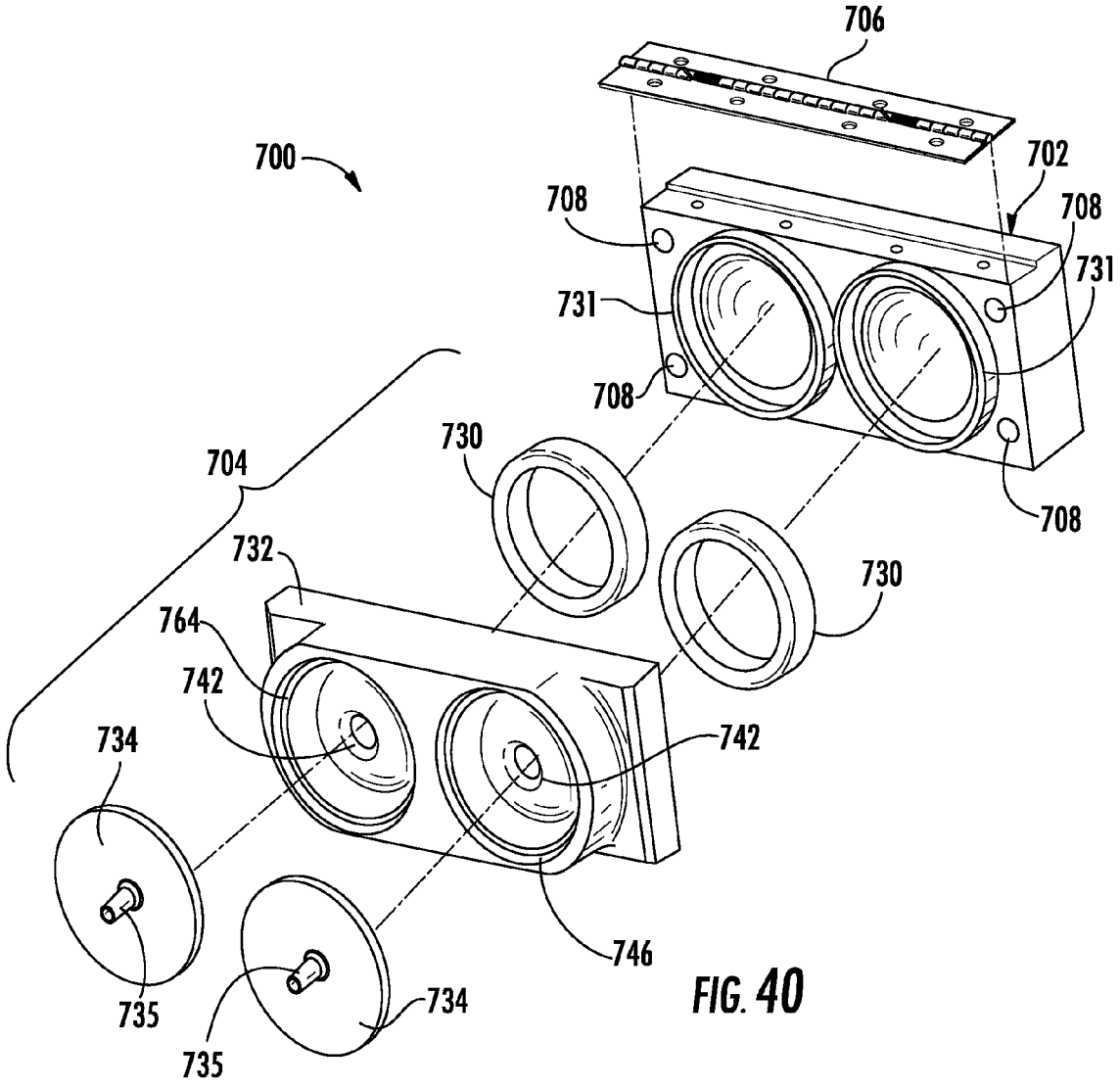
FIG. 40 is an exploded perspective view of the mold apparatus of FIG. 38.

Referring now to FIGS. 38-40, another embodiment of a mold apparatus 700 is shown. The mold apparatus 700 includes a first mold portion 702 and a second mold portion 704 that are operably coupled in a pivotal fashion by a piano hinge member 706; however, as with other embodiments, any engagement mechanism may be employed that allows the first mold portion and the second mold portion to move between an open position and a closed position. The mold apparatus 700 is shown in FIGS. 38 and 39 in a closed position C. The mold apparatus 700 includes two mold cavity forms each having a water inlet 735 disposed on the second mold portion 704. The water inlet 735 operates in a similar manner as the water inlet 635 shown in FIGS. 33-35D to allow for water to be injected into a mold cavity 720. As best shown in FIG. 39, the second mold portion 704 includes mold covers 734 for each mold form on the second mold portion 704. A chill ring cover 732 covers chill rings 730 associated with each mold form. A mold cavity water outlet aperture 742 is disposed on the chill ring cover 732 which opens into a water circulating cavity 740 such that unfrozen water injected into the mold cavity 720 during the ice formation process can flow into the water circulating cavity 740 through the mold cavity outlet aperture 742. In this way, unfrozen water within the mold cavity 720 does not remain stagnant, but rather circulates and continuously moves throughout the water circulating cavities 740.

As shown in FIG. 39, both water circulating cavities 740 further include water circulating cavity outlets 744, which allow water to escape the water circulating cavities 740 during the ice formation process. As shown in FIGS. 38 and 39, the first mold portion 702 includes mounting features 708, 710 and 712 for mounting the first mold portion 702 to an ice maker and to further couple the first mold portion 702 to a cooling source adapted to cool the first mold portion 702. As shown in FIG. 40, the mold apparatus 700 is shown in an exploded view, wherein the mold covers 734, having water inlet features 735 which are exploded away from the chill ring cover 732. The chill ring cover 732 includes the water outlet aperture 742 which allows water to escape from the mold cavity 720 and further includes housing apertures 746 which are adapted to receive the housing covers 734, such that the water circulating cavities 740 are defined therebetween. The chill ring elements 730 are disposed within the chill ring cover 732 as best shown in FIG. 39 and are further received in chill ring receiving housings 731 disposed on the first mold portion 702. The chill ring receiving housings 731 also serve as alignment features for the mold apparatus 700 when the first mold portion 702 and second mold portion 704 are in the closed position C.

As shown in the embodiment of FIG. 40, the first mold portion 702 includes mounting apertures 708, which are used to mount the first mold portion 702 to the ice maker body or a cooling source. As noted above, the water circulating cavities 740 help to slightly warm a portion of the second mold portion 704 to further induce directional solidification of an ice structure formed in the mold cavity 720.

Figure 41A:
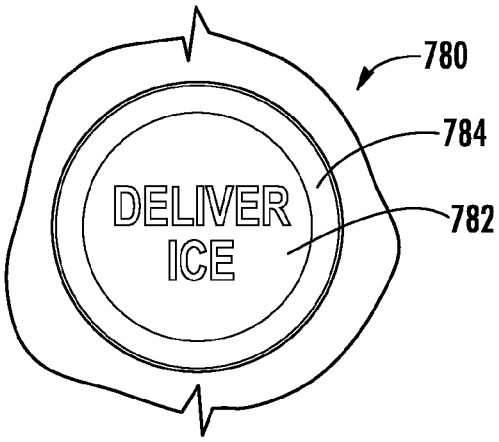
FIG. 41A-41D is a fragmentary top plan view of a function button.
Figure 41B:
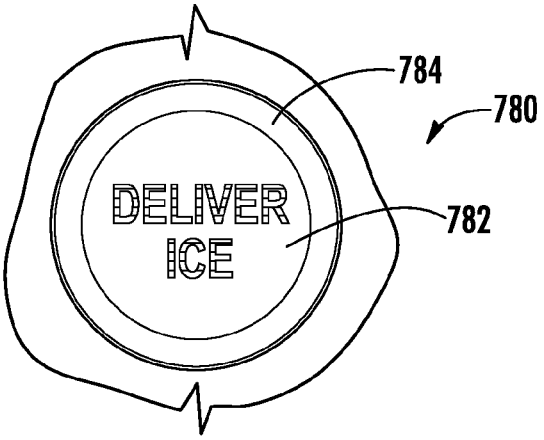
Figure 41C:
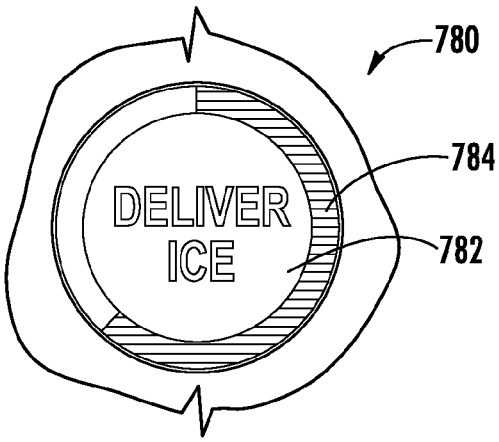
Figure 41D:
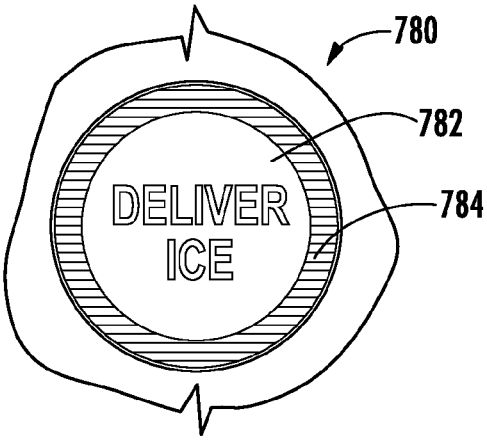

Referring now to FIGS. 41A-41D and 42, a function button 780 is generally shown. The function button 780 can be disposed on an ice maker, such as function button 322 shown in FIG. 6, however, the function button 780 can also appear in a virtual form, such as function button 780A, shown on a display of a handheld mobile device in FIG. 42. Specifically, as shown in FIGS. 41A-41D, the function button 780 is an ice delivery button with the wording "DELIVER ICE" disposed on a button portion 782 of the function button 780. As shown in FIG. 41B, the function button 780 indicates that the button portion 782 has been activated by a user such that the "DELIVER ICE" wording has been illuminated by an integrated illumination source. It is noted that the deliver ice wording is disposed on the button portion 782 of the function button 780, but may also be disposed adjacent to the function button 780 on an outer shell of an ice maker. Referring now to FIG. 41C, the function button 780 further includes a status indicator 784 which indicates the status of ice structures being delivered to an ice tray. As shown in FIG. 41C, the status indicator 784 is a status indicating ring capable of indicating that the delivery of ice to an ice tray is in process. Referring now to FIG. 41D, the status indicator 784 is fully illuminated such that the function button 780 is indicating to the consumer that ice has been delivered to the ice tray and is ready for retrieval. It is contemplated that upon the completion of the delivery of ice to the ice tray, the ice maker will alert the consumer by full illumination of the status indicator 784, which may be accompanied by an audible notification as well.

Figure 42:
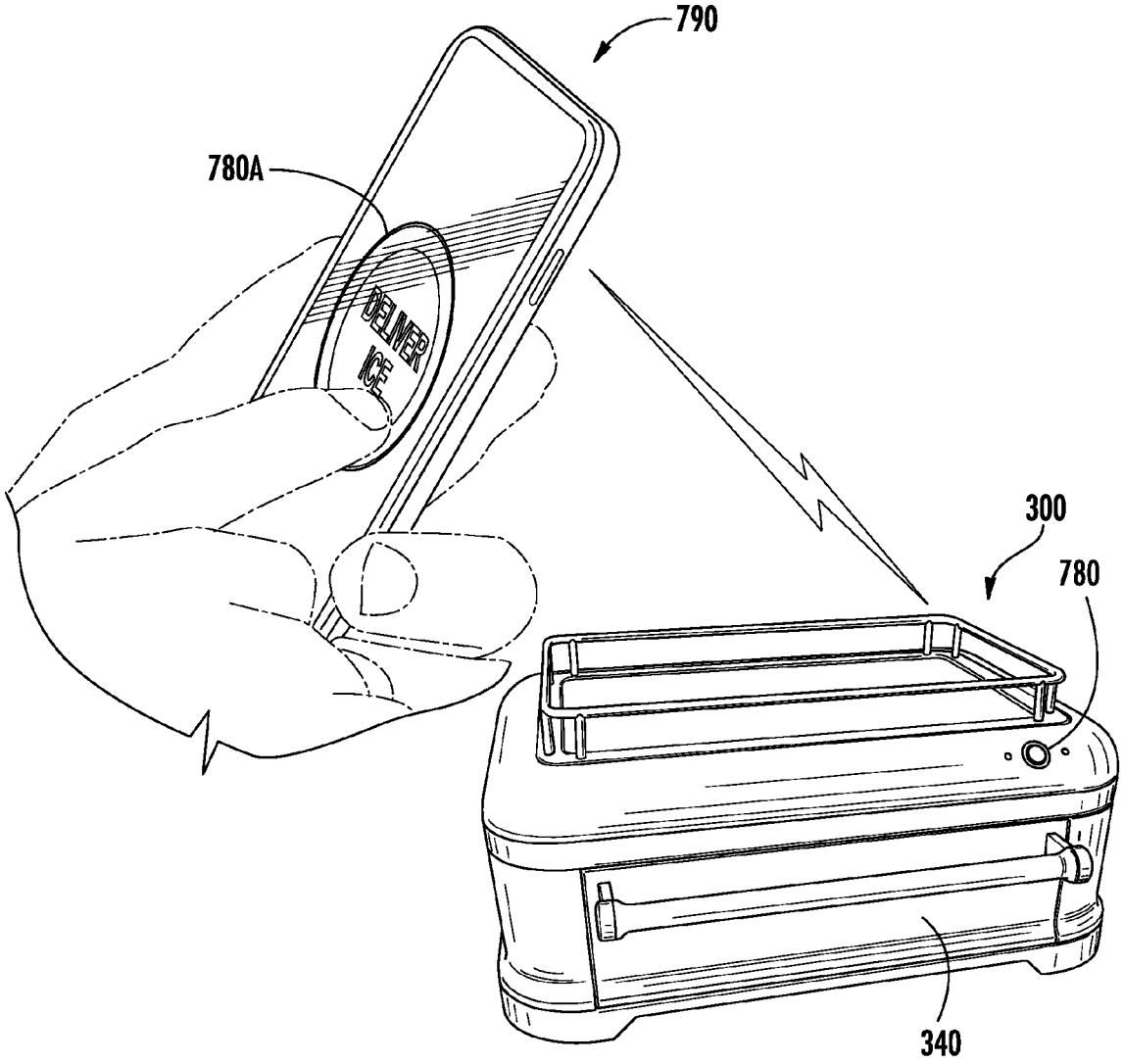
FIG. 42 is a perspective view of an ice maker in electronic communication with a user controlled mobile device.

Referring now to FIG. 42, an ice maker 300, such as ice maker 300 shown in FIG. 6, is depicted in electronic communication with a handheld mobile device 790 having a virtual function button 780A displayed thereon. A mobile application may be installed on the handheld mobile device that, when opened, provides the user with various information, including but not limited to access to the virtual function button. In this way, the consumer can remotely control an ice maker, such as ice maker 300 shown in FIG. 6, to deliver ice to the ice delivery drawer 340 through the handheld mobile device 790. It is contemplated that the handheld mobile device 790 can be a remote control device that is dedicated to the ice maker 300, or can be a mobile device that is programmable to control the ice maker 300, such as a Smartphone or other like mobile apparatus. It is contemplated that the ice maker 300 can communicate with the handheld mobile device 790 via a Wi-Fi or Bluetooth system, via the internet (a network of computer system) or any other like electronic communication system, such as radio or infrared correspondence. In the ice maker shown in FIG. 10, the Wi-Fi communication circuit board 421 is shown. The Wi-Fi communication circuit board 21 is typically proximate the fan 420, more typically proximate a side of the fan 420 to enable the fan to cool the Wi-Fi communication board through air movement.

Figure 43:
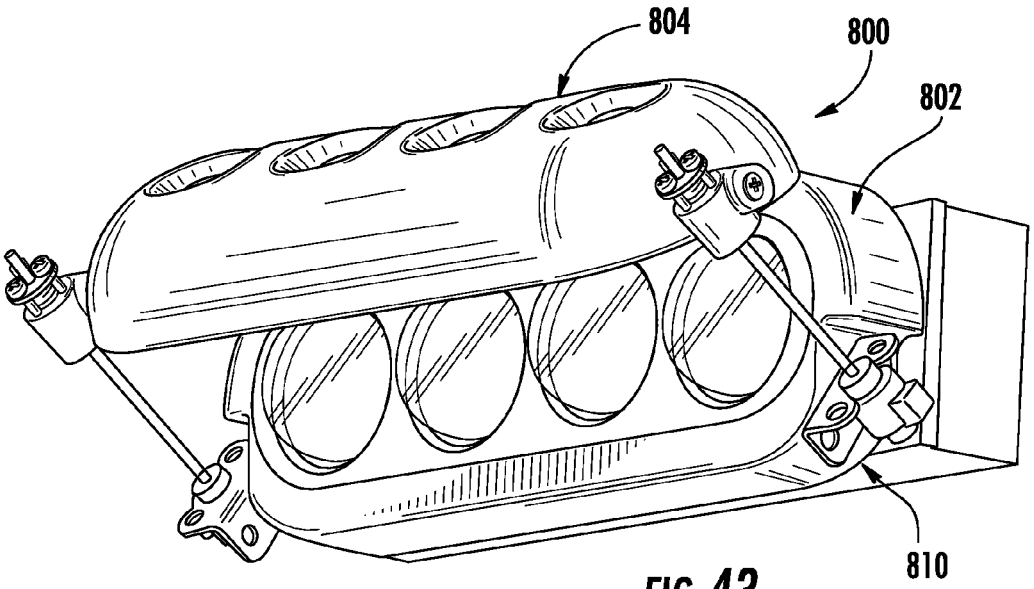
FIG. 43 is a perspective view of a mold apparatus having a drive mechanism.
Figure 44:
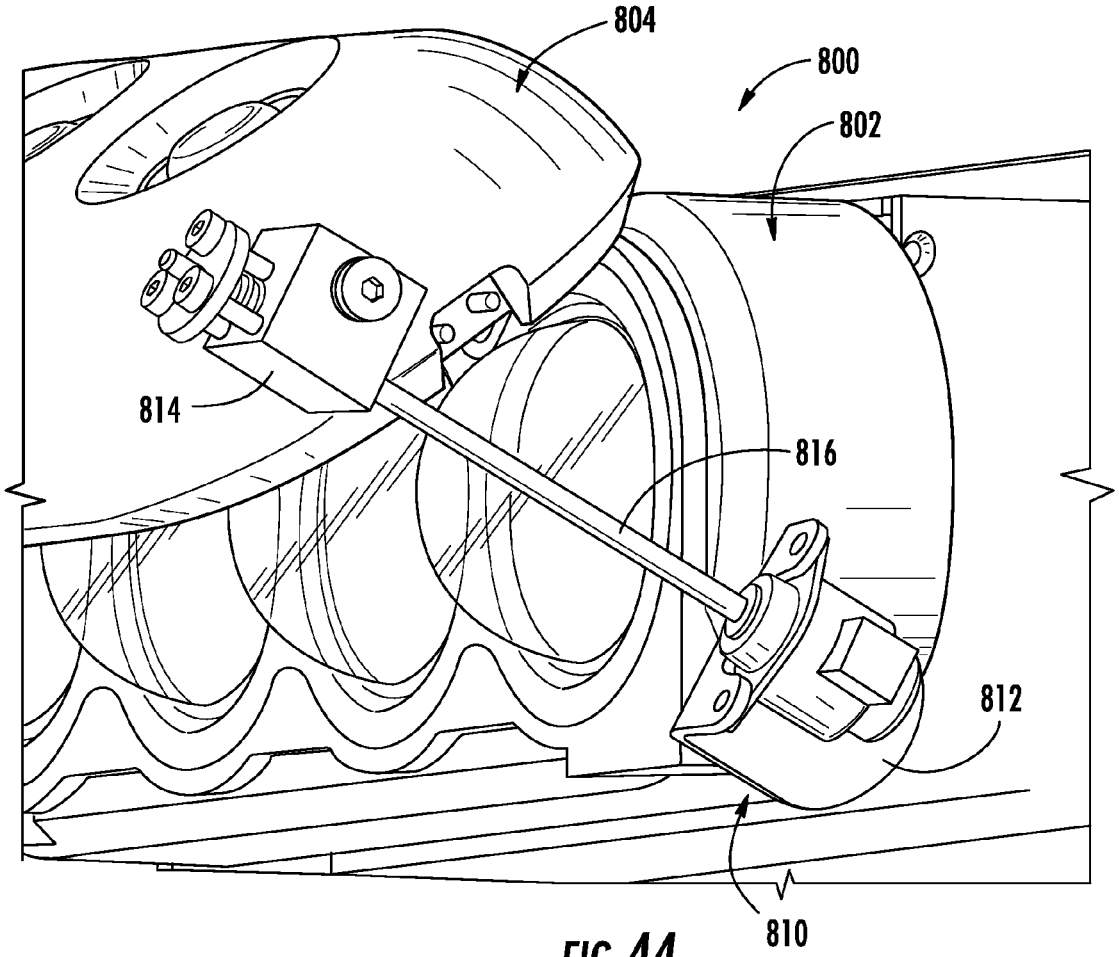
FIG. 44 is a fragmentary perspective view of the drive mechanism of FIG. 43.

Referring now to FIGS. 43-59, a plurality of mold closure mechanisms are shown for a variety of mold apparatuses which will generally be indicated as mold apparatuses 800 having a first mold portion 802 and a second mold portion 804. Each mold apparatus 800 generally includes a plurality of mold cavities that are formed when the first mold portion 802 and the second mold portion 804 are in a closed position. For purposes of the description of the mold apparatuses 800 shown in FIG. 43-59, it will be generally assumed that the mold apparatuses 800 are configured to produce clear ice spheres. With specific reference to FIGS. 43 and 44, a mold closing apparatus 810 is shown.

The mold closure apparatus 810 is a mold actuating device that is able to drive the second mold portion 804 towards the first mold portion 802 to close the mold apparatus 800. The mold closure mechanism 810 includes a first mounting bracket 812 mounted to the first mold portion 802, and a second mounting bracket 814 mounted to the second mold portion 804. A connecting rod or drive rod 816 connects the first mounting bracket 812 to the second mounting bracket 814. The mold closure mechanism 810 is typically powered by an electric motor (not shown) which drives the second mold portion 804 to a closed position with a mold portion 802. The mold closure mechanism 810 helps to keep the mold apparatus 800 in a closed position where the second mold portion 804 is tightly sealed against the first mold portion 802 such that water does not escape the closed mold during the ice formation process.

Figure 46:
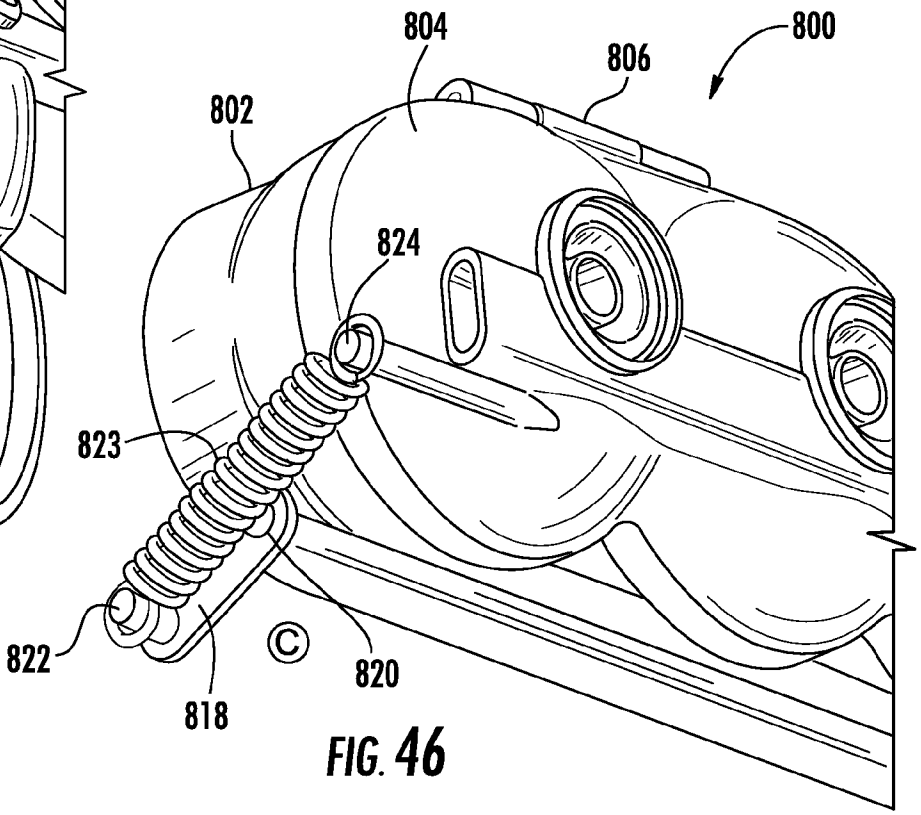
FIG. 46 is a fragmentary perspective view of the mold apparatus of FIG. 45 in a closed position.
Figure 45:
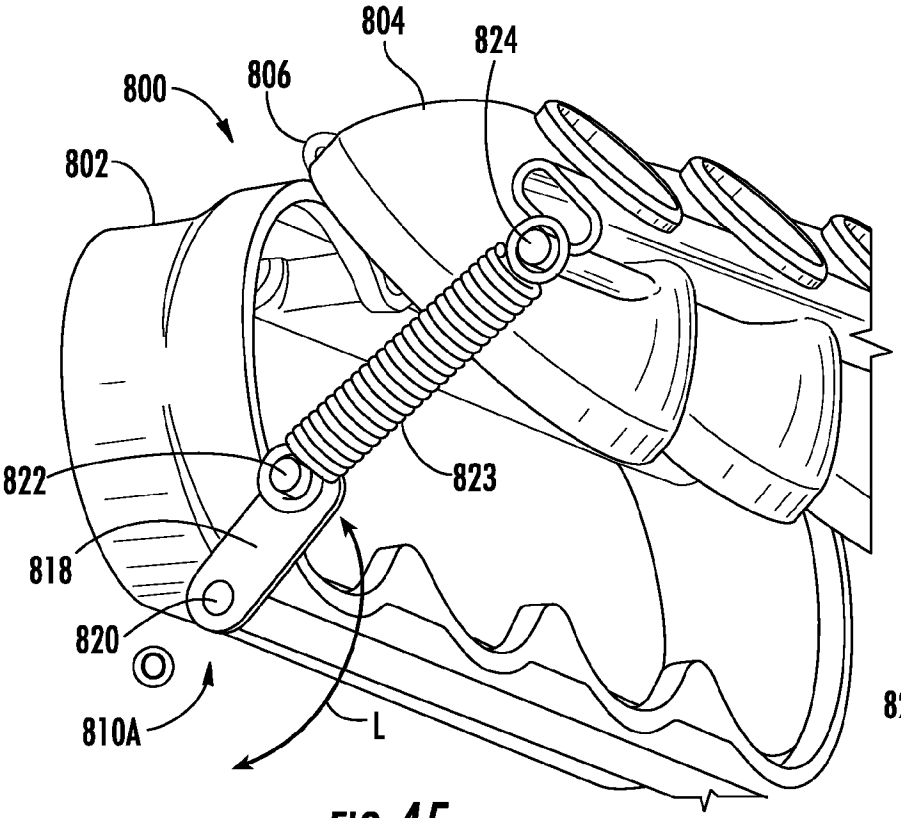
FIG. 45 is a fragmentary perspective view of a mold apparatus in an open position having a linkage and biasing member.

Referring now to FIGS. 45-46, the mold apparatus 800 is shown in an open position O, FIG. 45, and further shown in a closed position C, FIG. 46 having a mold closure mechanism 810A. As shown in FIG. 45, the first mold portion 802 includes a pivoting link 818, which is pivotally coupled to the first mold portion 802 at a mounting location 820. The link 818 further includes a mounting feature 822 which is coupled to a coil spring 823. The coil spring 823 is further coupled to a mounting feature 824 disposed on the second mold portion 804. In operation, the pivoting link 818 is adapted to pivot as indicated by arrow L to move the second mold portion 804 into a closed engagement with the first mold portion 802 shown in FIG. 46. As the link 818 moves along the path indicated by arrow L to the closed position, the coil spring 823 provides a retaining force on the mold apparatus 800 to ensure the mold apparatus 800 remains in the closed position C during the ice formation process. The mold closure mechanism 810A, shown in FIGS. 45 and 46, is contemplated to be disposed on either side of the mold apparatus 800, or can be used in conjunction with another mold closure mechanism, such as mold closure mechanism 810, shown in FIGS. 43 and 44. As shown in FIGS. 45 and 46, the first mold portion 802 is coupled to the second mold portion 804 in a pivoting manner by a hinge member 806.

Figure 47:
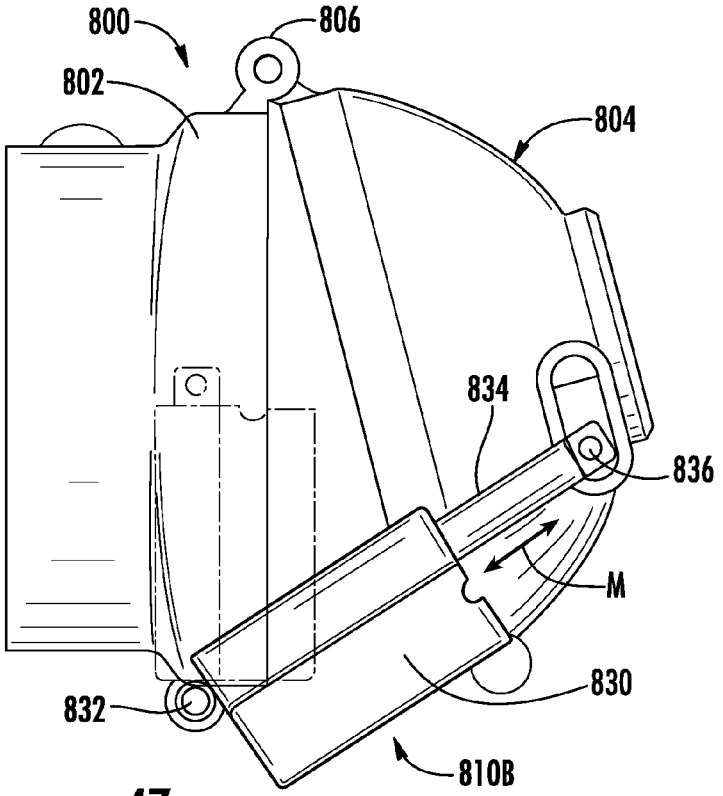
FIG. 47 is a side elevational view of a mold apparatus in a partially open position having a drive mechanism.

Referring now to FIG. 47, a mold closure mechanism 810B is shown having an actuation mechanism 830 which is pivotably coupled to the first mold portion 802 at a pivoting mounting aperture 832. The actuator mechanism 830 further includes an actuation rod 834, which is pivotally coupled to the second mold portion 804 at a pivoting mounting feature 836. In operation, the actuation mechanism 830 is adapted to extend and retract the actuation rod 834 along a path indicated by arrow M. When in the extended position, the actuation rod 834 moves the second mold portion 804 to an open position or an ice harvesting position. When in the retracted position, the actuation rod 834 moves the second mold portion 804 to a closed and sealed engagement with the first mold portion 802 for ice formation.

Figure 48:
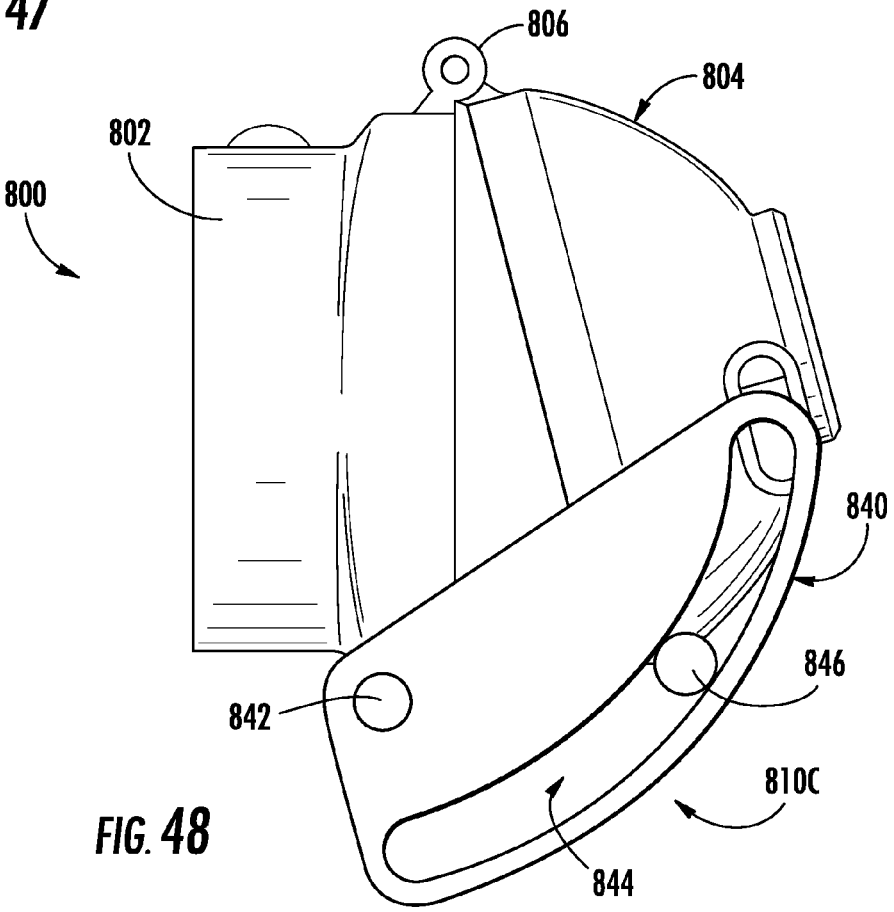
FIG. 48 is a side perspective view of a mold apparatus in a partially open position having a guide plate.
Figure 49:
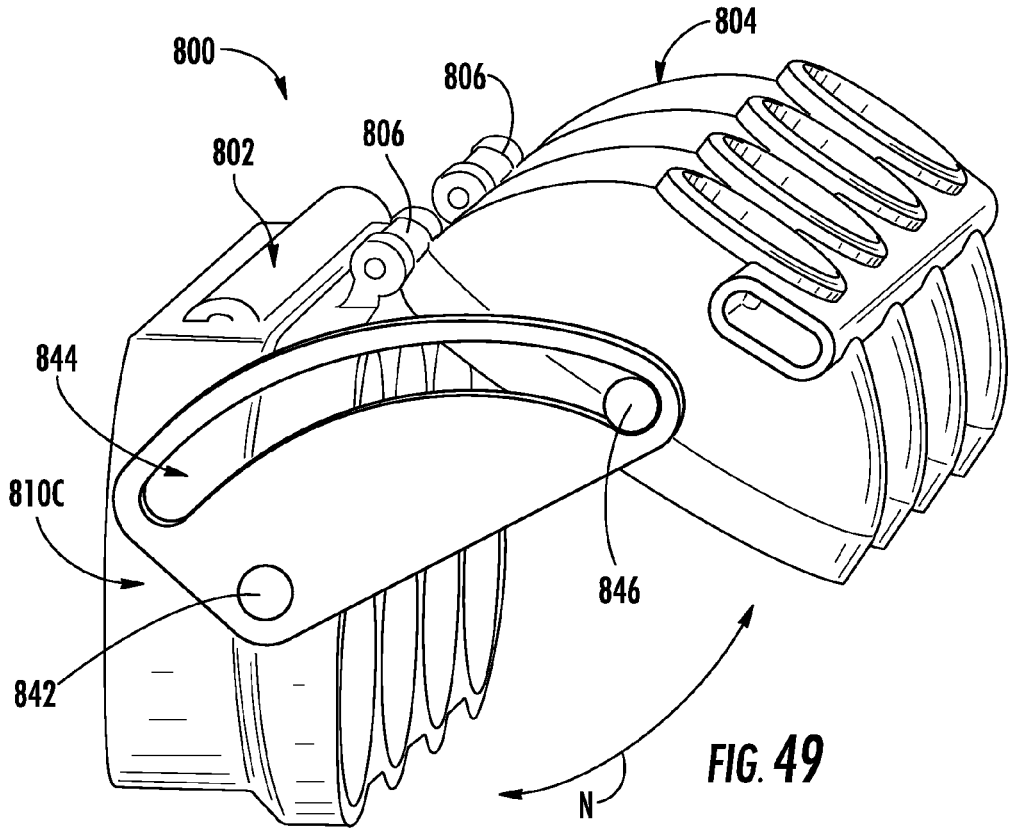
FIG. 49 is a perspective view of a mold apparatus in a fully open position having a guide plate.

Referring now to FIGS. 48 and 49, a mold closure guide mechanism 810C is shown comprising a guide bracket 840 which is pivotably mounted to the first mold portion 802 at a mounting aperture 842. The guide bracket 840 further includes a guide channel 844 running a length of the guide bracket 840 in a generally arcuate manner. The guide channel 844 is adapted to receive a guide member 846 disposed on the second mold portion 804, wherein the guide member 846 is slidably received within the guide channel 844. In this way, the guide bracket 840 guides the movement of the second mold portion 804 between open and closed positions. It is contemplated that the mold closure guide mechanism 810C shown in FIG. 48 can be used in conjunction with another mold closure mechanism, such as mold closure mechanism 810B shown in FIG. 47. As shown in FIG. 49, the mounting guide mechanism 810C is mounted to the first mold portion 802 in an inverse manner relative to the mounting of the guide mechanism 810C shown in FIG. 48. In a similar fashion, the mounting mechanism 810C, shown in FIG. 49, is adapted to guide the closing of the mold apparatus 800 along an arcuate path indicated by arrow N.

Figure 50:
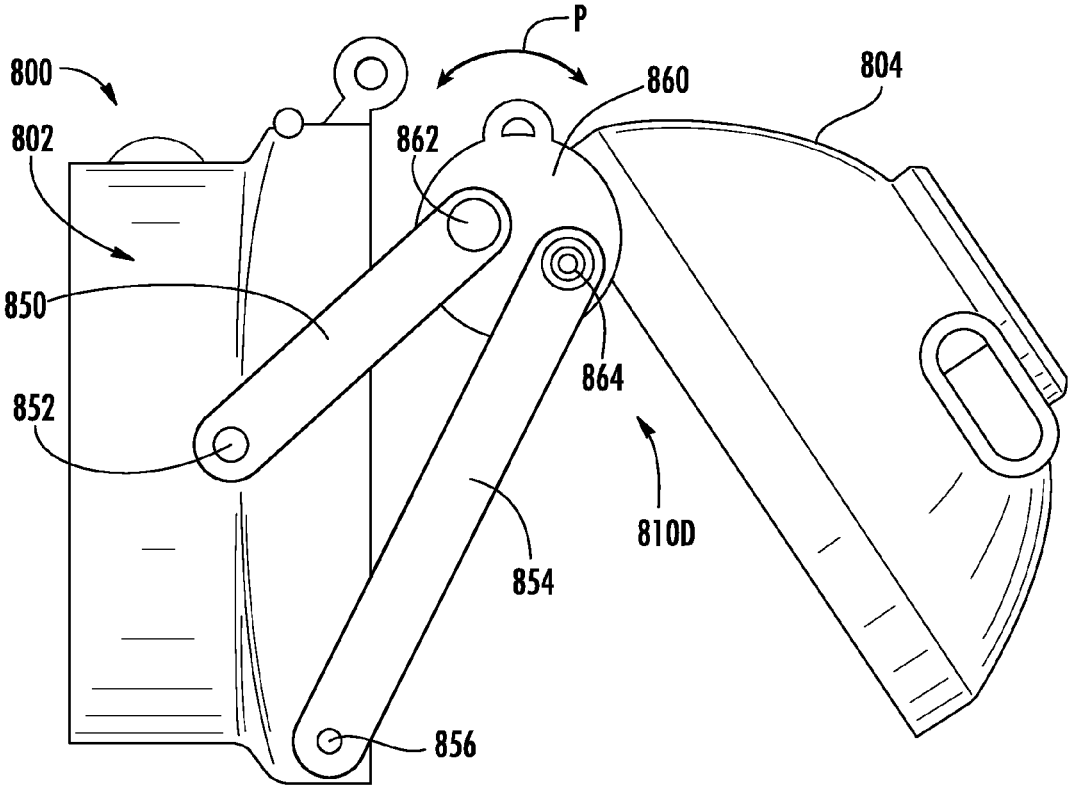
FIG. 50 is a side elevational view of a mold apparatus having a multi-bar linkage system.

Referring now to FIG. 50, the mold apparatus 800 includes a mold closure mechanism 810D which includes a first linkage 850 and a second linkage 854, which are operably coupled to the first mold portion 802 in a pivotal manner at mounting apertures 852 and 856, respectively. The linkages 850 and 854 are pivotally mounted at apertures 852, 856 and are further pivotally mounted to a drive wheel 860 at apertures 862 and 864 respectively. In operation, the drive wheel 860 is adapted to move in a rotating manner as indicated by arrow P to drive the second mold portion 804 to a closed, sealed engagement with the first mold portion 802 during ice formation.

Figure 51:
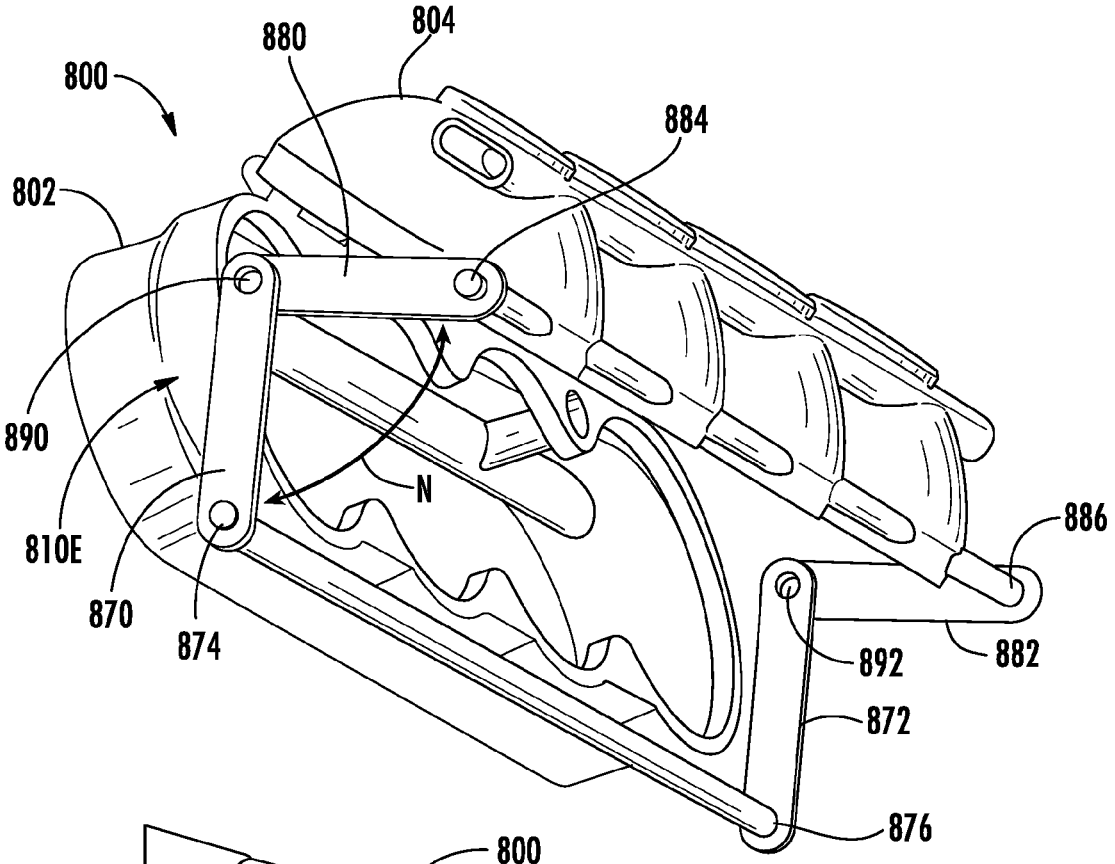
FIG. 51 is a perspective view of a mold apparatus having a multi-bar linkage system.

Referring now to FIG. 51, a mold closure mechanism 810E is depicted having first and second linkages 870, 872, which are pivotally mounted to the first mold portion 802 at mounting locations 874 and 876 on opposite sides of the mold apparatus 800. The linkages 870 and 872 are further pivotally mounted to first and second linkages 880 and 882, which are pivotally mounted to the second mold portion 804 at mounting locations 884 and 886 respectively. The first and second linkages 870, 872 of the first mold form 802 and the first and second linkages 880, 882 of the second mold form 804 are pivotally coupled at pivot points 890 and 892 respectively. When closing the mold apparatus 800, the mold closure mechanism 810E is driven by a motor (not shown) which drives the second mold portion 804 towards the first mold portion 802 along a path as indicated by arrow N.

Figure 52:
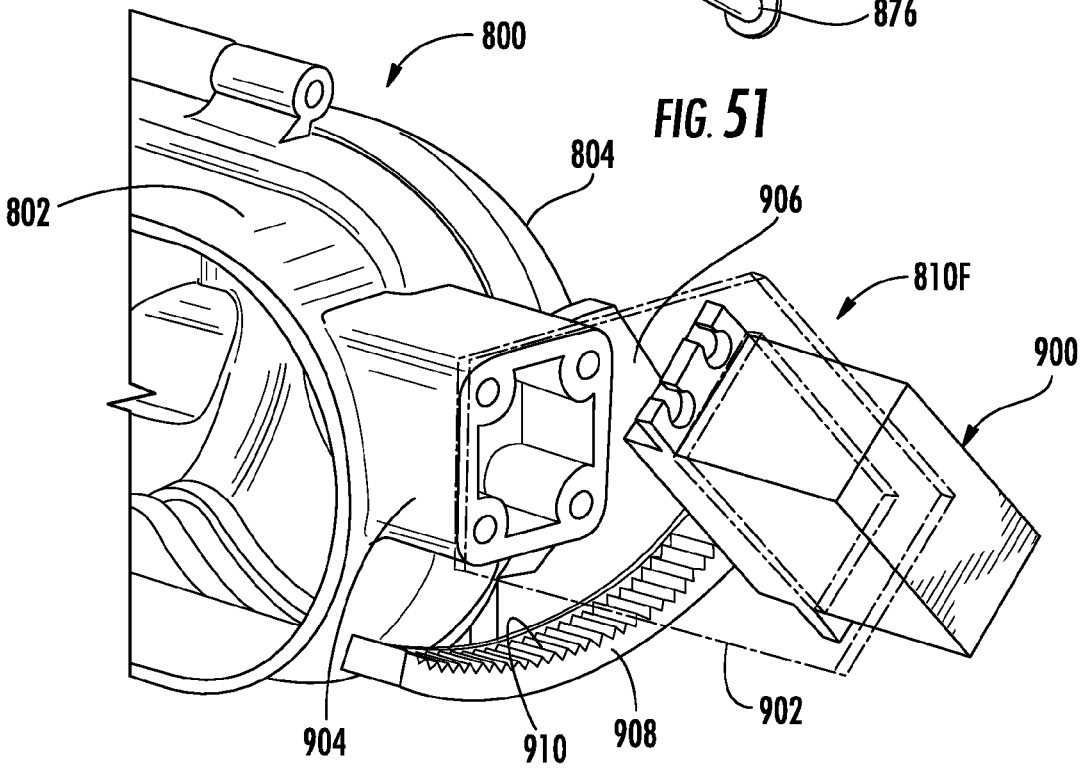
FIG. 52 is a fragmentary perspective view of a mold apparatus having a geared drive mechanism.

Referring now to FIG. 52, the mold apparatus 800 includes a mold closure mechanism 810F having a motor 900, which is adapted to be mounted onto a motor mounting plate 902, shown in phantom, which is mounted to a motor mounting bracket 904 disposed on the first mold portion 802. The second mold portion 804 includes a bracket member 906 having an arcuately shaped landing 908 with a geared tooth upper portion 910. In this assembly, the motor 900 will generally include a cog or gear mechanism adapted to gearingly couple to the geared tooth portion 910 of the landing 908. In this way, the motor 900 can drive the second mold portion 804 between open and closed positions along the arcuate path of the landing 908. Further, having this rigid geared configuration, the mold closure mechanism 810F provides a clutch mechanism to ensure the mold apparatus 800 remains in a closed position during the ice formation process.

Figure 53:
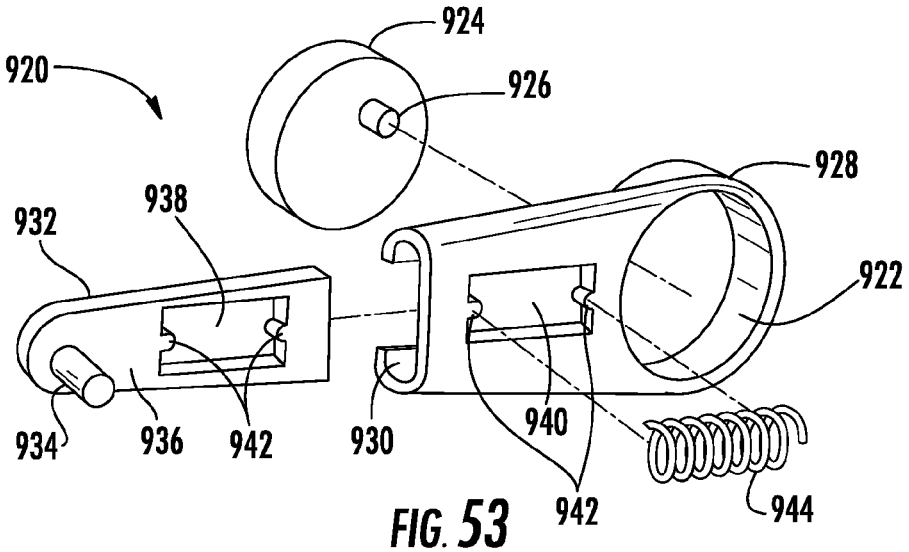
FIG. 53 is an exploded perspective view of a cammed lever arm.
Figure 54:
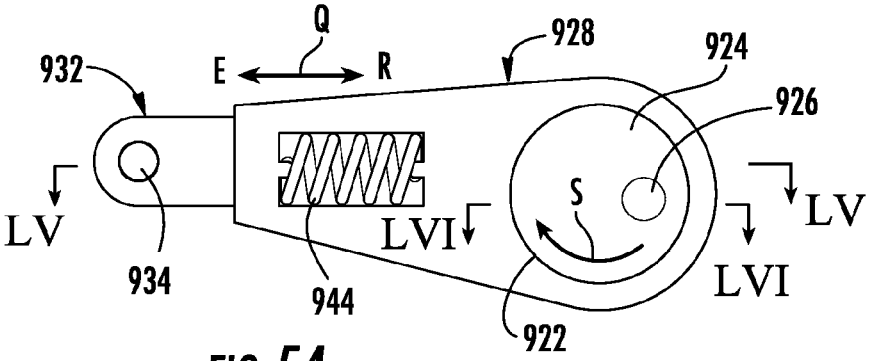
FIG. 54 is a top plan view of the cammed lever arm of FIG. 53.
Figure 55:
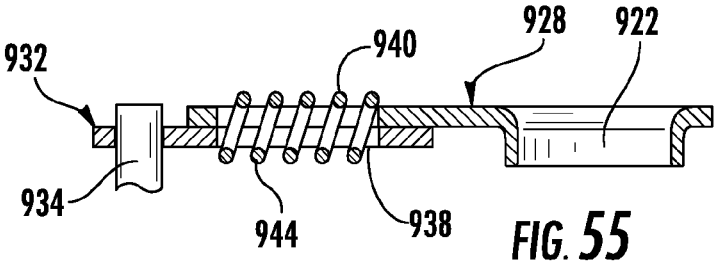
FIG. 55 is a fragmentary cross-sectional view of the cammed lever arm of FIG. 54 taken along line LV.
Figure 56:
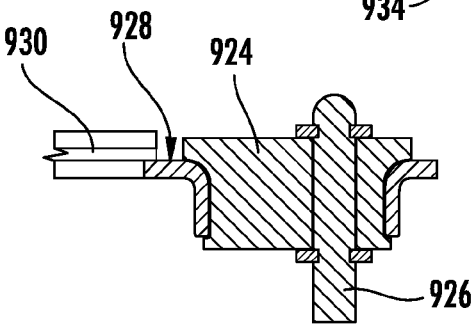
FIG. 56 is a fragmentary cross-sectional view of the cammed lever arm taken along line LVI.

Referring now to FIGS. 53-56, an extendable linkage arm 920 is shown having a base portion 928 with an open aperture 922 that is adapted to receive a drive wheel 924, wherein the drive wheel 924 further includes a motor mounting feature 926. The extendable linkage arm 920 is generally a two-piece linkage arm including the base portion 928 and an upper portion 932. The base portion 928 further includes a channel 930, which is adapted to receive the upper portion 932 of the two-part linkage arm 920. The upper portion 932 of the linkage arm 920 includes a mounting feature 934 disposed on a body portion 936. The body portion 936 is adapted to be received in channel 930 of the base portion 928. As shown in FIG. 53, the base portion 928 and upper portion 932 of the linkage arm 920 both include spring retainment apertures 938 and 940 having spring retainment features 942 disposed therein. A spring 944 is adapted to be disposed within the spring retainment apertures 938 and 940 when the spring retainment apertures 938 and 940 are aligned as shown in FIG. 54. In this way, the spring 944, or other like biasing mechanism, is adapted to bias the extendable linkage arm 920 to a retracted position R as shown in FIG. 54. The extendable linkage arm 920 is moveable between an extended position E and a retracted position R in a direction as indicated by arrow Q. In operation, the motor mounting feature 926 disposed on the drive wheel 924 is adapted to be received in the open aperture 922 of the base portion 928 such that the motor mounting feature 926 can be coupled to a mold closure actuation device adapted to rotate the drive wheel 924 in a rotating direction as indicated by arrow S. It is noted that the motor mounting feature 926 is an eccentric motor mounting feature, such that as the drive wheel 924 rotates in the direction indicated by arrow S, the extendable linkage arm 920 will move between the extended position E and the retracted position R as indicated by arrow Q.

Figure 57:
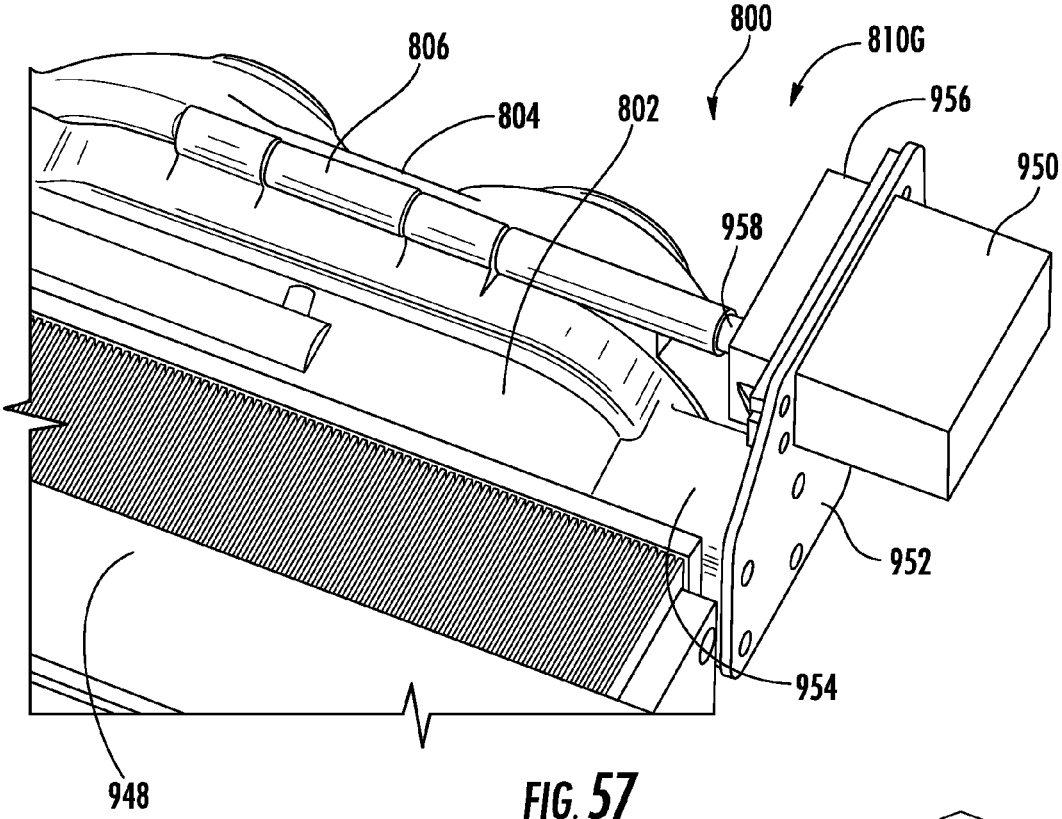
FIG. 57 is a fragmentary top perspective view of a mold apparatus coupled to a motor.
Figure 58:
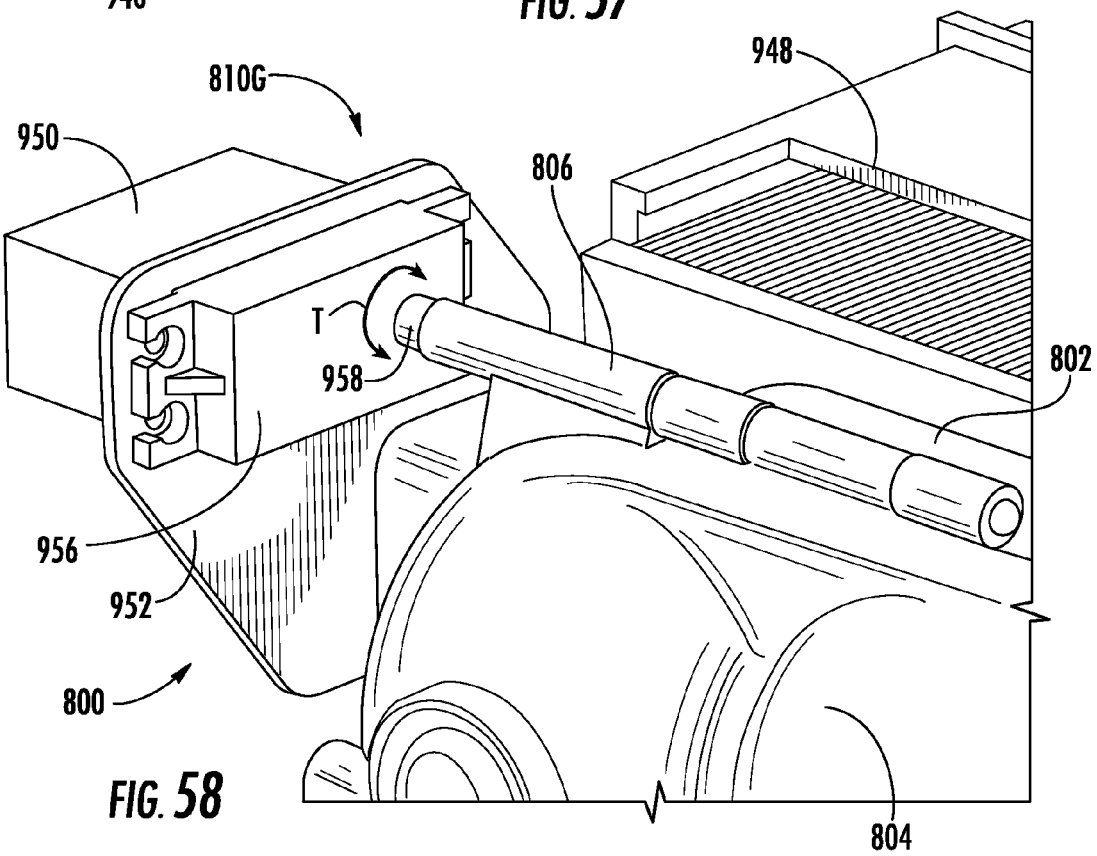
FIG. 58 is a fragmentary side perspective view of the mold apparatus of FIG. 57.
Figure 59:
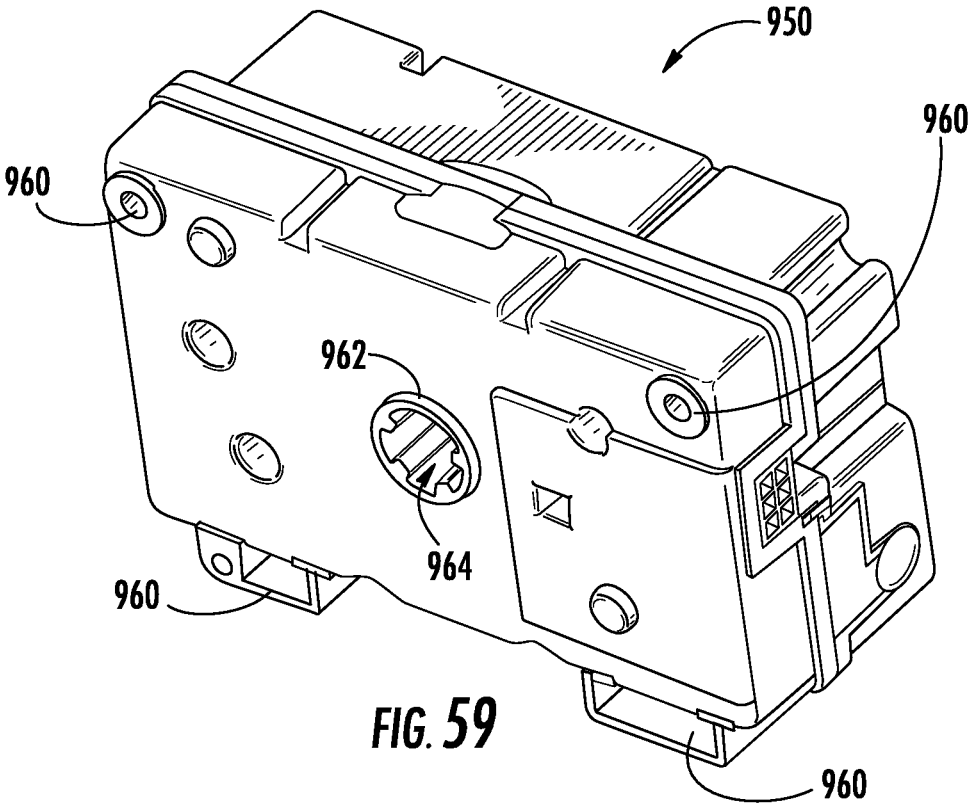
FIG. 59 is a perspective view of a motor.

Referring now to FIGS. 57-59, a mold closure mechanism 810G is shown having a motor portion 950 coupled to a motor mounting plate 952, which is further coupled to a motor mounting feature 954 disposed on the first mold portion 802. In the embodiment shown in FIGS. 57 and 58, the first mold portion 802 is coupled to a cooling source 948. The cooling source 948 is contemplated to be a heat exchanger, similar to the heat exchangers noted above, which is used to chill the mold apparatus 800. As shown in FIG. 58, the motor 950 is coupled to a mold engagement feature 956, which is operably coupled to the hinge mechanism 806 of the mold apparatus 800. In operation, the motor 950 is adapted to drive a drive rod 958 in a rotating manner as indicated by arrow T to drive the mold apparatus 800 between open and closed positions. As shown in FIG. 59, the motor 950 can include multiple mounting features 960 for mounting the motor 950 to a motor mounting plate 952 or to another portion of an ice maker as necessary. The motor 950 further includes a rotor drive aperture 962 having a geared channel 964 adapted to receive a geared portion of a drive rod, such as drive rod 958 shown in FIGS. 57 and 58.

Referring now to FIGS. 60-64, an ice maker apparatus 970 is shown having a base plate 972 with a waste water collection reservoir 974 and an air purifier apparatus 976. The waste water reservoir 974 generally includes a compartment or tray feature 978 that is adapted to collect runoff water expelled in the ice maker during the ice formation process. The waste water reservoir 974 further includes a handle 980 that is accessible from a side portion of the ice maker 970, such that the waste water reservoir 974 can be removed from the ice maker 970 and emptied by the consumer. Similarly, the air purifier apparatus 976 includes an air filter 982 disposed in a tray like compartment 984 of the air purifier apparatus 976. The air purifier apparatus 976 further includes outer casing 986 which is accessible from a side portion of the ice maker 970 such that the air purifier apparatus 976 can be substantially or completely removed from the ice maker 970 such that the consumer may remove the air filter 982 for cleaning or replacement. It is contemplated that the air filter 982 can be a washable air filter which can be cleaned by the consumer and inserted back into the air purifier apparatus 976 for future use. The air purifier mechanism 976 may also include replaceable air filters which can be monitored in such a fashion that the ice maker 970 will indicate to the consumer when an air filter needs to be replaced. Similar, the ice maker 970 can indicate to a consumer when the waste water reservoir 974 is filled to capacity and must be emptied by monitoring water levels in the waste water reservoir 974 using one or more sensors.

Figure 60:
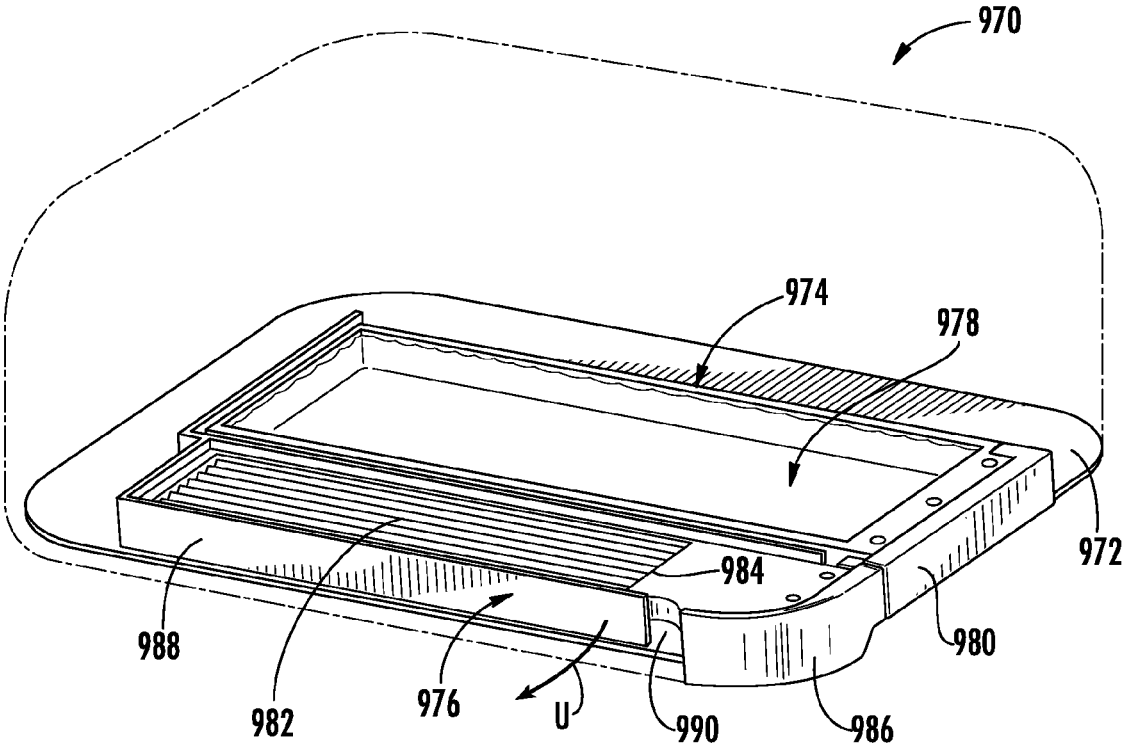
FIG. 60 is a top perspective view of a water collection tray accessible from the side of the ice maker shown in phantom.
Figure 61:
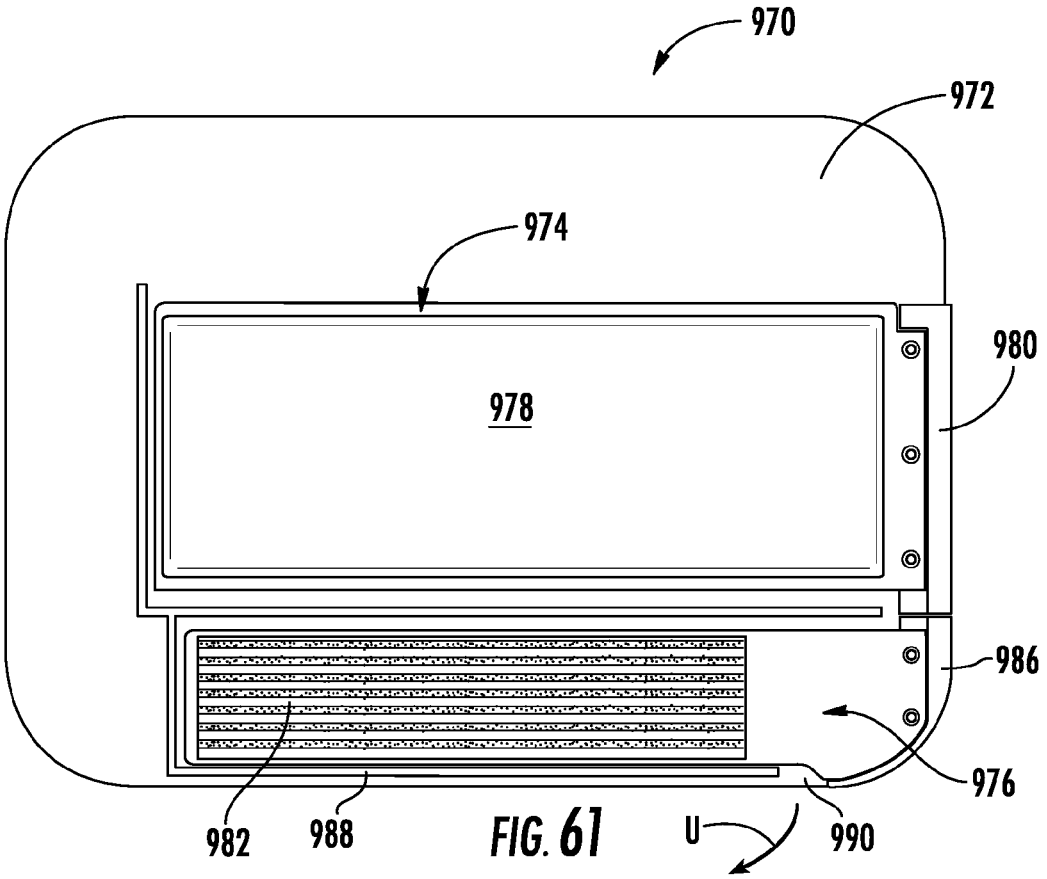
FIG. 61 is a top plan view of the water collection tray of FIG. 60.

The air purifying mechanism 974 helps prevent dirt and other particles from reaching the heat exchanger and in this way, the air purifier apparatus 976 filters air supplied to the heat exchanger. As noted above, air will generally pass through the base plate 972 of the ice maker 970 and will be expelled through an outer casing of the ice maker 970 by fans during air circulation. It is contemplated that the air purifier apparatus 976 will filter the air as drawn through the base plate 972 of the ice maker 970. It is contemplated that both the air purifying mechanism 976 and the waste water reservoir 974 can be slidably received within a lower portion of the ice maker 970 in a drawer-like maker, such that the air purifier apparatus 976 and the waste water reservoir 974 can be completely removed from the ice maker 970 for maintenance by the consumer. As shown in FIGS. 60 and 61, the air purifier outer casing 986 may be a stationery component of the ice maker 970, such that a front plate 988 may be pivoted out of the air purifier 976 in a direction as indicated by arrow U. The front plate 988 can be accessed through an access aperture 990 such that the front plate 988 can swing out from the ice maker 970 thereby making the air filter 982 accessible to the user. Further, it is contemplated that the air filter receiving tray 984 can be coupled to the front plate 988, such that the air filter 982 and air filter receiving tray 984 will also be pivoted out of the ice maker 970 along with the front plate 988.

Figure 62:
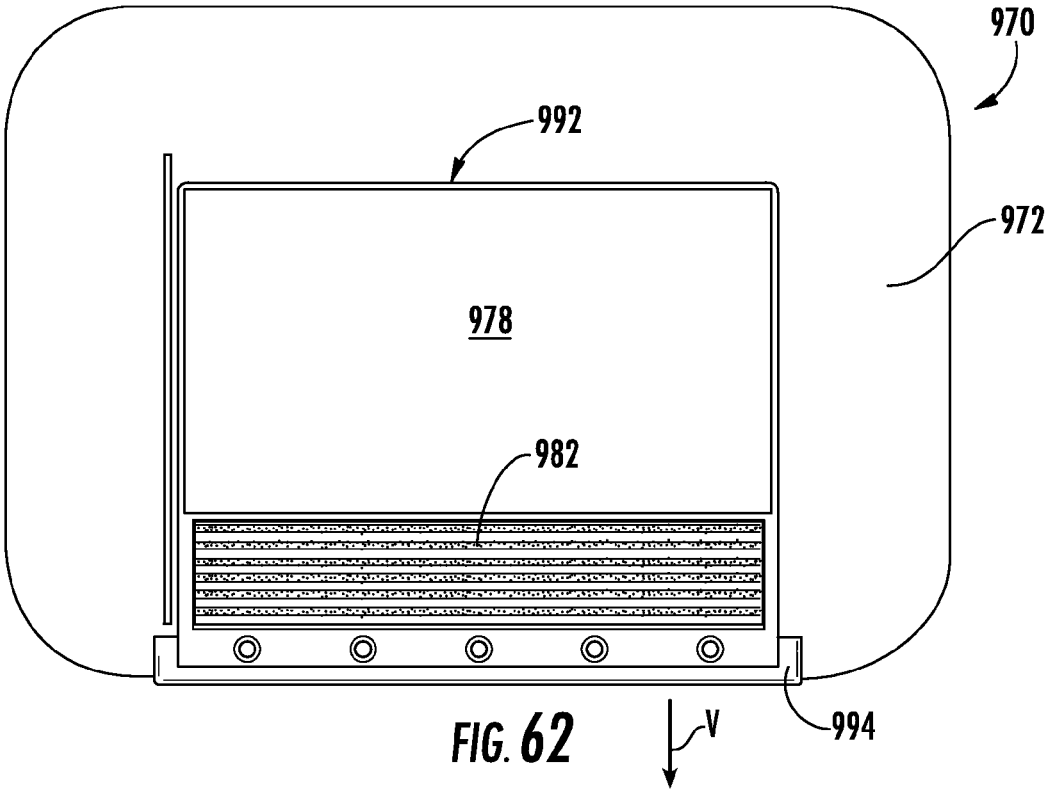
FIG. 62 is a top plan view of a water collection tray for a ice maker accessible from the front of the ice maker.
Figure 63:
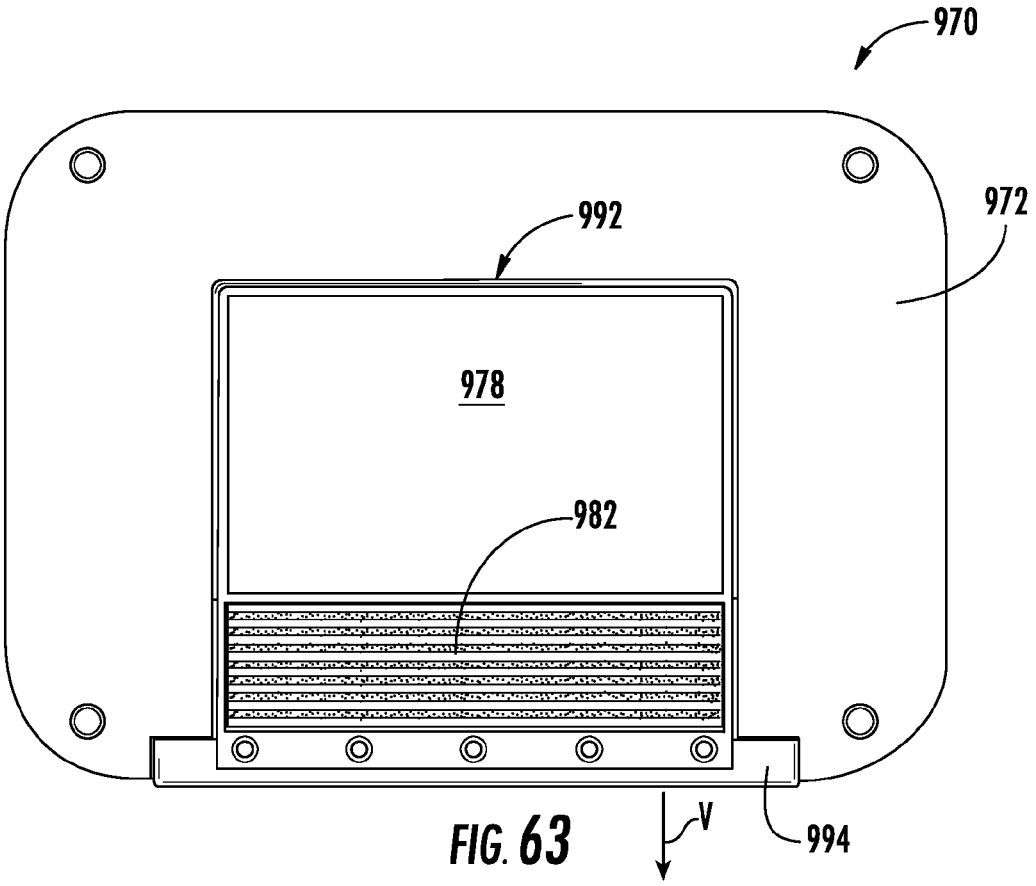
FIG. 63 is a bottom elevational view of the water collection tray of FIG. 62.
Figure 64:
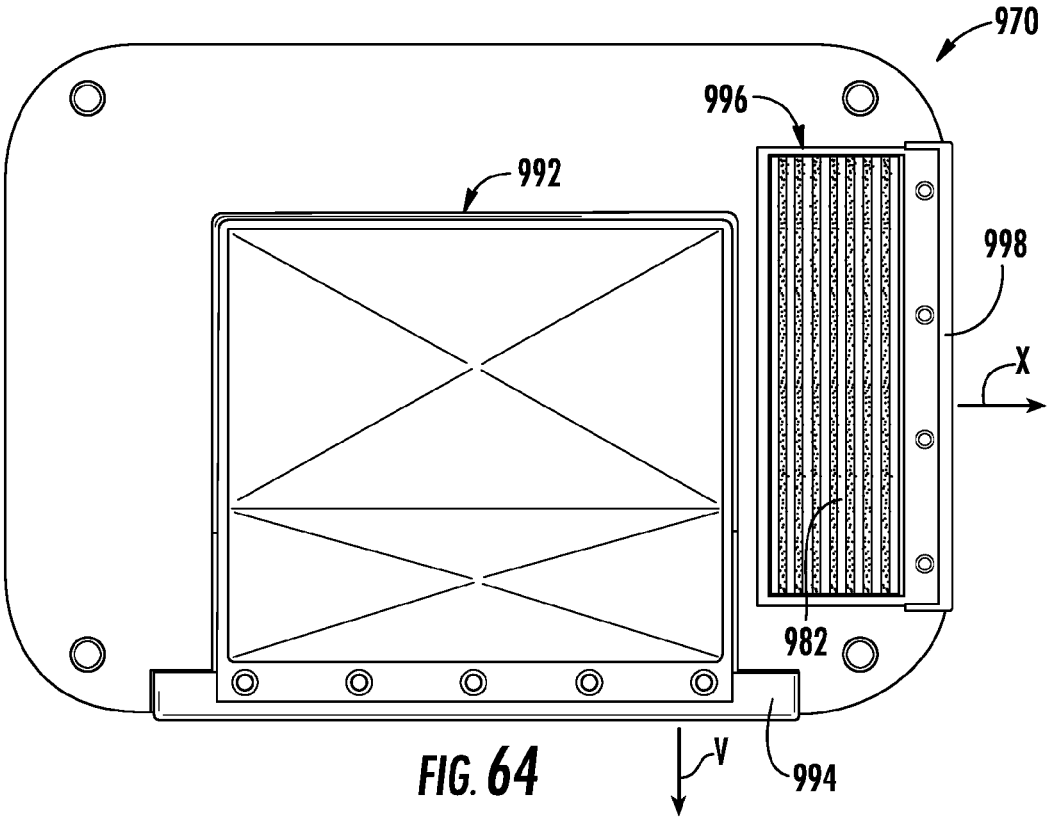
FIG. 64 is a bottom elevational view of a water collection tray accessible from the front of an ice maker and an air filter apparatus accessible from the side of an ice maker.
Figure 65:
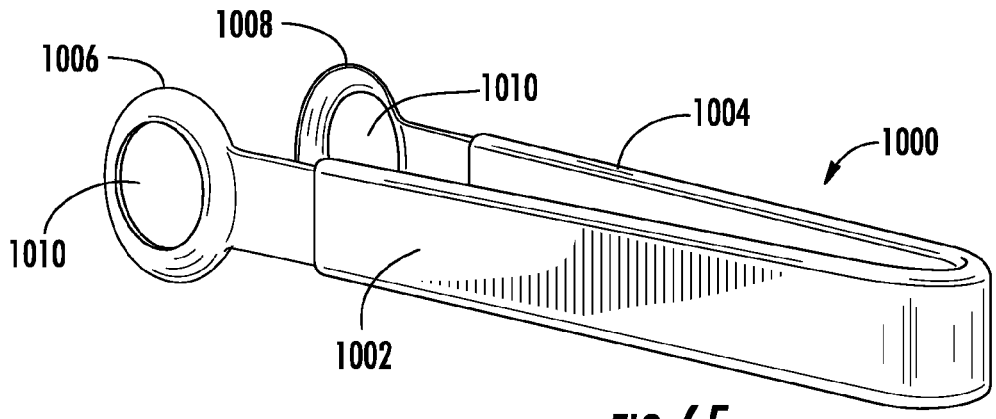
FIGS. 65-68 are perspective views of tong mechanisms adapted to grasp and emboss ice structures.

Referring now to FIGS. 62-64, the ice maker 970 may include a combined tray 992 which is a removable tray having a waste water reservoir 978 and an air filter 982 disposed therein. The removable tray 992 further includes a handle 994 which is accessible through a front portion of the ice maker 970 such that the tray 992 can be removed from the ice maker 970 in a direction as indicated by arrow V. As shown in FIG. 63, the removable tray 992 is shown from a bottom elevational view of the ice maker 970. As shown in FIG. 64, the ice maker 970 may further include a secondary air filter mechanism 996 adapted to receive an air filter 982 therein. The air filtering mechanism 996, as shown in FIG. 64, further includes a handle 998 which is accessible from a side portion of the ice maker 970 to remove the air filter mechanism 996 in a direction as indicated by arrow X.

Figure 66:
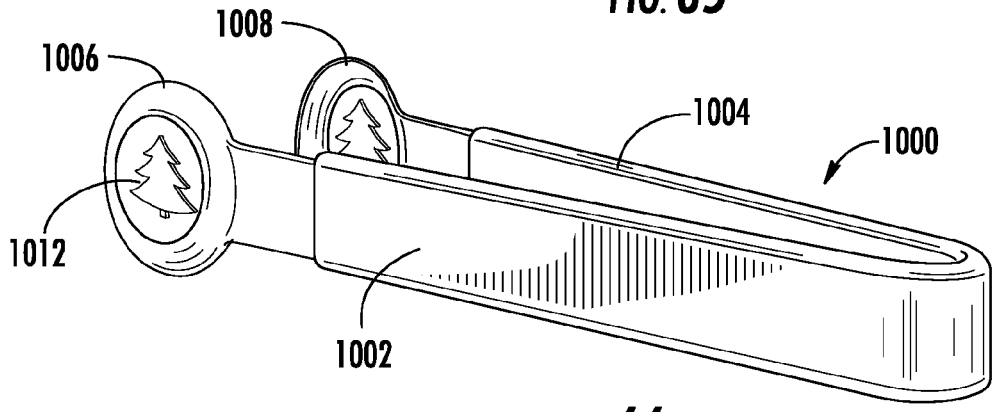
Figure 67:
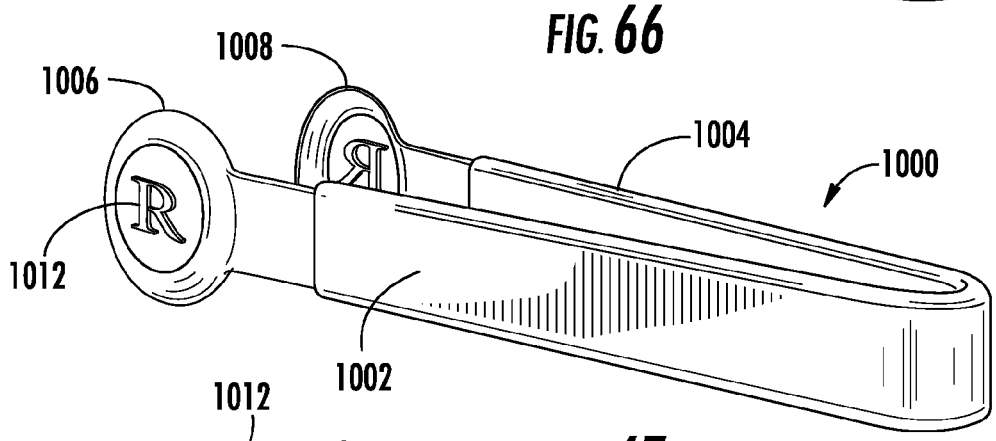
Figure 68:
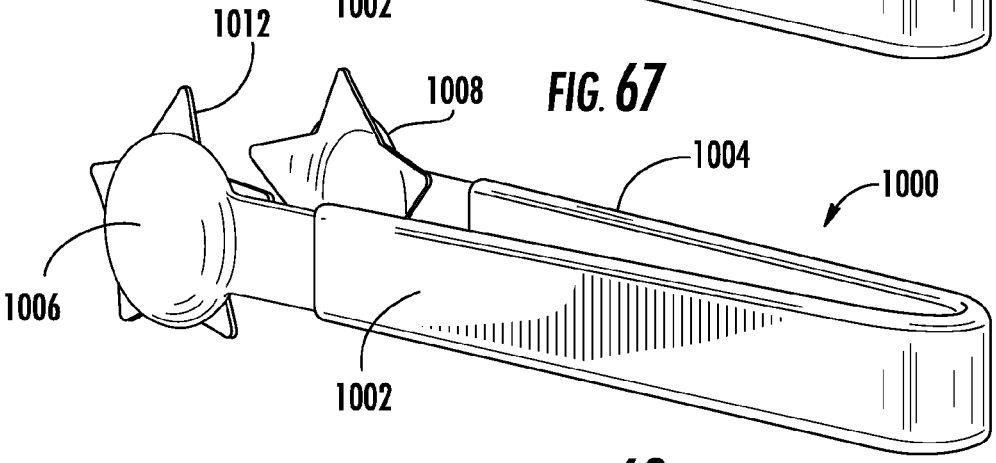

Referring now to FIGS. 65-68, a tong apparatus 1000 is depicted having a first arm 1002 and a second arm 1004 which provide for a generally U-shaped configuration of the tong apparatus 1000. At the ends of the first and second arms 1002, 1004 are ice retainment members 1006, 1008 which are adapted to grasp clear ice spheres produced using the ice maker and methods described above. It is noted in FIGS. 65-68, the ice retainment members 1006, 1008, are generally concaved in shape to better engage a spherical ice structure. In the embodiment shown in FIG. 65, an open aperture 1010 is disposed within a center of both the ice retainment members 1006, 1008. As shown in the embodiments of FIGS. 66-68, an embossing feature 1012 is disposed within the center portion 1010 of the ice retainment members 1006, 1008. The embossing feature 1012 is adapted to engage an ice structure between the ice retainment members 1006, 1008 and emboss a symbol or design on a clear ice structure, as shown in FIGS. 69 and 70.

Figure 69:
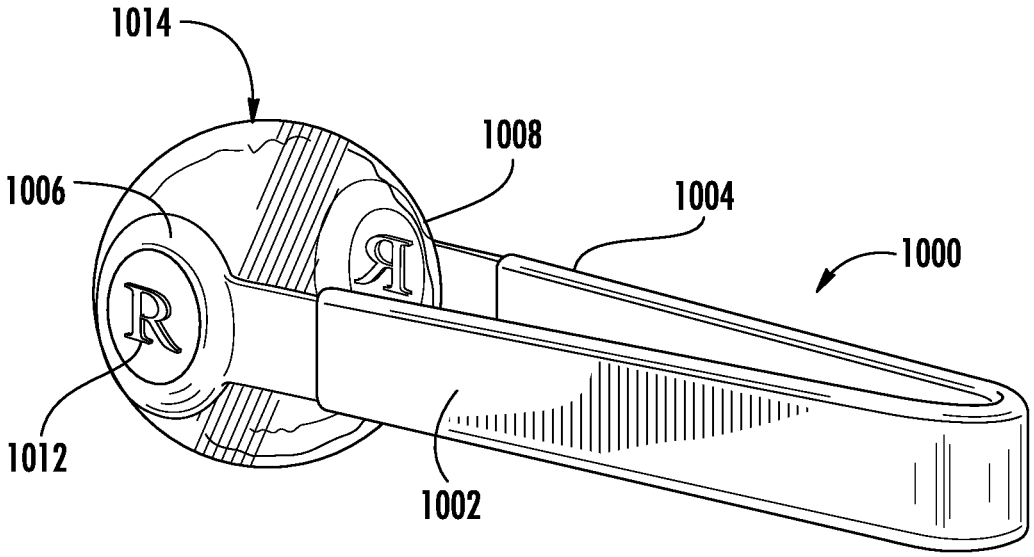
FIG. 69 is a perspective view of the tong mechanism of FIG. 67 engaging an ice structure.
Figure 70:
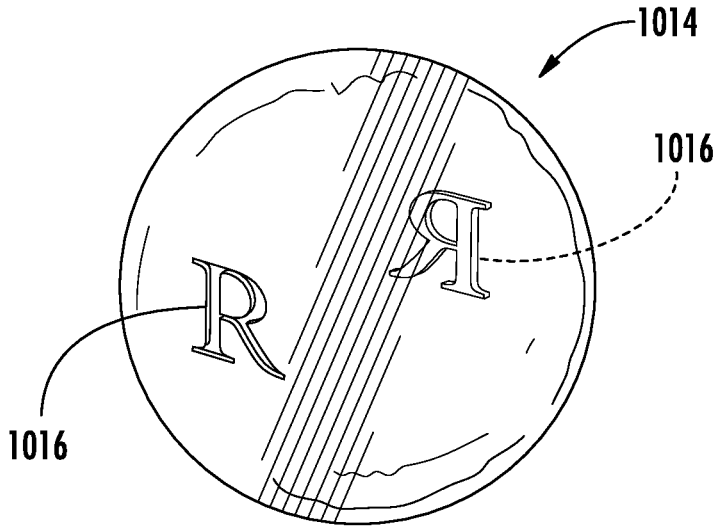
FIG. 70 is a perspective view of a resulting ice structure as embossed by the tong mechanism shown in FIG. 69.

Referring specifically to FIGS. 69 and 70, an ice structure 1014 is retained between the ice retainment members 1006, 1008 of a tong assembly 1000. The embossing feature 1012, shown in the form of an initial R, is embossed into the ice structure 1014 as shown in FIG. 70. The embossed image 1016 can be created by the tong assembly 1000 by having an embossing feature 1012 made of a metallic material, which is typically a raised metallic material that faces the ice structure 1014, or other like material that can melt ice when pressure is applied by closing the arms 1002, 1004 of the tong assembly 1000 about the clear ice structure 1014 to group the clear ice structure 1014. In this way, the tong assembly 1000 of the present invention allows for the consumer to customize the molded ice spheres as produced by the ice maker in the manner described above.

Figure 71:
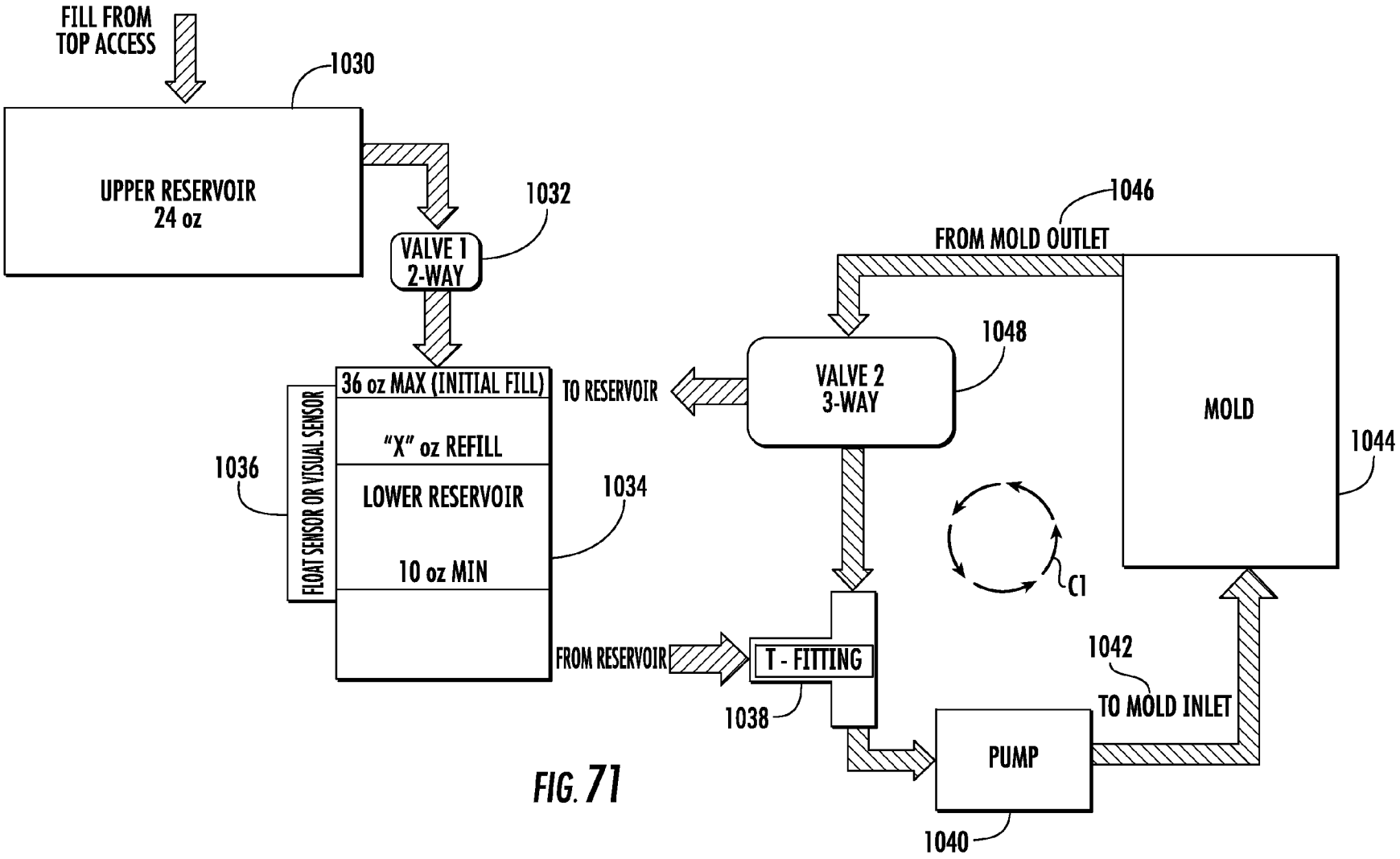
FIG. 71 is a diagrammatical flowchart of water management cycles.

Referring now to FIG. 71, a water management diagrammatical flowchart is depicted, wherein an upper reservoir 1030 is filled from the top access point or fill cap described above. As shown in FIG. 71, the water from the upper reservoir 1030 is then drawn through a two-way valve 1032 and deposited into a lower reservoir 1034. The lower reservoir 1034 has a maximum initial fill of 36 ounces and a minimum capacity of approximately 10 ounces as exemplified in the embodiment of FIG. 71. A float sensor or visual sensor 1036 is coupled to the lower reservoir 1034 such that the water level within the reservoir 1034 can be monitored. From the lower reservoir 1034, water is transmitted to a T-fitting 1038 as drawn by a pump 1040, which draws water from the lower reservoir 1034 to the T-fitting 1038 through the pump 1040 to a mold inlet 1042 disposed on a mold apparatus 1044. The mold apparatus 1044 is generally adapted to form clear ice structures by the procedures described above. The mold apparatus 1044 further includes a mold outlet 1046. Water that is not frozen during the ice formation process within the mold apparatus 1044 exits the mold apparatus 1044 through the mold outlet 1046 and continues to a second valve 1048, which is adapted to allow water to flow back to the lower reservoir 1034 or to the T-fitting 1038. Thus, a water management circulation cycle C is created between the mold 1044, the three-way valve 1048, the T-fitting 1038 and the pump 1040.

Figure 72:
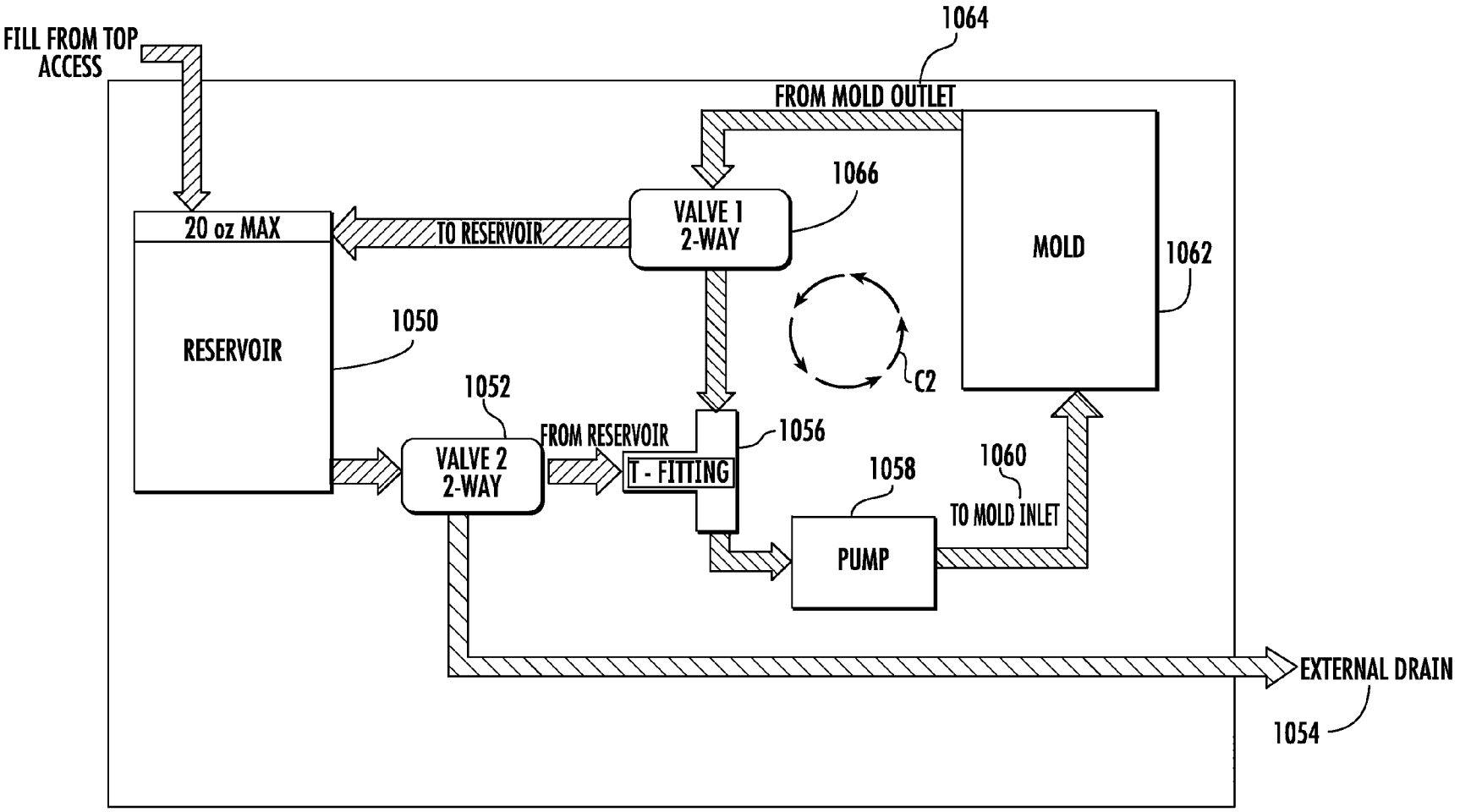
FIG. 72 is a diagrammatical flowchart of water management cycles.

Referring now to FIG. 72, a diagrammatical flowchart of a water management cycle is shown. A reservoir 1050 is filled from the fill cap disposed on an outer casing of an ice maker. The reservoir 1050, in this embodiment, has approximately a 20 ounce maximum. The water flows from the reservoir 1050 to a two-way valve 1052, which is adapted to permit water to flow to an external drain 1054 or to a T-fitting 1056. The water from the T-fitting 1056 is drawn through a pump 1058 to a mold inlet 1060 of a mold apparatus 1062. Water that is not used in the formation of ice structures in the mold apparatus 1062 is discharged from the mold apparatus 1062 through a mold outlet 1064 which feeds into a two-way valve 1066. The two-way valve 1066 is adapted to supply water to the reservoir 1050 or to the T-fitting 1056. In this way, a water management circulation cycle is created as indicated by arrow C2.

Figure 73:
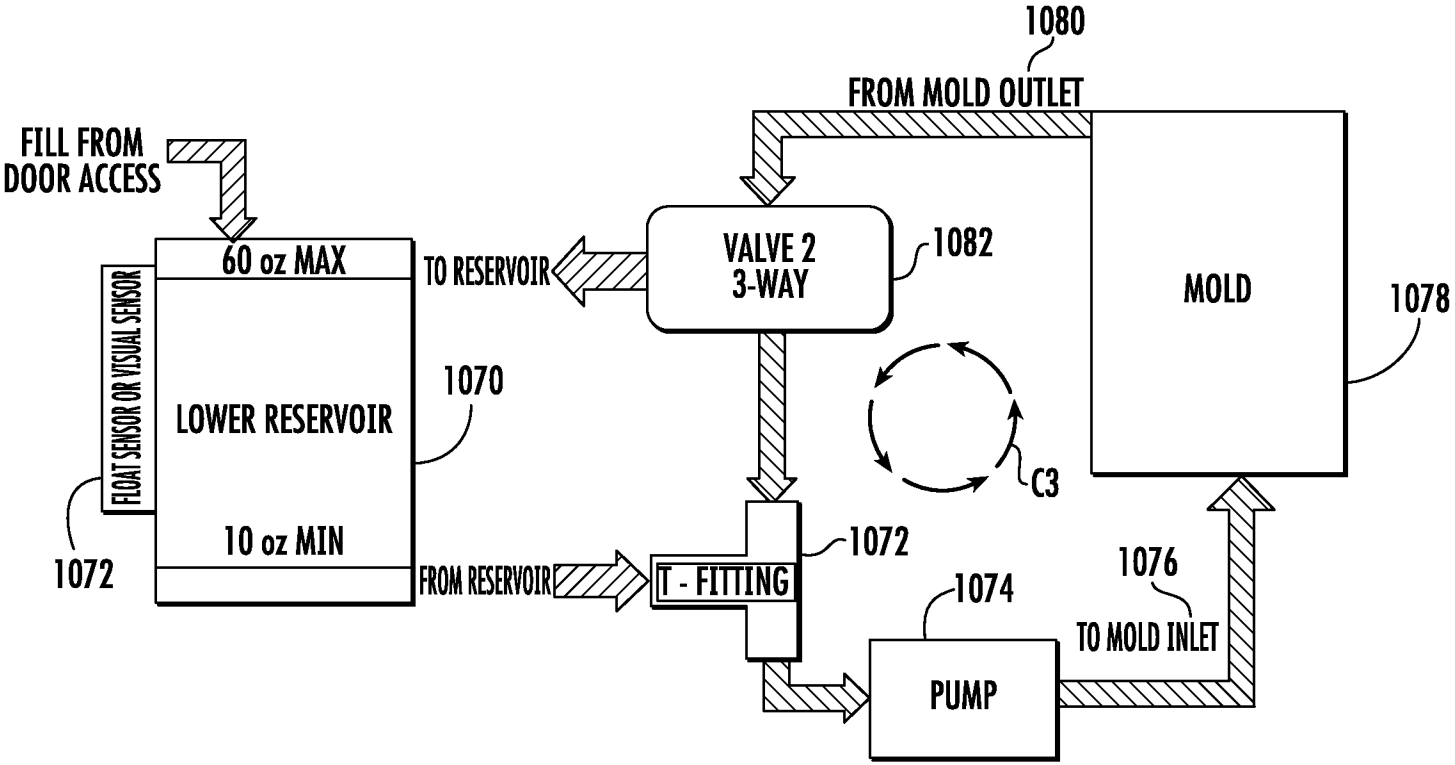
FIG. 73 is a diagrammatical flowchart of water management cycles.

Referring now to FIG. 73, a diagrammatical flowchart of a water management cycle is depicted, wherein a lower reservoir 1070 is filled from an access door or fill cap disposed on an ice maker. The lower reservoir 1070 is coupled to a float sensor or visual sensor 1072, which is adapted to indicate maximum and minimum amounts of water that can be stored in the lower reservoir 1070. The lower reservoir 1070 in this embodiment includes a 60 ounce maximum and a 10 ounce minimum. From the lower reservoir 1070, water is drawn through a T-fitting 1072 by a pump 1074. The pump 1074 then sends water to a mold apparatus 1078 through a mold inlet 1076. Water that is not frozen during an ice making process in the mold apparatus 1078 is expelled from a mold outlet 1080 and fed to a three-way valve 1082. The three-way valve 1082 is adapted to provide water to the reservoir 1070 or to the T-fitting 1072. In this way, a water management circulation cycle is created as indicated by arrow C3.

As noted in FIGS. 71, 72 and 73, water management circulation cycles C1, C2 and C3 are disposed therein where each water management circulation cycle includes a valve 1048, 1066 and 1082, respectively. The respective valves of the water management circulation cycles disclosed in FIGS. 71, 72 and 73 are adapted to close the cycle when enough water has entered the cycle for forming ice structures within the mold. Thus, the valves 1048, 1066 and 1082 are adapted to close the water management circulation loop after the water circulation loop has been flooded with enough water to create ice structures within the respective mold apparatuses. Similarly, the two-way valve 1052, shown in FIG. 72, is adapted to close once the water management circulation cycle C2 has been supplied with enough water, such that any remaining water from the reservoir that has already entered into the two-way valve can be expelled through an external drain 1054. By closing the water circulation loops in the water management cycles, the present invention is adapted to run more efficiently by keeping only the water in the circulation loop at a temperature suitable for forming ice structures.

Figure 74:
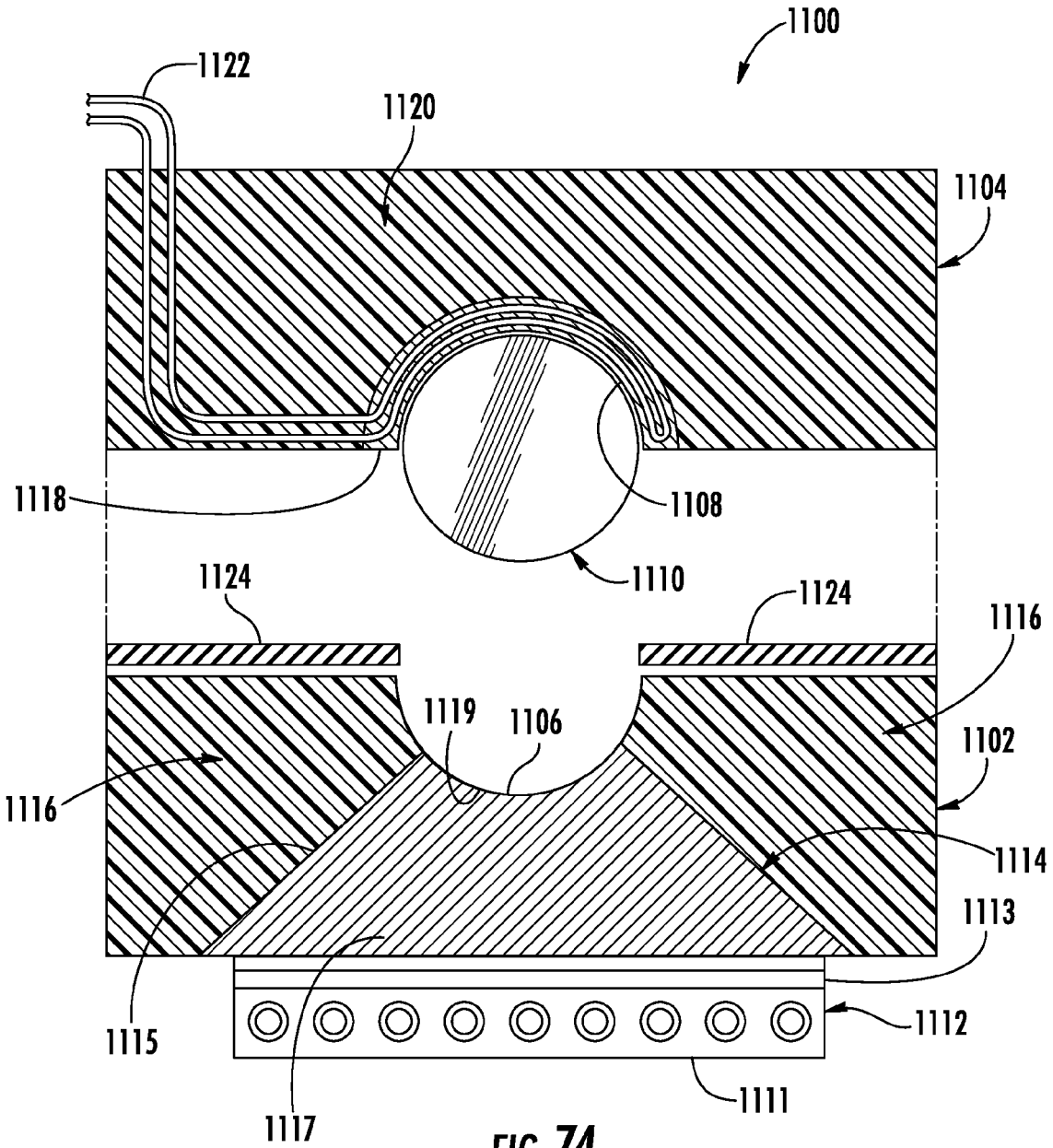
FIG. 74 is a cross-sectional view of a mold apparatus having multiple component parts of varying material makeup, wherein the mold apparatus is in an open position.

Referring now to FIG. 74, a mold apparatus 1100 is shown having a first mold portion 1102 and a second mold portion

1104. Each mold portion includes a mold cavity segment 1106, 1108 associated therewith. As shown in FIG. 74, the mold apparatus 1100 is in an open position, however, it is contemplated that when then mold apparatus 1100 is in a closed position the mold cavity segments 1106, 1108 are aligned to form a mold cavity used to form an ice structure, such as ice structure 1100. The first mold portion 1102 is operably coupled to a cooling source 1112. The cooling source 1112 is disposed adjacent to a metallic portion 1114, which is a conductive material that is part of the material makeup of the first mold portion 1102. It is contemplated that the metallic portion 1114 is comprised of a metallic material such as copper, aluminum, zinc or any other like metallic material that has a high thermal conductivity. An insulating portion 1116, which is contemplated to be comprised of a thermoplastic or other like polymeric material, surrounds a side wall 1115 of the metallic portion 1114 and is also a component part of the first mold portion 1102. The metallic portion 1114, as shown in FIG. 74, includes a first side 1117 and second side 1119 with the side wall 1115 disposed therebetween. The first side 1117 is in thermal communication with the cooling source 1112 while the second side 1119 defines, in part, the mold cavity segment 1106 of the first mold portion 1102 as further described below.

In the embodiment shown in FIG. 74, the second side 1119 of the highly conductive metallic portion 1114 selectively defines a lower center portion of the mold cavity segment 1106, such that the second side 1119 provides directed cooling to a center portion of the mold cavity segment 1106 that allows ice to develop or freeze in the mold cavity segment 1106 in a self-supporting manner. The cooling is again provided from the cooling source 1112 to the first side 1117 of the metallic portion 1114 to the second side 1119 of the metallic portion 1114. The insulating material portion 1116, disposed about the metallic portion 1114, further defines the mold cavity segment 1106 on an upper rim portion thereof. Thus, the mold cavity segment 1106 is defined by the second side 1119 of the metallic portion 1114 at a lower center portion, as well as by the insulating portion 1116 at an upper rim portion. The insulating material 1116 is strategically placed along the upper rim portion of the mold cavity segment 1106 to slow the growth or freeze rate of an ice formation where structure in the ice formation is not required. In this way, the ice will develop in a self-supporting manner within the mold cavity during an ice formation process and fracturing is at least substantially lessened or eliminated.

As shown in FIG. 74, a metallic portion 1118 comprised of a thermally conductive material, such as metal, may optionally be disposed in the second mold portion 1104 as a plate defining the mold cavity segment 1108 of the second mold portion 1104. Surrounding the conductive metallic plate 1118 is an insulating material 1120 which is made from a thermoplastic or other like polymeric material similar to the insulating portion 1116 of the first mold portion 1102. The insulating material is less thermally conductive than the metallic portion 1118 and the metallic portion 1114. The ice structure 1110 is shown disposed within the second mold portion 1104 in mold cavity segment 1108. An optional heating loop or heating coil 1122 is shown routed through the second mold portion 1104 to the conductive metallic plate 1118 defining the mold cavity segment 1108 of the second mold portion 1104. In this way, heat can be provided to the metallic plate portion 1118 of the second mold form 1104 to break bonds formed between the ice structure 1110 and the second mold portion 1104. In this way, the conductive metallic portion 1118, in thermal communication with the heating element 1122, provides for an efficient manner of harvesting ice structures by releasing them from the mold 1100. The mold apparatus 1100, shown in FIG. 74, further typically includes a sealing element 1124 that is disposed between the first and second mold forms 1102, 1104 for sealing the mold apparatus 1100 during an ice forming process. The metallic portion 1118 and the metallic portion 1114 of the mold apparatus 1110 are contemplated to be generally metallic mold portions that provide for a thermally conductive material to transfer cooling from the cooling source 1112 to a mold cavity as well as transfer heat from a heating element 1122 to the mold cavity in an efficient manner.

As shown in FIG. 74, the highly thermal conductive material 1114 extends generally about 45 degrees from the first side 1117 to the second side 1119 thereby defining a cone-like configuration. This configuration minimizes the cooling surface in the mold cavity segment 1106 which helps to minimize or altogether eliminate cracking in the ice structure formation process by not allow the ice to form too quickly. Having the insulating material 1116 disposed about the highly conductive metallic portion 1114 ensures a slower growth of ice in the mold cavity segment 1106 that is adjacent the insulating material 1116. This slower growth of ice forces the ice structure to freeze directionally from the second side 1119 of the highly conductive metallic portion 1114. As further shown in FIG. 74, the ice structure 1110 has bonded to the metallic plate 1118 when the mold apparatus 1100 is in the open position. Having this highly conductive metallic plate 1118 ensures that the structure 1110 will couple to the second mold portion 1104 when the mold 1100 opens. Further, it is contemplated that the cooling source 1112 can consist of an evaporator plate 1111 and a thermoelectric unit 1113 that can be sequenced to cool the first mold portion 1102 for freezing the ice structure 1110, as well as being sequenced to heat the first mold portion 1102 for releasing the ice structure 1110 from the mold cavity segment 1106. This sequenced heating effect provided by the cooling source 1112 helps ensure that the resulting ice structure 1110 will bond only with the second mold portion 1104 when the mold apparatus 1100 is open.

Figure 75:
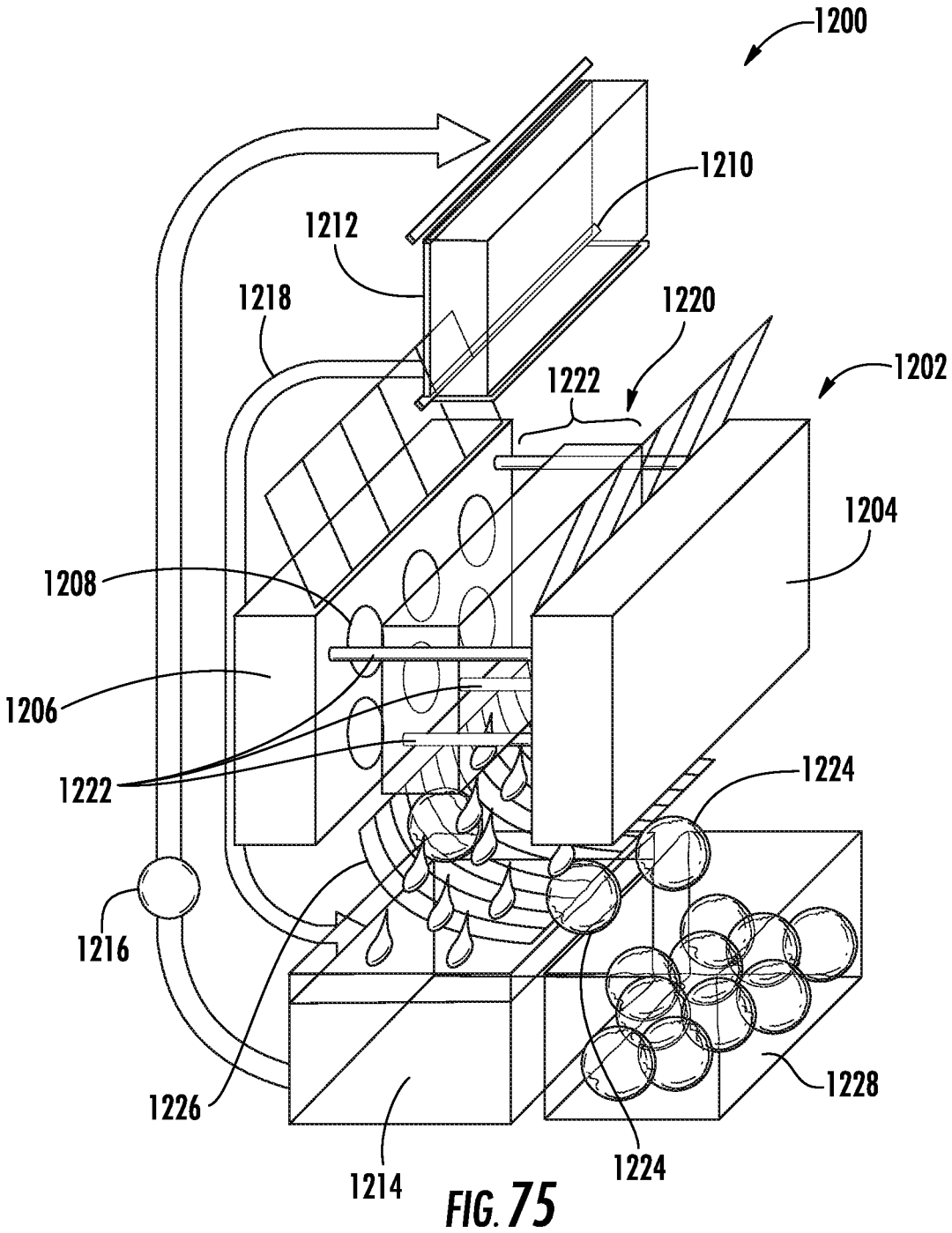
FIG. 75 is a perspective view of an ice making apparatus according to another embodiment of the present invention.
Figure 76:
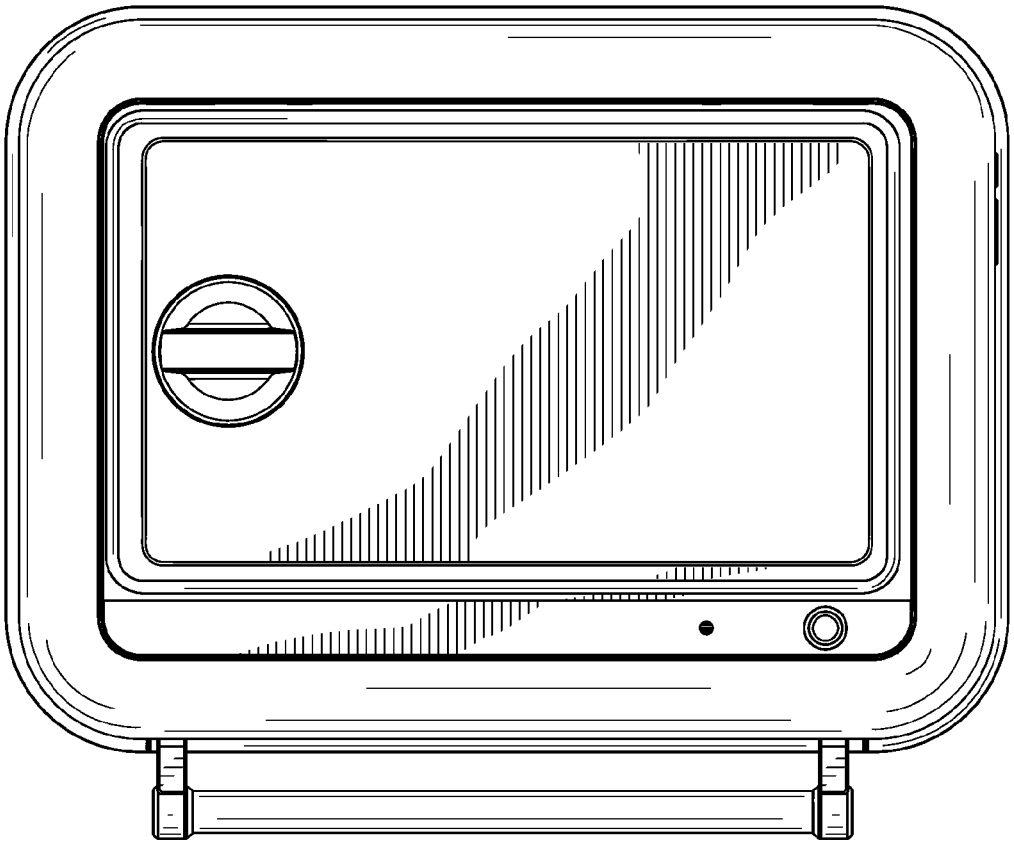
FIG. 76 is a top view of an ice maker according to the present invention.
Figure 77:
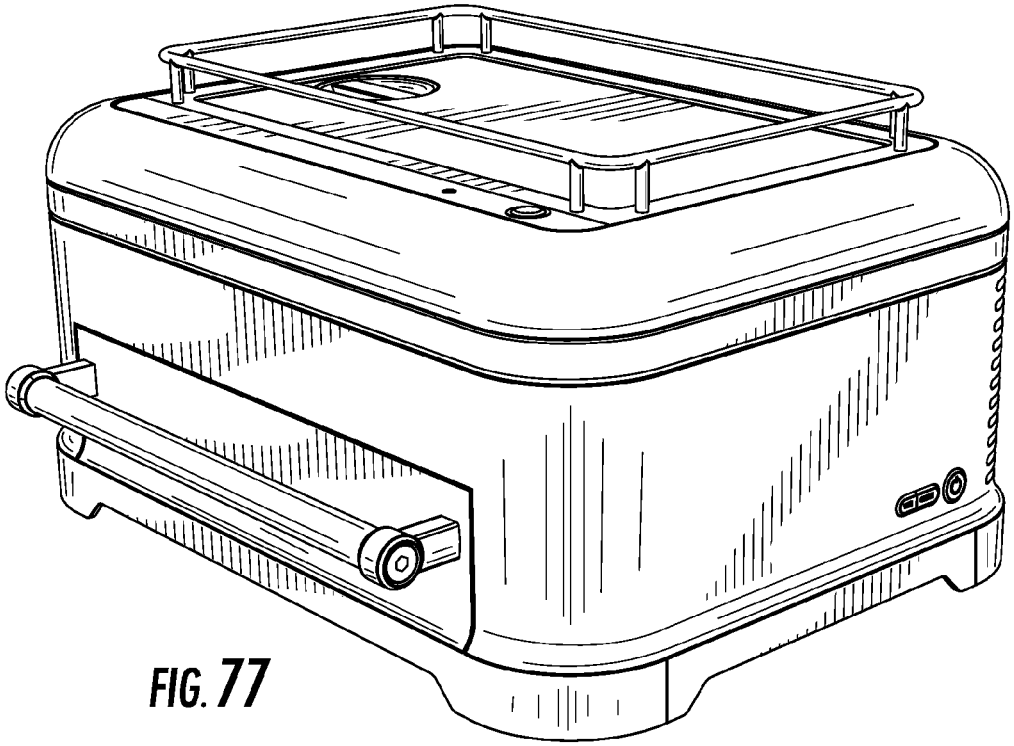
FIG. 77 is an upper right perspective view of an ice maker according to the present invention.
Figure 78:
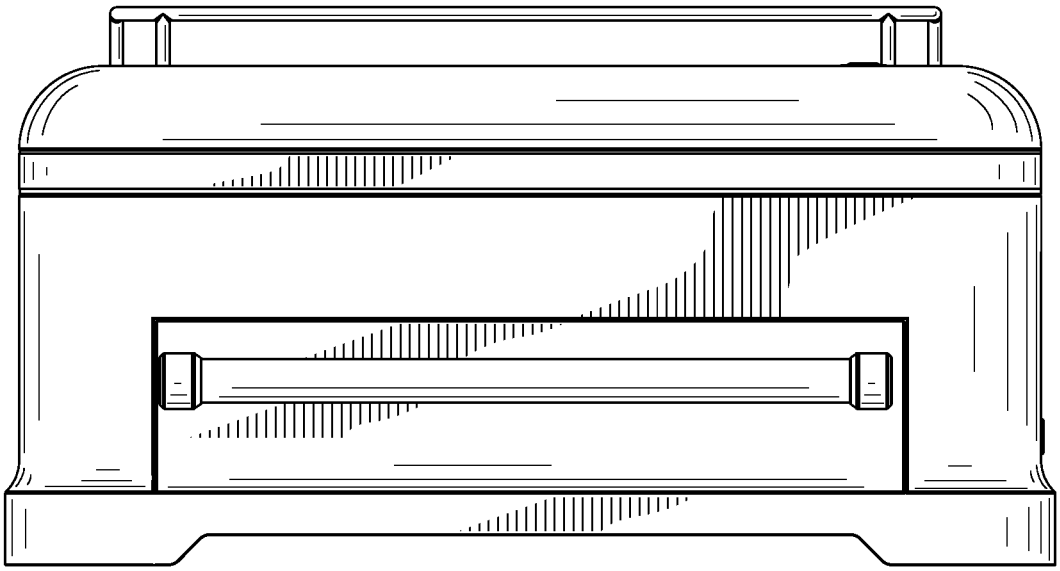
FIG. 78 is an elevated front view of an ice maker according to the present invention.
Figure 79:
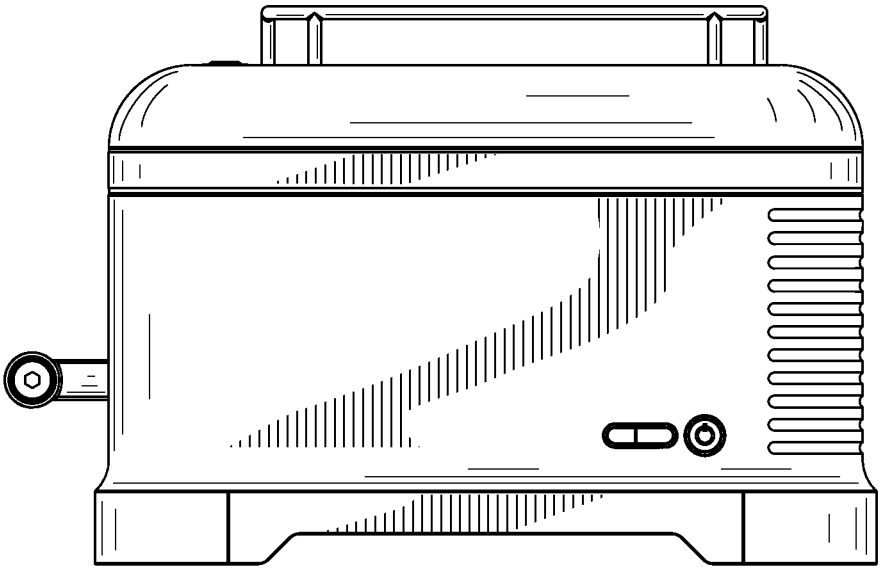
FIG. 79 is an elevated right side view of an ice maker according to the present invention.

Referring now to FIG. 75, an ice maker apparatus 1200 is shown having a mold apparatus 1202 that includes first and second mold portions 1204, 1206. Each of the first and second mold portions 1204, 1206 include reciprocal mold forms 1208. The mold forms 1208 are adapted to create mold cavities when the mold apparatus 1202 is in a closed position in a similar manner as described above. As shown in FIG. 75, a clear ice sheet 1210 is formed on an evaporator plate 1212 by running water over the evaporator plate 1212 as provided by a water reservoir 1214. The water reservoir 1214 stores water which is pumped to the evaporator plate 1212 via a pump 1216 to supply running water to the evaporator plate 1212 for the formation of the clear ice structure 1210. Water that is not frozen during the ice formation phase is recirculated through a water recirculation conduit 1218 and returned to the water reservoir 1214. As shown in FIG. 75, the mold apparatus 1202 is in an open position where the first and second mold portions 1204, 1206 define a channel 1220 therebetween. The clear ice sheet 1210, once formed, is deposited into the channel 1220 and is positioned by a plurality of positioning mechanism or guide rods 1222. Once in the channel 1220, the clear ice sheet 1210 is engaged on first and second sides of the clear ice sheet 1210 by the mold portions 1204, 1206. The mold portions 1204, 1206 are moved to a closed position about the ice sheet 1210 by a drive mechanism. It is contemplated that the drive mechanism may drive both of the mold portions 1204, 1206 or may drive either mold portions towards the other to close the mold apparatus 1202. By closing the mold apparatus 1202 about the ice sheet 1210, ice structures 1224 are formed in the mold cavities formed by the reciprocal mold forms 1208 of the first and second mold portions 1204, 1206. Once formed, the mold apparatus 1202 is driven to an open position or ice harvesting position, wherein the first and second mold forms 1204, 1206 separate to allow the formed ice structures 1224 to be ejected from the mold apparatus 1202. Upon ejection from the mold apparatus 1202, the ice structures, as shown in FIG. 75, are deposited onto an angled chute 1226, which is a grate-like angled chute, which allows water to pass through to the water reservoir 1214 disposed therebelow. The ice structures 1224 are directed by the angled chute 1226 to an ice storage container 1228 where they are stored until they are retrieved by the consumer. As shown in FIG. 75, the ice structures 1224 formed by the ice maker 1200 are clear ice spheres 1224. Further, it is contemplated that a heating element can be included in the mold apparatus 1202 which heats either of the first and second mold portions 1204, 1206 to facilitate the forming of the ice sheet 1210 into the clear ice spheres 1224. Heating of the mold portions 1204, 1206 is contemplated to be configured similarly to the heat coil apparatus 1122 shown in FIG. 74.

FIGS. 76-79 show additional views of an ice maker of the present invention. The rear of the ice maker shown in FIGS. 76-79 is identical or similar to the rear of the ice maker shown in FIG. 7. The vents may be fewer or greater in number and/or differently located.

It is also to be understood that variations and modifications can be made on the aforementioned structures and methods without departing from the concepts of the present invention, and further it is to be understood that such concepts are intended to be covered by the following claims unless these claims by their language expressly state otherwise.

What is claimed is:

1. An ice structure producing apparatus comprising:

a first mold portion having an outer surface area in thermal communication with a cooling source and at least one mold cavity segment disposed on the outer surface of the first mold portion;

a second mold portion having and outer surface and at least one liquid inlet configured to permit liquid ingress and at least one liquid outlet configured to permit liquid egress and further including at least one mold cavity segment disposed on the outer surface of the second mold portion;

at least one liquid delivery conduit fluidly connected to the at least one liquid inlet and a liquid source and a liquid departure conduit fluidly connected to the at least one liquid outlet;

wherein the first mold portion and the second mold portion are configured to engage with one another to form at least one mold cavity defined by the mold cavity segments of the first mold portion and the second mold portion;

wherein the cooling source in thermal communication with the first mold portion is configured to provide sufficient cooling to produce an ice structure within the at least one mold cavity when liquid capable of freezing solid is injected into the at least one mold cavity from the at least one liquid inlet;

wherein the first mold portion is configured to be cooled by the cooling source to a first temperature, and further wherein the first temperature is below a second temperature of the second mold portion during the freezing of the liquid injected into the at least one mold cavity;

wherein the second mold portion comprises a metallic portion and an insulating portion, and further wherein the metallic portion defines the mold cavity segment of the second mold portion; and a heating element disposed in the second mold portion in thermal communication with the metallic portion of the second mold portion.

2. The apparatus of claim 1, wherein the first mold portion comprises a metallic portion having a first side, a second side and a side wall disposed therebetween, and further wherein the first mold portion comprises an insulating portion disposed about the side wall of the metallic portion.

3. The apparatus of claim 2, wherein the first side of the metallic portion is disposed adjacent the cooling source, and further wherein the second side and the insulating portion cooperate to define the mold cavity segment of the first mold portion.

4. The apparatus of claim 3, wherein the metallic portion of the first mold portion is narrowed from the first side to the second side.

5. The apparatus of claim 3, including:

an evaporator and a thermoelectric disposed within the cooling source, wherein the cooling source is adapted to be sequenced to cool the first mold portion during the freezing of the liquid injected into the at least one mold cavity using the evaporator, and further heat the first mold portion during an ice harvesting process to release the ice structure from the first mold portion.

6. The apparatus of claim 1, including:

a sealing element disposed between the first mold portion and the second mold portion.

7. The apparatus of claim 1, wherein the first mold portion has a greater thermal conductivity relative to the second mold portion.

8. The apparatus of claim 1, wherein a temperature gradient is present across a length of the engaged first mold portion and second mold portion.

9. The apparatus of claim 1, wherein the mold cavity is at least substantially spherically shaped.

10. The apparatus of claim 9, wherein the ice structure is a clear ice sphere.

11. The apparatus of claim 1, wherein the at least one liquid inlet and the at least one liquid outlet share a common aperture and are operably engaged with the liquid delivery conduit and the liquid departure conduit through the common aperture and the liquid delivery conduit and liquid departure conduit are the same conduit with a liquid delivery channel and a liquid departure channel.

12. The apparatus of claim 1, wherein the cooling source comprises a cooling source chosen from one or more of the group consisting of: an evaporator, a thermoelectric source, a secondary cooling loop and air below freezing temperature.

13. The apparatus of claim 1, wherein the inlet and outlet are configured in a manner chosen from the group consisting of coaxially with one another and proximate one another.

14. The apparatus of claim 1, further comprising an ejection pin within the second portion and configured to apply a force to an ice structure formed within the at least one mold cavity.

15. The apparatus of claim 14, wherein the first mold portion and the second mold portion are substantially rectangularly prism shaped and the first portion is at least substantially metal and wherein the mold cavity is at least substantially spherical and has a equatorial plane and the ejection pin is offset from the equatorial plane and configured to project into the second mold cavity segment and the at least one liquid inlet is a single inlet and the at least one liquid outlet is a single outlet and the single inlet and single outlet are each at least substantially aligned with the equatorial plane.

16. An ice mold comprising:

a substantially metallic first mold portion having an outer surface area in thermal communication with a cooling source and at least one mold cavity segment disposed on the outer surface of the first mold portion;

a substantially polymeric second mold portion having an outer surface and at least one water inlet configured to permit water ingress and at least one water outlet configured to permit water egress and further including at least one mold cavity segment disposed on the outer surface of the second mold portion;

wherein the first mold portion and the second mold portion are configured to engage one another to form at least one mold cavity defined by the mold cavity segments of the first mold portion and the second mold portion;

a drive mechanism configured to move the first mold portion and the second mold portion between an ice structure forming position and an ice harvesting position;

an ejector apparatus coupled to one of the first mold portion and the second mold portion;

wherein the first mold portion is at a first temperature below the temperature of the second mold portion;

wherein the second mold portion comprises a metallic portion and an insulating portion, and further wherein the metallic portion defines the mold cavity segment of the second mold portion; and a heating element disposed in the second mold portion in thermal communication with the metallic portion of the second mold portion.

17. The ice mold of claim 16, wherein the ice mold is configured to produce clear ice structures and the first mold portion and the second mold portion are substantially rectangularly prism shaped and wherein the mold cavity is at least substantially spherical and has a equatorial plane and the ejector apparatus comprises an ejection pin that is offset from the equatorial plane and configured to project into the second mold cavity segment and the at least one water inlet is a single inlet and the at least one water outlet is a single outlet and the single inlet and single outlet are each at least substantially aligned with the equatorial plane.

18. An apparatus for making clear ice structures comprising:

a first mold portion comprising a metal material and having an outer surface in thermal communication with at least one thermoelectric cooling source that cools the first mold portion below freezing and wherein the first mold portion has at least one mold cavity segment disposed on the outer surface area of the first mold portion;

a second mold portion comprising a polymeric material and having an outer surface and at least one inlet configured to permit water ingress and at least one outlet configured to permit water egress and further including at least one mold cavity segment disposed on the outer surface of the second mold portion wherein the first mold portion and the second mold portion are configured such that the at least one mold cavity segment of the first mold portion and the at least one mold cavity segment of the second mold portion engage with one another to form at least one spherical mold cavity having a diameter in a range from about 20 mm to about 80 mm;

a motorized drive mechanism configured to move the first mold portion and the second mold portion between an ice structure forming position and an ice harvesting position;

a heat source engaged with the second mold portion and configured to emit heat and to facilitate a directional freezing of water injected into the at least one spherical mold cavity; and an ejector pin coupled to one of the first mold portion and the second mold portion wherein the ejector pin is configured to extend and retract between an extended position wherein a portion of the pin is disposed within the spherical mold cavity and a retracted position wherein the pin is disposed in one of the first mold portion and the second mold portion; and wherein the first mold portion has a higher thermal conductivity than the second mold portion.

* * * * *